US008827191B2

(12) United States Patent
Mather et al.

(10) Patent No.: US 8,827,191 B2
(45) Date of Patent: Sep. 9, 2014

(54) SPRAY APPLICATOR WITH MULTI-PIECE HOUSING

(75) Inventors: Brian D. Mather, North Olmsted, OH (US); James V. Bachman, Lorain, OH (US); Joseph G. Schroeder, North Royalton, OH (US); Terrence M. Fulkerson, Brunswick, OH (US); Herman E. Turner, Norwalk, OH (US)

(73) Assignee: Nordson Corporation, Westlake, OH (US)

( * ) Notice: Subject to any disclaimer, the term of this patent is extended or adjusted under 35 U.S.C. 154(b) by 169 days.

(21) Appl. No.: 13/012,907

(22) Filed: Jan. 25, 2011

(65) Prior Publication Data

US 2011/0114018 A1 May 19, 2011

Related U.S. Application Data

(63) Continuation of application No. 12/849,898, filed on Aug. 4, 2010, which is a continuation of application No. 11/140,759, filed on May 31, 2005, now Pat. No.

(Continued)

(51) Int. Cl.

| | |
|---|---|
| ***B05B 5/00*** | (2006.01) |
| ***B05B 7/14*** | (2006.01) |
| ***B05B 5/16*** | (2006.01) |
| *B05B 15/02* | (2006.01) |
| *B05B 12/14* | (2006.01) |

(52) U.S. Cl.

CPC ..... *B05B 5/32* (2013.01); *B05B 15/025* (2013.01); *B05B 12/14* (2013.01); *B05B 7/1459* (2013.01); *B05B 5/1683* (2013.01)

USPC ..... 239/690; 239/708; 239/433

(58) Field of Classification Search

USPC ..... 239/433, 526, 690–708, DIG. 14; 118/321, 323

See application file for complete search history.

(56) References Cited

U.S. PATENT DOCUMENTS

| | | | |
|---|---|---|---|
| 3,517,262 | A | 6/1970 | Juvinall et al. |
| 3,659,151 | A | 4/1972 | Fabre |

(Continued)

FOREIGN PATENT DOCUMENTS

| | | |
|---|---|---|
| DE | 24 46 022 | 4/1976 |
| DE | 4418288 | 11/1995 |

(Continued)

OTHER PUBLICATIONS

Versa-Spray II Automatic Powder Spray Gun product literature, Nordson Corporation, 2006.

(Continued)

*Primary Examiner* — Jason Boeckmann

(74) *Attorney, Agent, or Firm* — Calfee, Halter & Griswold LLP

(57) ABSTRACT

A nozzle assembly for a material application device includes an expansion chamber for slowing down the velocity of powder fed to the nozzle from a dense phase pump. The nozzle assembly includes a nozzle insert that forms the expansion chamber and provides air assist function. The nozzle includes an integral deflector, and further includes a passageway for a charging electrode so that the electrical path is routed away from the powder path, while permitting the electrode tip to be centered in the powder spray pattern from the nozzle. The nozzle also includes air wash for the electrode. The nozzle outlet orifice has a cross-sectional area that is equal to or greater than the inlet cross-sectional area so that a slow moving dense phase powder cloud is produced by the nozzle.

18 Claims, 37 Drawing Sheets

Related U.S. Application Data

7,793,869, which is a continuation-in-part of application No. 10/711,434, filed on Sep. 17, 2004, now abandoned, and a continuation-in-part of application No. 10/515,400, filed on Apr. 29, 2005, now abandoned, and a continuation-in-part of application No. PCT/US2004/026887, filed on Aug. 18, 2004.

(60) Provisional application No. 60/481,250, filed on Aug. 18, 2003, provisional application No. 60/523,012, filed on Nov. 18, 2003, provisional application No. 60/554,655, filed on Mar. 19, 2004, provisional application No. 60/524,459, filed on Nov. 24, 2003.

(56) References Cited

U.S. PATENT DOCUMENTS

| | | | | | |
|---|---|---|---|---|---|
| 4,241,880 | A | | 12/1980 | Hastings | |
| 4,502,629 | A | | 3/1985 | McGhee et al. | |
| 4,576,827 | A | | 3/1986 | Hastings et al. | |
| 4,598,871 | A | | 7/1986 | Hartle | |
| 4,630,777 | A | | 12/1986 | Hollstein et al. | |
| 4,824,026 | A | * | 4/1989 | Tamura et al. | 239/707 |
| 4,893,966 | A | | 1/1990 | Roehl | |
| 4,993,645 | A | | 2/1991 | Buschor | |
| 5,351,903 | A | | 10/1994 | Mazakas et al. | |
| 5,584,931 | A | | 12/1996 | Buhlmann | |
| 5,620,138 | A | | 4/1997 | Crum | |
| 5,636,798 | A | | 6/1997 | Buschor | |
| 5,720,436 | A | | 2/1998 | Buschor | |
| 5,743,958 | A | | 4/1998 | Shutic | |
| 5,759,271 | A | | 6/1998 | Buschor | |
| 5,853,126 | A | * | 12/1998 | Alexander | 239/700 |
| 5,922,131 | A | | 7/1999 | Haas | |
| 6,105,886 | A | * | 8/2000 | Hollstein et al. | 239/700 |
| 6,325,572 | B1 | | 12/2001 | Dietrich | |
| 6,375,094 | B1 | | 4/2002 | Schroeder et al. | |
| 6,478,242 | B1 | | 11/2002 | Knobbe et al. | |
| 6,508,610 | B2 | | 1/2003 | Dietrich | |
| 6,622,948 | B1 | | 9/2003 | Haas et al. | |
| 6,623,215 | B2 | | 9/2003 | Dietrich | |
| 6,712,291 | B2 | | 3/2004 | Mauchle | |
| 6,935,583 | B2 | | 8/2005 | Mauchle | |
| 7,128,277 | B2 | * | 10/2006 | Schaupp | 239/700 |
| 7,793,869 | B2 | * | 9/2010 | Mather et al. | 239/690 |
| 2003/0006321 | A1 | | 1/2003 | Mather | |
| 2003/0042341 | A1 | | 3/2003 | Buschor et al. | |
| 2003/0071143 | A1 | | 4/2003 | Mauchle | |
| 2003/0080220 | A1 | | 5/2003 | Mather et al. | |
| 2005/0095071 | A1 | | 5/2005 | Kleineidam et al. | |
| 2005/0178325 | A1 | | 8/2005 | Herre et al. | |

FOREIGN PATENT DOCUMENTS

| | | |
|---|---|---|
| DE | 19621072 | 11/1997 |
| DE | 196 54 523 | 2/1998 |
| DE | 10147858 | 4/2003 |
| DE | 10150759 | 4/2003 |
| EP | 0 509 367 | 10/1992 |
| EP | 0680790 | 8/1995 |
| EP | 1 080 789 | 3/2001 |
| EP | 1 084 759 | 3/2001 |
| EP | 2179795 | 6/2012 |
| JP | 9-71325 | 3/1997 |
| JP | 9-150105 | 6/1997 |
| WO | 03/024612 | 5/2003 |
| WO | 03/024613 | 5/2003 |
| WO | 2004/087331 | 10/2004 |
| WO | 2005/005060 | 1/2005 |

OTHER PUBLICATIONS

European Search Report dated Mar. 18, 2011, for European Patent Application No. 10179872.6.

European Search Report dated Mar. 28, 2011, for European Patent Application No. 10179879.1.

Office Action for Canadian Patent Application No. 2,534,254 dated Nov. 21, 2011.

Letter from Meissner Bolte to EPO dated Nov. 3, 2010 regarding Opposition of EP Patent No. 1 658 142.

Letter from Nuckel to EPO dated Nov. 3, 2010 regarding Opposition of EP Patent No. 1 658 142.

* cited by examiner

SPRAY APPLICATOR WITH MULTI-PIECE HOUSING

RELATED APPLICATIONS

This application is a continuation of pending U.S. application Ser. No. 12/849,898 filed on Aug. 4, 2010 for PARTICULATE MATERIAL APPLICATOR AND PUMP which is a continuation of pending U.S. application Ser. No. 11/140,759 filed on May 31, 2005 for IMPROVED PARTICULATE MATERIAL APPLICATOR AND PUMP which is a continuation in part of pending U.S. patent application Ser. No. 10/711,434 filed on Sep. 17, 2004 for IMPROVED PARTICULATE MATERIAL APPLICATION SYSTEM, Ser. No. 10/515,400 filed on Nov. 19, 2004 for SPRAY APPLICATOR FOR PARTICULATE MATTER and International application number PCT/US04/26887 filed on Aug. 18, 2004 for SPRAY APPLICATOR FOR PARTICULATE MATTER, and further by such continuations claims the benefit of U.S. provisional patent application Ser. Nos. 60/481,250 filed on Aug. 18, 2003, for POWDER APPLICATOR WITH PATTERN ADJUSTMENT; 60/523,012 filed on Nov. 18, 2003 for POWDER SPRAY APPLICATOR; 60/554,655 filed on Mar. 19, 2004 for POWDER COATING MATERIAL SPRAY GUN; and 60/524,459 filed Nov. 24, 2003 for PINCH PUMP WITH VACUUM TUBE, the entire disclosures all of which are fully incorporated herein by reference.

TECHNICAL FIELD OF THE INVENTION

The invention relates generally to material application systems, for example but not limited to powder coating material application systems. More particularly, the invention relates to an applicator and a pump that reduce cleaning time, color change time and improves ease of use.

BACKGROUND OF THE INVENTION

Material application systems are used to apply one or more materials in one or more layers to an object. General examples are powder coating systems, as well as other particulate material application systems such as may be used in the food processing and chemical industries. These are but a few examples of a wide and numerous variety of systems used to apply particulate materials to an object and to which the present invention can find realization.

The application of dry particulate material is especially challenging on a number of different levels. An example, but by no means a limitation on the use and application of the present invention, is the application of powder coating material to objects using a powder spray gun. Because sprayed powder tends to expand into a cloud or diffused spray pattern, known powder application systems use a spray booth for containment. Powder particles that do not adhere to the target object are generally referred to as powder overspray, and these particles tend to fall randomly within the booth and will alight on almost any exposed surface within the spray booth. Therefore, cleaning time and color change times are strongly related to the amount of surface area that is exposed to powder overspray.

In addition to exterior surface areas exposed to powder overspray, color change times and cleaning are strongly related to the amount of interior surface area exposed to the flow of powder during an application process. Examples of such interior surface areas include all surface areas that form the powder flow path, from a supply of the powder all the way through the powder spray gun. The powder flow path typically includes a pump that is used to transfer powder from a powder supply to one or more spray guns. Hoses are commonly used to interconnect the supply, pumps and guns.

Interior surface areas of the powder flow path are typically cleaned by blowing a purge gas such as pressurized air through portions of the powder flow path. Wear items that have surfaces exposed to material impact, for example a spray nozzle in a typical powder spray gun, can be difficult to clean due to impact fusion of the powder on the wear surfaces.

Most powder spray application systems use a powder containment booth or spray booth in which the objects are sprayed. Powder overspray is collected by a powder recovery system, which typically operates on the basis of drawing a large volume of air from the spray booth, usually through openings in the walls or floor. This large air volume acts as containment air to prevent powder overspray from falling outside the spray booth. This containment air has entrained powder overspray which is separated from the containment air by a suitable device such as primary filters or cyclones. Since the primary filters or cyclones do not typically extract 100% of the entrained powder overspray, after filters are used to filter out residual powder from the air before venting to atmosphere.

Known supply systems for powder coating materials generally involve a container such as a box or hopper that holds a fresh supply of new or 'virgin' powder. This powder is usually fluidized within the hopper, meaning that air is pumped into the powder to produce an almost liquid-like bed of powder. Fluidized powder is typically a rich mixture of material to air. Often, recovered powder overspray is returned to the supply via a sieve arrangement. A venturi pump is used to draw powder through a suction line or tube from the supply into a feed hose and then to push the powder under positive pressure through the hose to a spray gun. Such systems are difficult to clean for a color change operation because the venturi pumps cannot be reverse purged, the suction tubes and associated support frames retain powder and changing the hoppers can be time consuming. The sieve is also challenging and time consuming to clean as it often is in a separate housing structure as part of the powder recovery system or is otherwise not easily accessible. Most of these components need to be cleaned by use of a high pressure air wand which an operator manually uses to blow powder residue back up into a cyclone or other powder recovery unit. Every minute that operators have to spend cleaning and purging the system for color change represents downtime for the system and inefficiency.

There are two generally known types of dry particulate material transfer processes, referred to herein as dilute phase and dense phase. Dilute phase systems utilize a substantial quantity of air to push material through one or more hoses from a supply to a spray applicator. A common pump design used in powder coating systems is the venturi pump which introduces a large volume of air at higher velocity into the powder flow. In order to achieve adequate powder flow rates (in pounds per minute or pounds per hour for example), the components that make up the flow path must be large enough to accommodate the flow with such a high air to material ratio (in other words lean flow) otherwise significant back pressure and other deleterious effects can occur.

Dense phase systems on the other hand are characterized by a high material to air ratio (in other words rich flow). A dense phase pump is described in pending U.S. patent application Ser. No. 10/501,693 filed on Jul. 16, 2004 for PROCESS AND EQUIPMENT FOR THE CONVEYANCE OF POWDERED MATERIAL, the entire disclosure of which is fully incorporated herein by reference, and which is owned by the assignee of the present invention. This pump is characterized in general by a pump chamber that is partially defined by a gas permeable member. Material, such as powder coating material as an example, is drawn into the chamber at one end by gravity and/or negative pressure and is pushed out of the chamber through an opposite end by positive air pressure. This pump design is very effective for transferring material, in part due to the novel arrangement of a gas permeable member forming part of the pump chamber. The overall pump, however, in some cases may be less than optimal for purging, cleaning, color change, maintenance and material flow rate control.

Many known material application systems utilize electrostatic charging of the particulate material to improve transfer efficiency. One form of electrostatic charging commonly used with powder coating material is corona charging that involves producing an ionized electric field through which the powder passes. The electrostatic field is produced by a high voltage source connected to a charging electrode that is installed in the electrostatic spray gun. Typically these electrodes are disposed directly within the powder path.

SUMMARY OF THE INVENTION

The invention provides apparatus and methods for improving the cleanability and reducing color change time for a material application system. Cleanability refers, among other things, to reducing the quantity of powder overspray that needs to be removed from exterior surfaces of the applicator and internal surfaces of the spray booth, and therefore is also related to the transfer efficiency. Cleanability also can refer to reducing the quantity of powder that needs to be purged or otherwise removed from interior surfaces that define the powder path from the supply through the spray applicator outlet. Cleanability can also refer to the ease with which the powder flow path can be purged or otherwise cleaned. Improving cleanability results in faster color change times by reducing contamination risk and shortening the amount of time needed to remove a first color powder from the powder flow path prior to introducing a second color powder.

In accordance with one aspect of the invention, cleanability is improved by providing improved transfer efficiency. By transfer efficiency is meant the percentage or ratio of sprayed powder that adheres to the target object to the total powder sprayed. In one embodiment, transfer efficiency is improved by a nozzle design that produces a slow moving dense phase cloud of powder. In one embodiment, a nozzle is provided that includes an expansion chamber to slow the powder flow exiting the nozzle. In a more particular embodiment, the cross-sectional area of the outlet orifice is greater than the cross-sectional area of the delivery hose connected to the nozzle. Air assist within the nozzle may optionally be provided for atomization and/or to produce a penetrating velocity. For electrostatic applicators, an electrode is provided that charges the cloud of powder on axis but with which the electrode and electrode holder are not disposed in the powder flow path. Other optional features in other embodiments include air wash of the electrode and a filter arrangement to prevent back flow of powder into the air passages used for air assist within the nozzle. An additional optional feature includes an integral deflector as part of the nozzle body.

The invention also contemplates an improved color change sequence and pump operation.

The invention also contemplates an alternative technique for providing negative pressure or suction to a dense phase pump. In one embodiment, a negative pressure reservoir or accumulator is used to separate the negative pressure source and timing from the pump chambers and related timing.

In further accordance with this aspect of the invention, interior surface areas are reduced by designing the spray applicator to operate with high density low volume powder feed. In this context, high density means that the powder fed to the spray applicator has a substantially reduced amount of entrainment or flow air in the powder as compared to conventional powder flow systems. Low volume simply refers to the use of less volume of flow air needed to feed the powder due to its higher density as compared to conventional powder spray guns. By removing a substantial amount of the air in the powder flow, the associated conduits, such as a powder feed hose and a powder feed tube, can be substantially reduced in diameter, thereby substantially reducing the interior surface area. This also results in an significant reduction in the overall size of the spray applicator, thus further reducing the amount of exterior surface area exposed to powder overspray. For manually operated spray applicators, the invention provides an easily replaceable or removable powder path. In any case, a powder flow path is realized that optionally comprises only a single part.

In accordance with another aspect of the invention, a pump and applicator arrangement is contemplated that uses an air cap rather than a nozzle and has a single internal diameter in the powder flow path from the pump outlet to the applicator outlet.

In accordance with another aspect of the invention, spray pattern adjustment is implemented with adjustment of the material flow rate. In one embodiment, when the spray pattern is adjusted by changing the air directed at the powder stream, the material flow rate is adjusted accordingly. The control of pattern shape and flow rates are additional parameters that may be individually or together included in the material application recipes for various objects being processed.

These and other aspects and advantages of the present invention will be apparent to those skilled in the art from the following description of the preferred embodiments in view of the accompanying drawings.

DETAILED DESCRIPTION OF THE INVENTION AND EXEMPLARY EMBODIMENTS THEREOF

Figure 1:
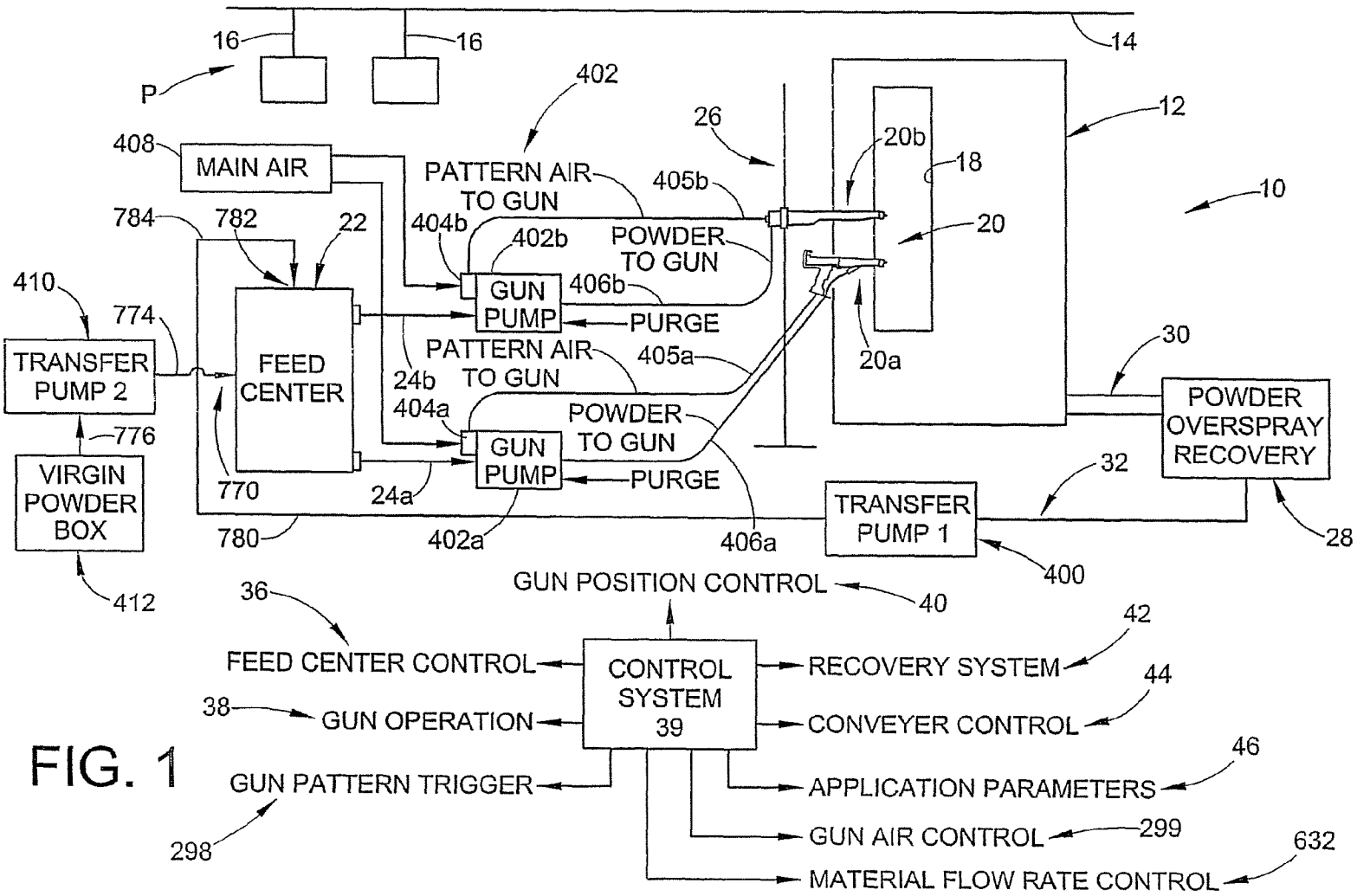
FIG. 1 is a simplified schematic diagram of a powder coating material application system utilizing the present invention.

The invention contemplates a variety of new aspects for a particulate material application system. In general, the invention is directed to three major system functions, namely the supply of material, the applicator used to apply material to an object and a transfer device or pump for transferring powder from the supply to an applicator or from a recovery system to the supply. The three main system functions operationally interface with each other as well as other functions of a typical material application system, including an overspray containment function typically in the form of a spray booth and an overspray recovery function typically in the form of a filter based or cyclone based material recovery devices.

From a system perspective, the invention is directed among other things to improving the cleanability of the system so as to significantly reduce the total time needed for a color change operation. In addition, the invention is directed to various aspects that make the system or subsystems easier to use with less manpower and time involved. In exemplary embodiments of the invention the material is handled in dense phase, but not all aspects of the invention need to be implemented only with dense phase systems.

By "dense phase" is meant that the air present in the particulate flow is about the same as the amount of air used to fluidize the material at the supply such as a feed hopper. As used herein, "dense phase" and "high density" are used to convey the same idea of a low air volume mode of material flow in a pneumatic conveying system where not all of the material particles are carried in suspension. In such a dense phase system, the material is forced along a flow passage by significantly less air volume, with the material flowing more in the nature of plugs that push each other along the passage, somewhat analogous to pushing the plugs as a piston through the passage. With smaller cross-sectional passages this movement can be effected under lower pressures.

In contrast, conventional flow systems tend to use a dilute phase which is a mode of material flow in a pneumatic conveying system where all the particles are carried in suspension. Conventional flow systems introduce a significant quantity of air into the flow stream in order to pump the material from a supply and push it through under positive pressure to the spray application devices. For example, most conventional powder coating spray systems utilize venturi pumps to draw fluidized powder from a supply into the pump. A venturi pump by design adds a significant amount of air to the powder stream. Typically, flow air and atomizing air are added to the powder to push the powder under positive pressure through a feed hose and an applicator device. Thus, in a conventional powder coating spray system, the powder is entrained in a high velocity high volume of air, thus necessitating large diameter powder passageways in order to attain usable powder flow rates.

Dense phase flow is oftentimes used in connection with the transfer of material to a closed vessel under high pressure. The present invention, in being directed to material application rather than simply transport or transfer of material, contemplates flow at substantially lower pressure and flow rates as compared to dense phase transfer under high pressure to a closed vessel.

As compared to conventional dilute phase systems having air volume flow rates of about 3 to about 6 cfm (such as with a venturi pump arrangement, for example), the present invention may operate at about 0.8 to about 1.6 cfm, for example. Thus, in the present invention, powder delivery rates may be on the order of about 150 to about 300 grams per minute.

Dense phase versus dilute phase flow can also be thought of as rich versus lean concentration of material in the air stream, such that the ratio of material to air is much higher in a dense phase system. In other words, in a dense phase system the same amount of material per unit time is transiting a cross-section (of a tube for example) of lesser area as compared to a dilute phase flow. For example, in some embodiments of the present invention, the cross-sectional area of a powder feed tube is about one-fourth the area of a feed tube for a conventional venturi type system. For comparable flow of material per unit time then, the material is about four times denser in the air stream as compared to conventional dilute phase systems.

The present invention is directed to a material application system that includes a spray applicator and various improvements therein, some of which are specific to a low pressure dense phase applicator, but others of which will find application in many types of material flow systems, whether dense phase, low pressure dense phase, or other. Accordingly, as to the applicator, the present invention is not specifically concerned with the manner in which a dense phase material flow is created and fed to the applicator. In general, dense phase delivery is performed by a pump that operates to pull material into a chamber under negative pressure and discharge the material under positive pressure with a low air volume as noted above. There are a number of known dense phase pump and transfer systems, including but not limited to the following disclosures: EP Application No. 03/014,661.7; PCT Publication 03/024,613 A1; and PCT Publication 03/024,612 A1; the entire disclosures of which are fully incorporated herein by reference.

The invention also contemplates a number of new aspects for a dense phase pump for particulate material. The pump may be used in combination with any number or type of spray applicator devices or spray guns and material supply. The invention further contemplates improvements in color change processes.

With reference to FIG. 1, in an exemplary embodiment, the present invention is illustrated being used with a material application system, such as, for example, a typical powder coating spray system 10. Such an arrangement commonly includes a powder spray booth 12 in which an object or part P is to be sprayed with a powder coating material. The application of powder to the part P is generally referred to herein as a powder spray, coating or application operation or process, however, there may be any number of control functions, steps and parameters that are controlled and executed before, during and after powder is actually applied to the part.

As is known, the part P is suspended from an overhead conveyor 14 using hangers 16 or any other conveniently suitable arrangements. The booth 12 includes one or more openings 18 through which one or more spray applicators 20 may be used to apply coating material to the part P as it travels through the booth 12. The applicators 20 may be of any number depending on the particular design of the overall system 10. Each applicator can be a manually operated device as in device 20*a*, or a system controlled device, referred to herein as an automatic applicator 20*b*, wherein the term "automatic" simply refers to the fact that an automatic applicator is mounted on a support and is triggered on and off by a control system, rather than being manually supported and manually triggered.

It is common in the powder coating material application industry to refer to the powder applicators as powder spray guns, and with respect to the exemplary embodiments herein we will use the terms applicator and gun interchangeably. However, it is intended that the invention is applicable to material application devices other than powder spray guns, and hence the more general term applicator is used to convey the idea that the invention can be used in many material application systems in addition to powder coating material application systems. Some aspects of the invention are applicable to electrostatic spray guns as well as non-electrostatic spray guns. The invention is also not limited by functionality associated with the word "spray". Although the invention is especially suited to powder spray application, the pump concepts and methods disclosed herein may find use with other material application techniques beyond just spraying, whether such techniques are referred to as dispensing, discharge, application or other terminology that might be used to describe a particular type of material application device.

The spray guns 20 receive powder from a feed center or supply 22 through an associated powder feed or supply hose 24. The terms "feed center" and "supply" are used interchangeably herein to refer to any source of particulate material in accordance with the present invention. To the extent that the supply 22 mimics a feed hopper in the sense of being a container for powder, the supply 22 can be thought of and referred to as a hopper.

The automatic guns 20*b* typically are mounted on a support 26. The support 26 may be a simple stationary structure, or may be a movable structure, such as an oscillator that can move the guns up and down during a spraying operation, or a gun mover or reciprocator that can move the guns in and out of the spray booth, or a combination thereof.

The spray booth 12 is designed to contain powder overspray within the booth, usually by a large flow of containment air into the booth. This air flow into the booth is usually effected by a powder overspray reclamation or recovery system 28. The recovery system 28 pulls air with entrained powder overspray from the booth, such as for example through a duct 30. In some systems the powder overspray is returned to the feed center 22 as represented by the return line 32. In other systems the powder overspray is either dumped or otherwise reclaimed in a separate receptacle.

In the exemplary embodiment herein, powder is transferred from the recovery system 28 back to the feed center 22 by a first transfer pump 400. A respective gun pump 402 is used to supply powder from the feed center 22 to one or more associated spray applicator or gun 20. For example, a first pump 402*a* is used to provide dense phase powder flow to the manual gun 20*a* and a second pump 402*b* is used to provide dense phase powder flow to the automatic gun 20*b*. The design of the gun pumps and transfer pumps may be any conveniently available or suitable design. Dense phase pumps, such as for example the pump described in the patent application noted hereinabove or as further described herein below, or dilute phase pumps may be used.

Each gun pump 402 operates from pressurized gas such as ordinary air supplied to the gun by a pneumatic supply manifold 404. Although each manifold and pump assembly is schematically illustrated in FIG. 1 as being directly joined, it is contemplated that in practice the manifolds 404 will be disposed in a cabinet or other enclosure and directly mounted to the pumps 402 through an opening in a wall of the cabinet. In this manner, the manifolds 404, which may include electrical power such as solenoid valves, are isolated from the spraying environment.

The manifold 404 supplies pressurized air to its associated pump 402 for purposes that will be explained hereinafter. In addition, each manifold 404 includes a pressurized pattern air supply 405 that is provided to the spray guns 20 via air hoses or lines 406. Main air 408 is provided to the manifold 404 from any convenient source within the manufacturing facility of the end user of the system 10.

In this embodiment, a second transfer pump 410 is used to transfer powder from a supply 412 of virgin powder (that is to say, unused) to the feed center 22. Those skilled in the art will understand that the number of required transfer pumps 410 and gun pumps 402 will be determined by the requirements of the overall system 10 as well as the spraying operations to be performed using the system 10.

Other than the guns 20 and the pumps 400, 402, 410, the selected design and operation of the material application system 10, including the supply 22, the spray booth 12, the gun mover 26, the conveyor 14, and the recovery system 28, form no part of the present invention and may be selected based on the requirements of a particular coating application. A control system 34 likewise may be a conventional control system architecture such as a programmable processor based system or other suitable control circuit. The control system 39 executes a wide variety of control functions and algorithms, typically through the use of programmable logic and program routines, which are generally indicated in FIG. 1 as including but not necessarily limited to feed center control 36 (for example supply controls and pump operation controls), gun operation control 38, gun position control 40 (such as for example control functions for the reciprocator/gun mover 26 when used), powder recovery system control 42 (for example, control functions for cyclone separators, after filter blowers and so on), conveyor control 44 and material application parameter controls 46 (such as for example, powder flow rates, applied film thickness, electrostatic or non-electrostatic application and so on). Conventional control system theory, design and programming may be utilized.

The control functions for gun operation 38 include but are not limited to gun trigger on and off times, electrostatic parameters such as voltage and current settings and monitoring, and powder and air flow rates to the guns. These functions and parameters make up what is commonly known as part recipes, meaning that each part may have its own set of parameters and control functions for each color or type of powder applied. These control functions and parameters may be conventional as is well known. However, in addition, the present invention does contemplate new control functions for the spray applicators and pumps of the present invention, specifically related to spray pattern adjusting and powder atomization air, as will be set forth herein below. This additional gun control function is made available by the present invention in the use of an air assist feature along with the feature, in one embodiment, of no longer using a nozzle device, used for dense phase powder flow, as contrasted to conventional systems wherein nozzles are commonly used and dense phase powder flow is not used. Still further, the present invention contemplates an optional feature of the pump control, wherein material flow rate is adjusted in response to changes in the spray pattern. These new control features may be incorporated into the overall part recipes.

The invention further provides, however, a nozzle for the spray applicator even for dense phase applications, as will be further described hereinafter.

While the described embodiments herein are presented in the context of a dense phase transport system for use in a powder coating material application system, those skilled in the art will readily appreciate that the present invention may be used in many different dry particulate material application systems, including but not limited in any manner to: talc on tires, super-absorbents such as for diapers, food related material such as flour, sugar, salt and so on, desiccants, release agents, and pharmaceuticals. These examples are intended to illustrate but not limit the broad application of the invention for dense phase application of particulate material to objects. The specific design and operation of the material application system selected provides no limitation on the present invention unless and except as otherwise expressly noted herein.

While various aspects of the invention are described and illustrated herein as embodied in combination in the exemplary embodiments, these various aspects may be realized in many alternative embodiments, either individually or in various combinations and sub-combinations thereof. Unless expressly excluded herein all such combinations and sun-combinations are intended to be within the scope of the present invention. Still further, while various alternative embodiments as to the various aspects and features of the invention, such as alternative materials, structures, configurations, methods, devices, software, hardware, control logic and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated.

Even from the general schematic illustration of FIG. 1 it can be appreciated that such complex systems can be very difficult and time consuming to clean and to provide for color change. Typical powder coating material is very fine and tends to be applied in a fine cloud or spray pattern directed at the objects being sprayed. Even with the use of electrostatic technology, a significant amount of powder overspray is inevitable. Cross contamination during color change is a significant issue in many industries, therefore it is important that the material application system be able to be thoroughly cleaned between color changes. Color changes however necessitate taking the material application system offline and thus is a cost driver. Additional features and aspects of the invention are advantageous separate and apart from the concern for cleanability and color change.

Figure 2A:
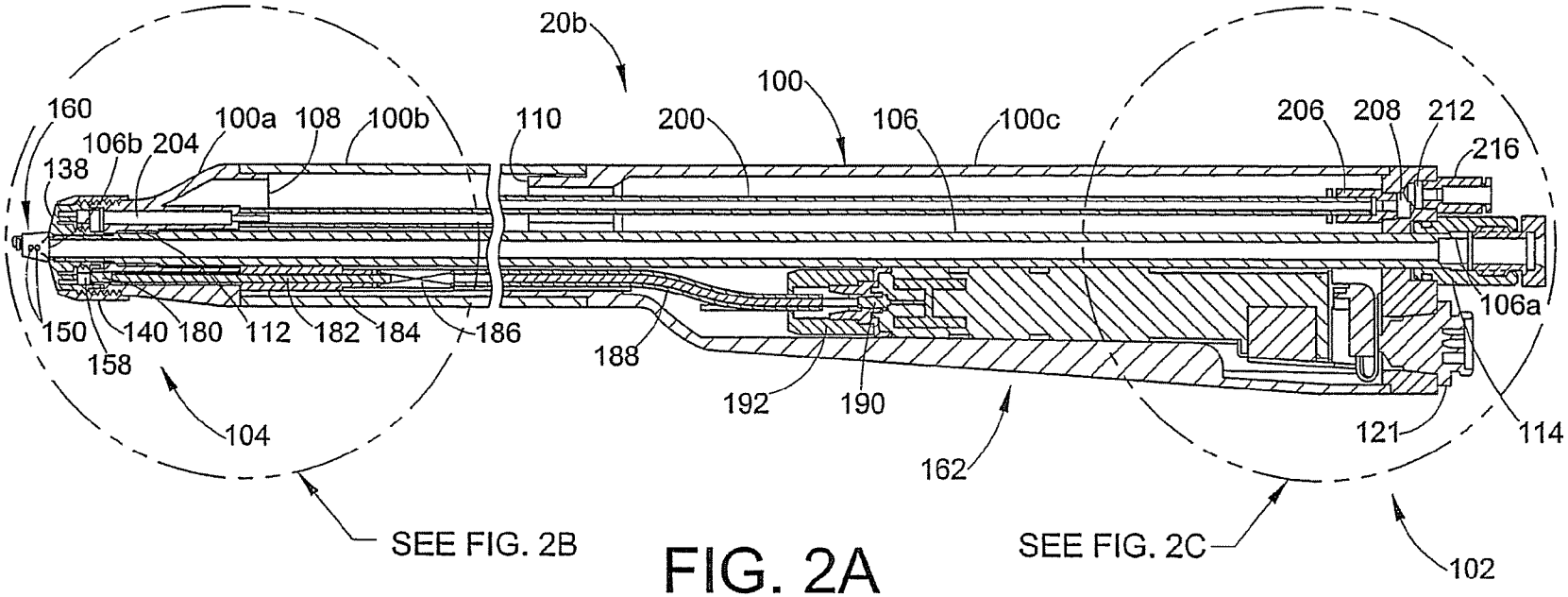
FIG. 2A is a spray applicator in accordance with the invention and illustrated in longitudinal cross-section.
Figure 2B:
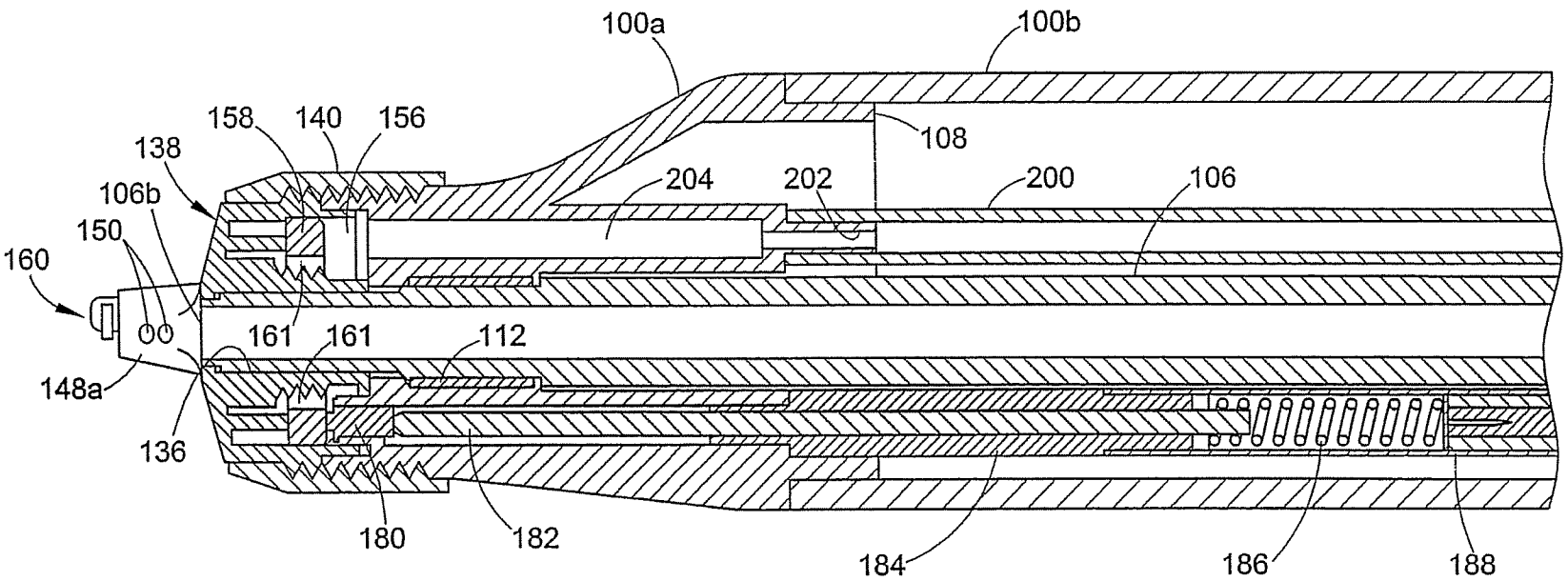
FIG. 2B is an enlarged view of the forward circled portion of FIG. 2A

With reference to FIGS. 2A and 2B, an exemplary embodiment of an automatic spray applicator 20*b* in accordance with the invention is illustrated. The same embodiment is illustrated in exploded perspective in FIGS. 3A and 3B.

The spray applicator 20*b* includes a main housing 100 that encloses most of the applicator components. The housing 100 has a powder inlet end 102 and an outlet end 104. A powder tube 106 extends substantially through the housing 100. The powder tube 106 forms a straight and uninterrupted powder path from an inlet end 106*a* thereof to an outlet end 106*b* thereof. The powder tube is preferably a single piece of tubing to minimize joints that can trap powder. This makes the applicator 20*b* easy to clean and purge internally. The only joint in the powder path within the gun housing 100 is where a powder hose (not shown) is connected to the inlet end 102 of the gun as will be described herein below.

In accordance with one aspect of the invention, the gun 20 design is particularly advantageous for cleaning and color change by virtue of being fully operable with a straight through powder tube 106 that extends from the inlet all the way through to the outlet. The tube has a reduced diameter as a result of the dense phase powder flow from the pumps 402 and therefore presents less internal surface area to clean. Moreover, the powder hose that is connected between the gun powder inlet and the pump outlet can be the same diameter as the powder tube diameter. Thus there is a continuous, uniform geometry in the form of a single diameter powder flow path from the pump to the gun outlet. This feature eliminates potential entrapment areas and minimizes resistance to flow. Moreover, the powder flow path is much easier and effective to purge for color change. In accordance with other aspects of the invention as will be set forth hereinbelow, the pumps 402 can be purged in two directions, including forward through the powder hose and through the powder tube. This purging works hand in hand and is facilitated by the uniform geometry of the powder flow path between the pump and gun.

The housing 100 in this embodiment is a three section housing including a front section 100*a*, an elongated middle section 100*b* and a back section 100*c*. The front section 100*a* includes a boss 108 at its back end that fits inside the forward end of the middle section 100*b* with preferably a snug friction fit. The back section 100*c* includes a boss 110 at its forward end that fits inside the rearward end of the middle section 100*b* with preferably a snug friction fit. The powder tube 106 includes a forward threaded portion 112 that threadably mates with an internally threaded portion of the front section 100*a*. The powder tube 106 also includes a rearward threaded portion 114 (FIG. 2C) that threadably mates with a lock nut 116. The lock nut 116 partially extends into a counterbore 118 of a heat sink 120. The lock nut 116 abuts the counterbore during assembly of the gun. Once the powder tube 106 has been threadably joined to the front section 100*a* of the housing 100 and tightened down, the lock nut 116 is then tightened, which causes the powder tube 106 to be pulled backward in tension. This action pulls the three housing sections 100*a, b* and *c* axially together in compression such that the powder tube 106 acts like a tie rod to hold the housing sections tightly together. The lock nut 116 includes a seal 122, such as for example an o-ring, that provides a friction fit between the lock nut 116 and the heat sink 120.

A powder tube lock knob 124 is threadably joined to the lock nut 116. A forward end of a powder feed hose 125 is inserted through a bore 126 of the lock knob and bottoms against an inner shoulder 128 formed in the powder tube 106. A lock ring 130 is captured between a forward end of the lock knob 124 and the back edge of the powder tube 106. The lock ring allows easy insertion of a powder feed tube 125 into the inlet end of the gun 20*b*. The lock ring 130 however grips the outer wall of the feed tube and prevents the feed tube from backing out. The lock ring 130 tightly engages the feed tube 125 when the lock knob 124 is tightened down against the lock nut 116. The powder tube 125 can be easily removed for service and optionally for color change by simply loosening the lock knob 124. A seal 132 is provided to prevent loss of powder. The seal 132 also provides a friction fit so that when the powder tube 125 is removed from the gun, the lock knob 124 does not slide down the length of the powder tube.

Figure 2C:
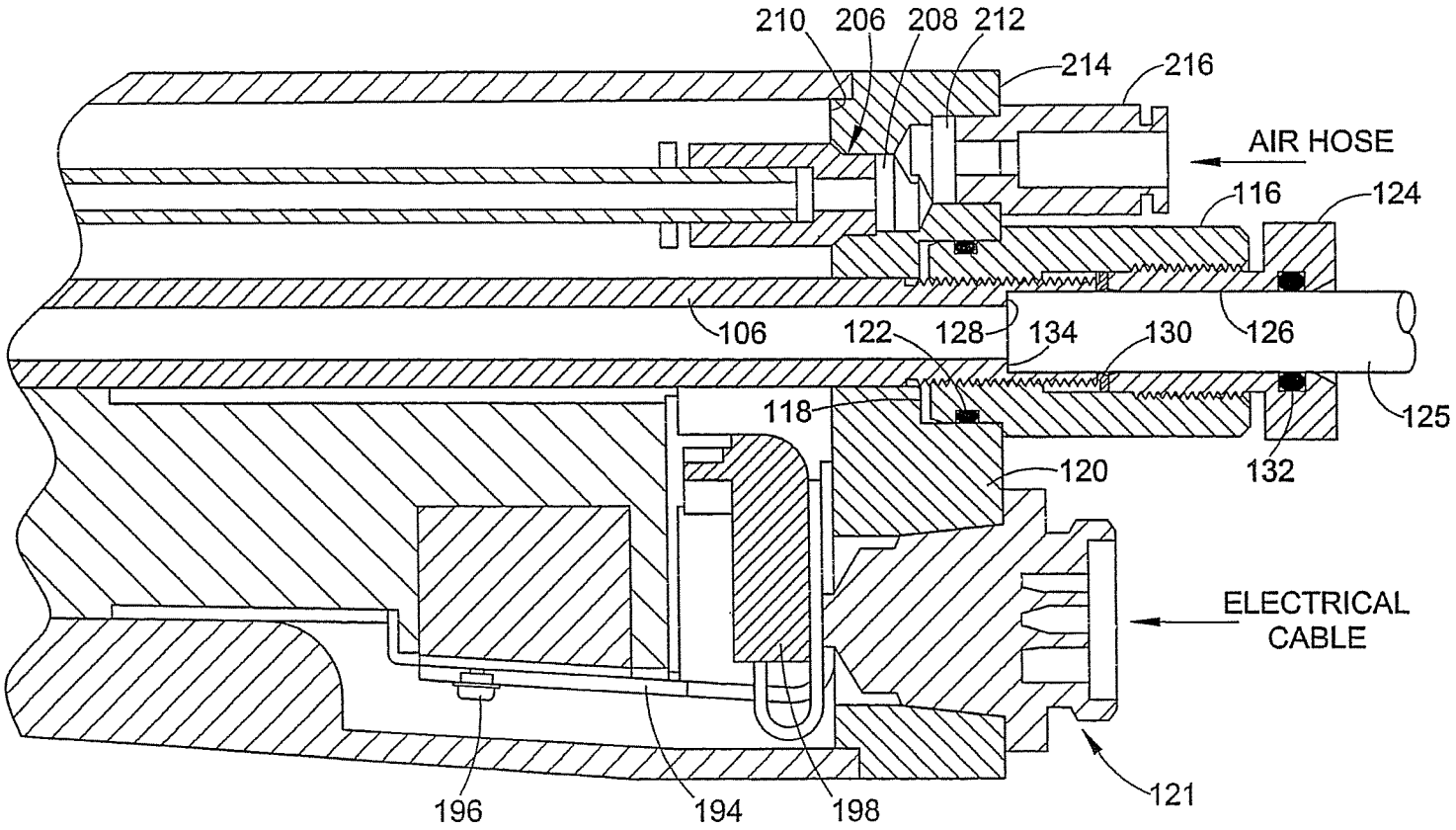
FIG. 2C is an enlarged view of the rearward circled portion of FIG. 2A.

It will thus be apparent from FIGS. 2A and 2C that the powder path through the spray applicator 20*b* is defined by the powder tube 106. The only joint is the location 134 where the powder feed hose 125 abuts the powder tube 106 shoulder 128. Other than that one joint, powder can flow along an uninterrupted path through the spray gun to the outlet end 104. Thus the gun is easy to purge for color change and has no significant entrapment areas in the powder path. For use with a dense phase particulate material, the powder tube diameter is substantially reduced as compared to a conventional powder spray gun powder tube. For example, in one embodiment of the invention, the inner diameter of the powder tube may be about six millimeters whereas in a conventional dilute phase system it may be on the order of 11 to 12 millimeters.

The powder tube 106 extends through the housing 100 and the front end 106*b* is received in a central bore 136 of an air cap 138 that is retained on the front section 100*a* by a threaded retaining nut 140. With the powder tube 106 extending all the way through the gun, there is no nozzle device as used in typical prior art powder spray guns. Rather, powder will exit the gun from the front end 106*b* of the powder tube. The powder tube end 106*b* may be but need not be aligned generally flush with the forward end of the central bore 136 of the air cap 138.

At this point it is noted that the spray applicator 20*b* will typically be a rather long device, with most of the length of the applicator defined by the middle section 100*b*. The overall gun length may be several feet, for example, five feet.

Figure 4:
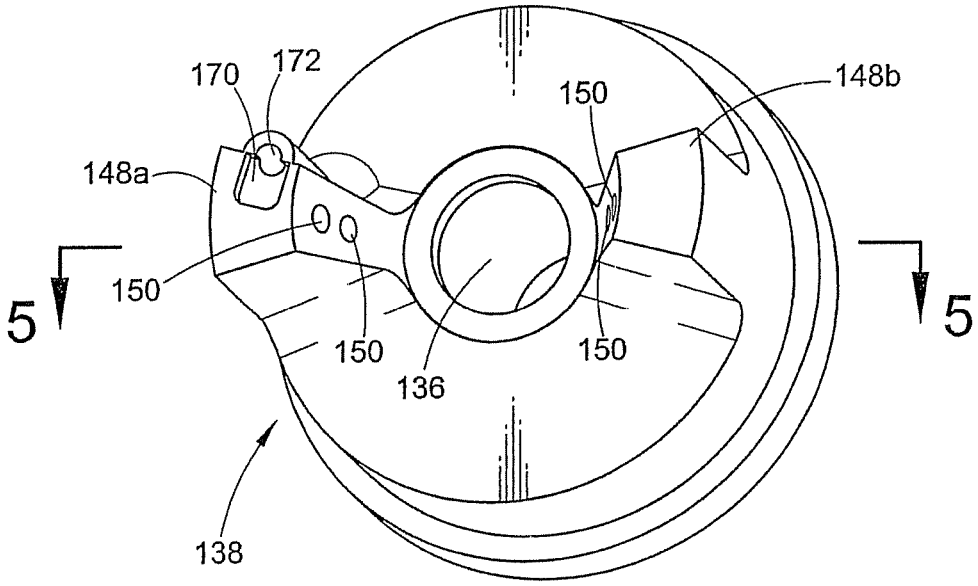
FIG. 4 is an air cap illustrated in front perspective.
Figure 5:
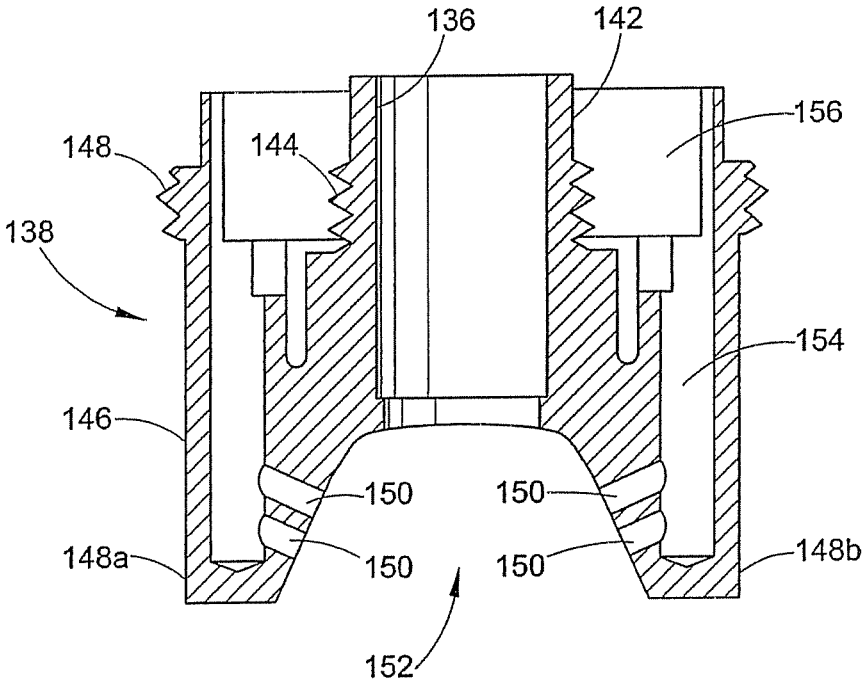
FIG. 5 is a longitudinal section of the air cap of FIG. 4.

The air cap 138 is best illustrated in FIGS. 4 and 5. The air cap 138 is provided in accordance with one aspect of the invention to add air, primarily as atomizing or diffusion air, to the powder flow that exits the powder tube end 106*b*. The invention contemplates adding air to the powder flow for dense phase particulate systems. In the absence of air being added, the powder flow in a dense phase system is nearly fluid like with the powder flowing much like water in a tube.

The air cap 138 includes a central passage 136 that receives the front end of the powder tube 106. The passage 136 is sized so as to loosely receive the powder tube end. This helps to center the powder stream for proper presentation of the powder stream to the air jets 150. This also allows air to pass around the outside of the tube end to prevent powder from migrating back inside the gun housing. The central passage 136 is defined by a male threaded inner tubular portion 142. The male threads 144 receive a conductive diffuser ring as will be described herein shortly. An outer wall 146 of the air cap is also male threaded as at 148 and mates with the threaded retainer nut 140. The retainer nut 140 is thus threadably joined to the air cap 138 and a threaded end of the front housing section 100*a* (FIG. 2B) to securely hold the air cap on the housing.

As best illustrated in FIG. 5, the air cap includes two air jet prongs 148*a* and 148*b*. Each prong 148 includes one or more air jets 150. The air jets 150 open into an atomizing or diffusing region 152 that is just forward of the powder tube end 106*b*. The number of air jets and the angle that their direct air at the powder flow is a matter of design choice to optimize atomization of the powder and to shape the spray pattern as desired. Typically, the more air that is directed at the powder flow will tend to atomize the flow more and enlarge the spray pattern.

Figure 3A:
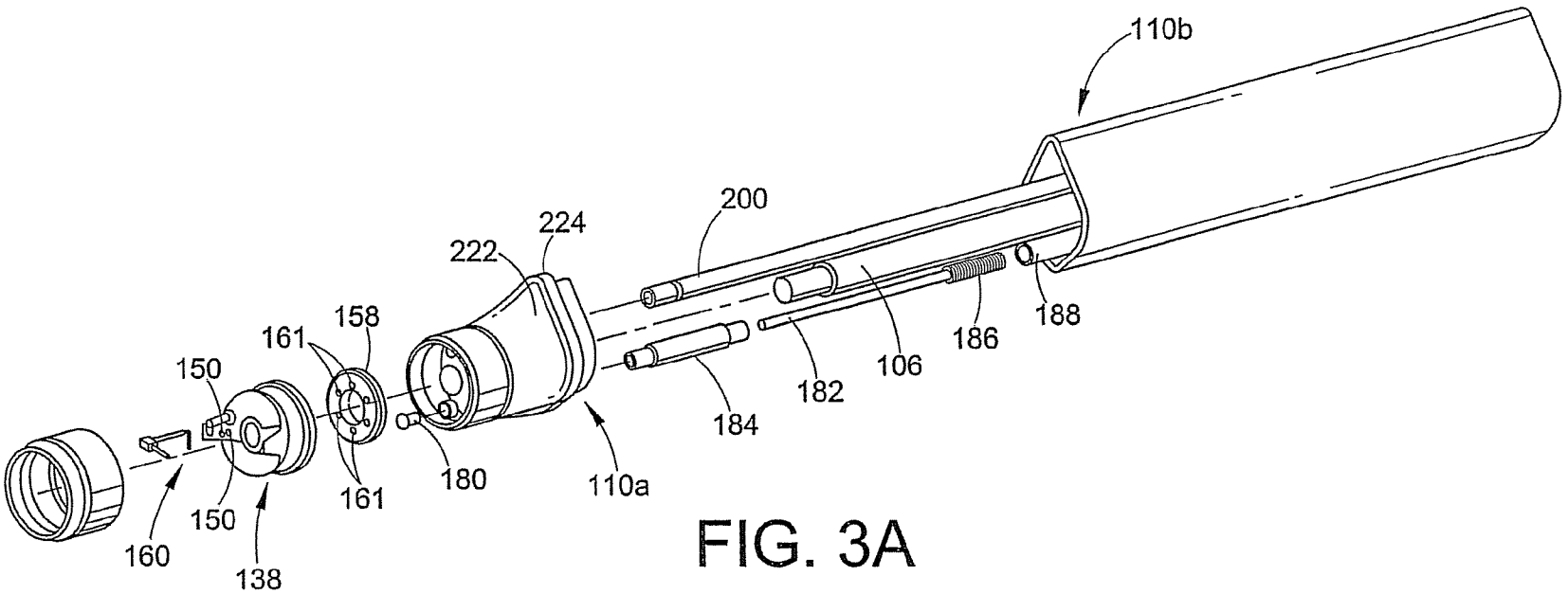
FIGS. 3A and 3B illustrate the spray applicator of FIG. 2A in exploded perspective.
Figure 6:
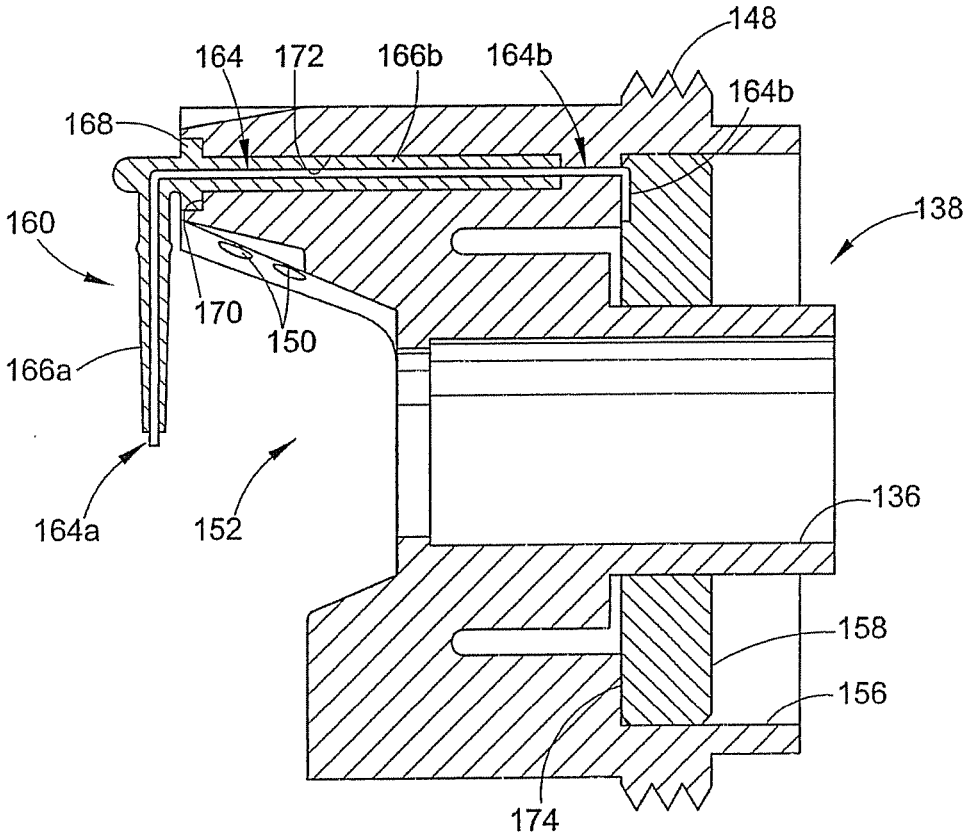
FIG. 6 is a longitudinal section of the air cap of FIG. 4 to illustrate an electrode retained therewith.
Figure 7A:
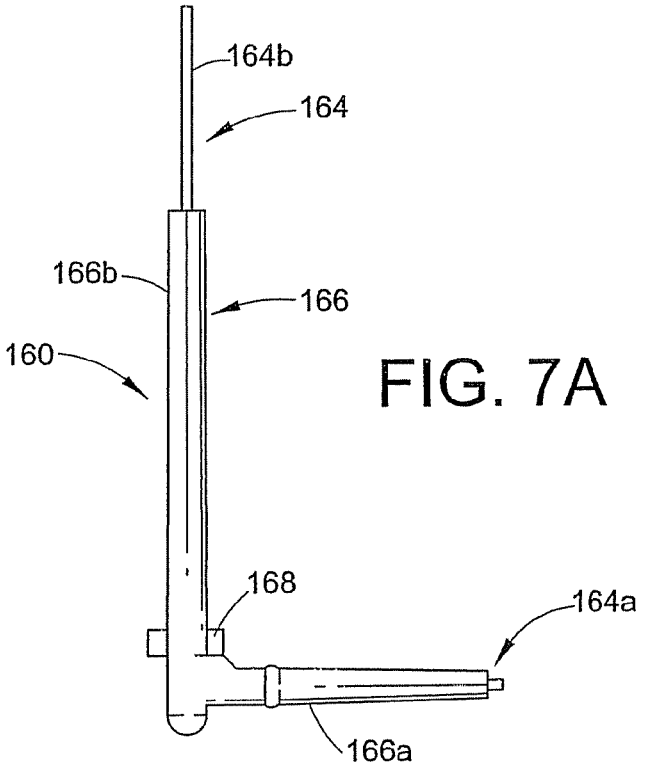
FIGS. 7A-C illustrate an electrode and holder assembly.
Figure 7B:
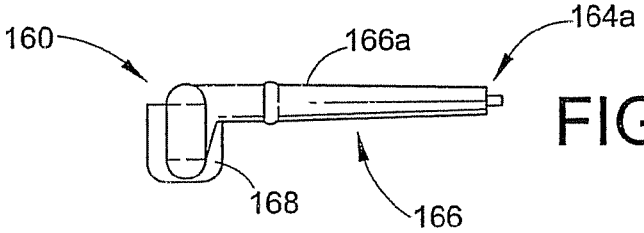
Figure 7C:
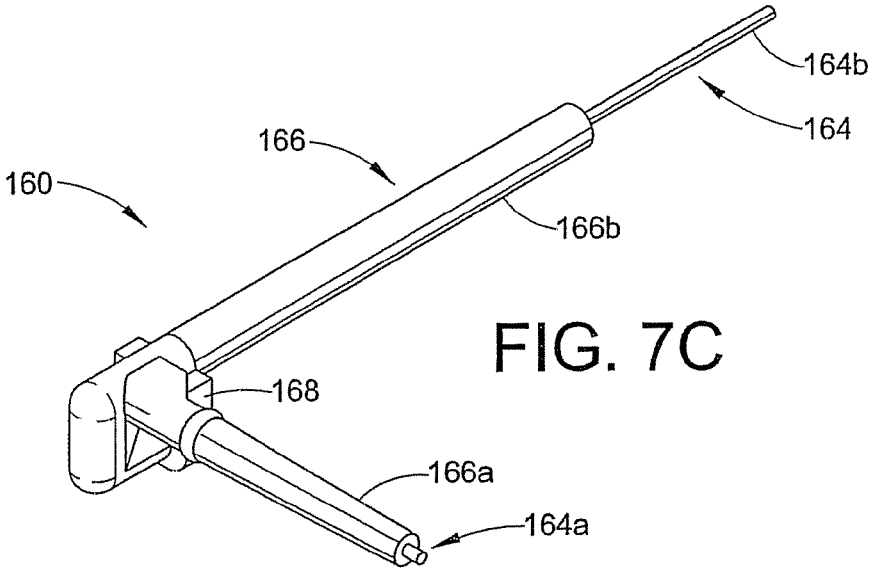

The air jets 150 open to an annular air passage 154. The annular air passage 154 further communicates with an annular cavity 156. The annular cavity 156 receives a female threaded air diffuser ring 158 (FIG. 6). The ring 158 is threaded into the air cap 138 with the internal threads 144. As best illustrated in FIG. 3A, the ring 158 includes a plurality if air holes 161 that provide an even air flow within the air cap 138. The ring 158 is also made of a electrically conductive material. For example, the ring 158 may be formed from carbon filled Teflon™. The ring 158 is made conductive because in addition to providing a diffused flow of air through the air cap 138, the ring 158 also electrically connects an electrode assembly 160 to a high voltage multiplier 162.

With reference to FIGS. 7A-C and FIG. 6, in accordance with another aspect of the invention an external electrode is provided just downstream from where the powder exits the powder feed tube end 106*b*. By placing the electrode on the outside of the gun housing 100, it does not interfere with the powder flow or with the cleanability of the powder tube. This is particularly useful with dense phase material flow.

In one embodiment, an electrode assembly 160 is provided that includes an electrode conductor 164 and an electrode holder 166. Preferably although not necessarily the holder 166 is molded over the conductor 164. A short portion 164*a* of the conductor extends out of the holder 166 and a longer portion 164*b* extends from the opposite end of the holder 166. The holder 166 is formed with an alignment key 168 in the form of a U-shaped boss that is received in a conforming recess 170 formed in the air cap 138 (see FIGS. 4 and 6). In this manner, the electrode holder 166 can only be installed with one orientation, so that the electrode tip 164*a* is optimally positioned downstream from the powder tube end 106*b*. The holder has an extended portion 166*b* that is inserted into a bore 172 in the air cap 138. A forward portion 166*a* of the holder 166 positions the electrode tip and is formed at about a right angle to the extended portion 166*b*.

As best illustrated in FIGS. 4 and 6, the inner portion 164*b* of the electrode is bent down and is captured between the conductive ring 158 and a shoulder 174 in the air cap. In this way, a solid electrical connection is made between the electrode conductor 164 and the conductive ring 158.

With reference to FIGS. 2A and 2B, a contact pin 180 is positioned in the front section 100*a* for intimate contact with a back side of the conductive ring 158. The contact pin 180 is also in contact with a resistor cable 182 which extends back through a forward portion of the middle housing section 100*b*. The resistor cable 182 may be any conventional resistive assembly that uses resistive carbon fiber and that provides current limiting protection for the electrostatic gun. This protection is enhanced by placing the resistance closer to the electrode. The resistor cable 182 may be supported in the housing with a guide member 184 and is supported at a back end thereof with a bias spring 186. The spring 186 maintains good electrical contact between the pin 180 and the electrical cable 188. The back end of the spring 186 makes electrical contact with a contact of an electrical cable 188. The electrical cable may be in accordance, for example, with U.S. Pat. Nos. 4,576,827 and 4,739,935 issued to the assignee of the present invention, the entire disclosures of which are fully incorporated herein by reference.

The electrical cable 188 extends back through the extended housing mid-section 100*b*. The electrical cable 188 at its back end makes electrical contact with an output contact 190 of the multiplier 162. A nut 192 may be used to secure the electrical cable 188 to the multiplier output 190.

Thus, in accordance with another aspect of the invention, the high voltage multiplier 162 is positioned in a rearward section of the gun housing, preferably near where the gun is mounted. In this manner the major weight of the gun is supported at the back end to significantly reduce the vibration and movement of the forward portion of the gun. If the multiplier were positioned closer to the front of the gun, as in conventional powder guns, the cantilever mounting could cause large bending moments. Thus, the invention contemplates an arrangement of a multiplier in line with an electrical cable coupled to a resistance and the electrode, with the multiplier in a rearward portion of the gun and the resistance positioned near the front of the gun.

The multiplier 162 is mounted to a bracket member 194 by a bolt 196. The bracket is thermally conductive, such as made of aluminum that is also mounted to the heat sink 120 by a pair of screws 198. In this manner the multiplier can be cooled by the heat sink 120. A conventional electrical input connector 121 is used to provide the input drive voltage, typically a low DC voltage, to the multiplier input as is known.

An air tube 200 is pushed onto a nipple 202 formed in the front housing section 100*a*. The nipple 202 forms an air passage to a main air passage 204 that opens to the annular cavity 156 just behind the conductive ring 158. Air that flows down the air tube 200 thus passes through the holes 161 in the ring 158 and then out the air jets 150 in the air cap 138 as described herein above.

The air tube 200 extends back through the gun housing 100 to a male connector 206. The male connector 206 mates with a first bore 208 that is formed in the front face 210 of the heat sink 120 (see FIG. 2C). The first bore 208 opens to a second bore 212 that is formed in the back face 214 of the heat sink 120. It will be noted from FIG. 2C that the centerline axis of the first bore 208 is offset from the centerline axis of the second bore 212 even though they are in fluid communication. This causes air turbulence and better cooling of the heat sink 120. A second fitting 216 is connected to the second bore 212 and serves as a connection for a main air hose (not shown). By this arrangement, air is thus provided to the air cap at the front of the gun, and the multiplier is cooled by the heat sink that is exposed to the same flow of air that goes to the air cap.

Figure 3B:
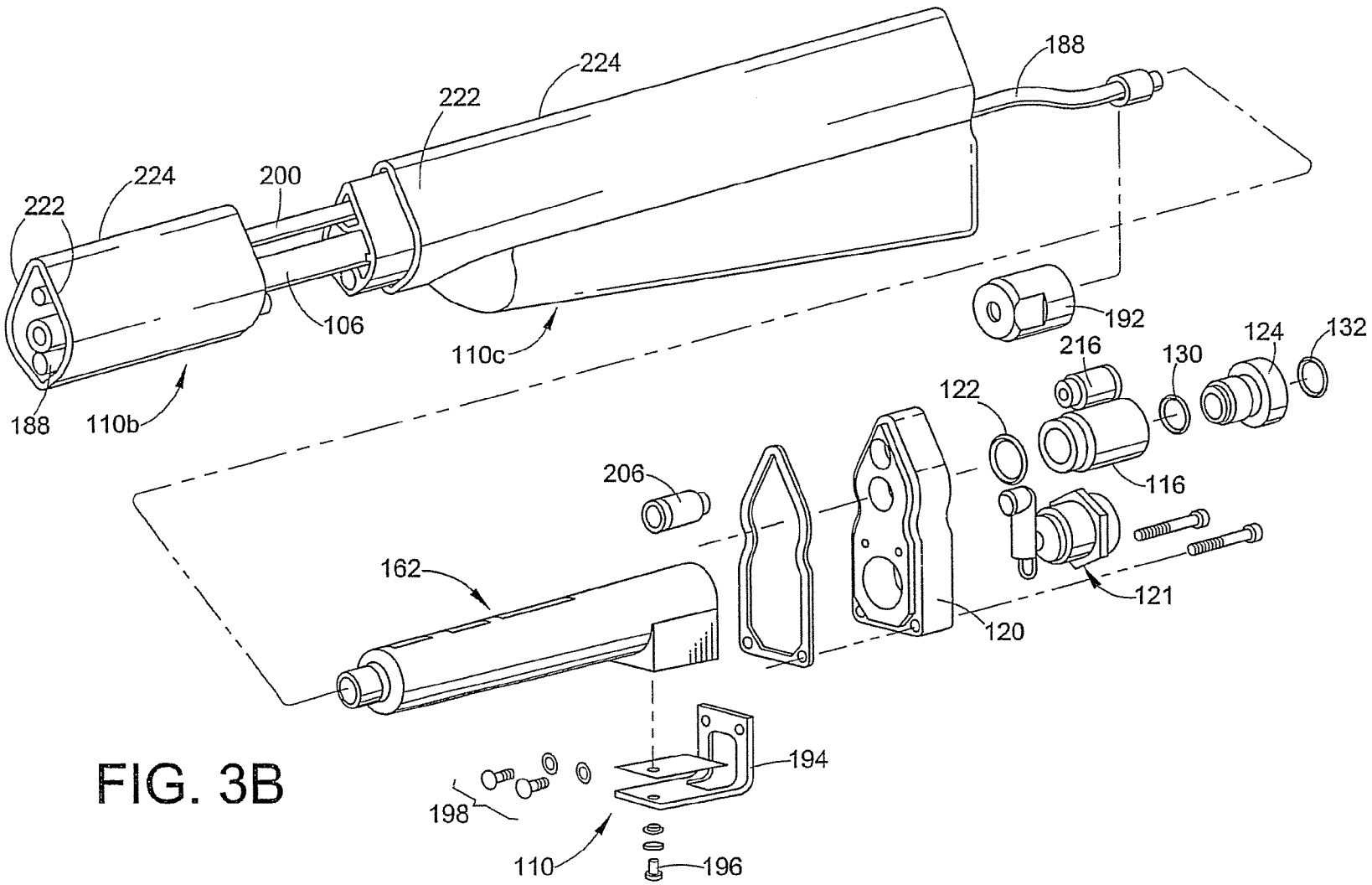

The exploded views of FIGS. 3A and 3B are provided to better illustrate the assembly described herein above.

In accordance with another aspect of the invention, as best illustrated in FIGS. 3A and 3B, the housing 100 sections are preferably formed with a tapered upper portion formed by two rather steep walls 222 that join at a small radius apex 224. Preferably the apex is the top of the gun housing when the gun is being used for spraying material, so that the profile of the gun housing 100 reduces the amount of powder overspray that can alight on the gun and the steep sides can help shed powder.

Figure 8A:
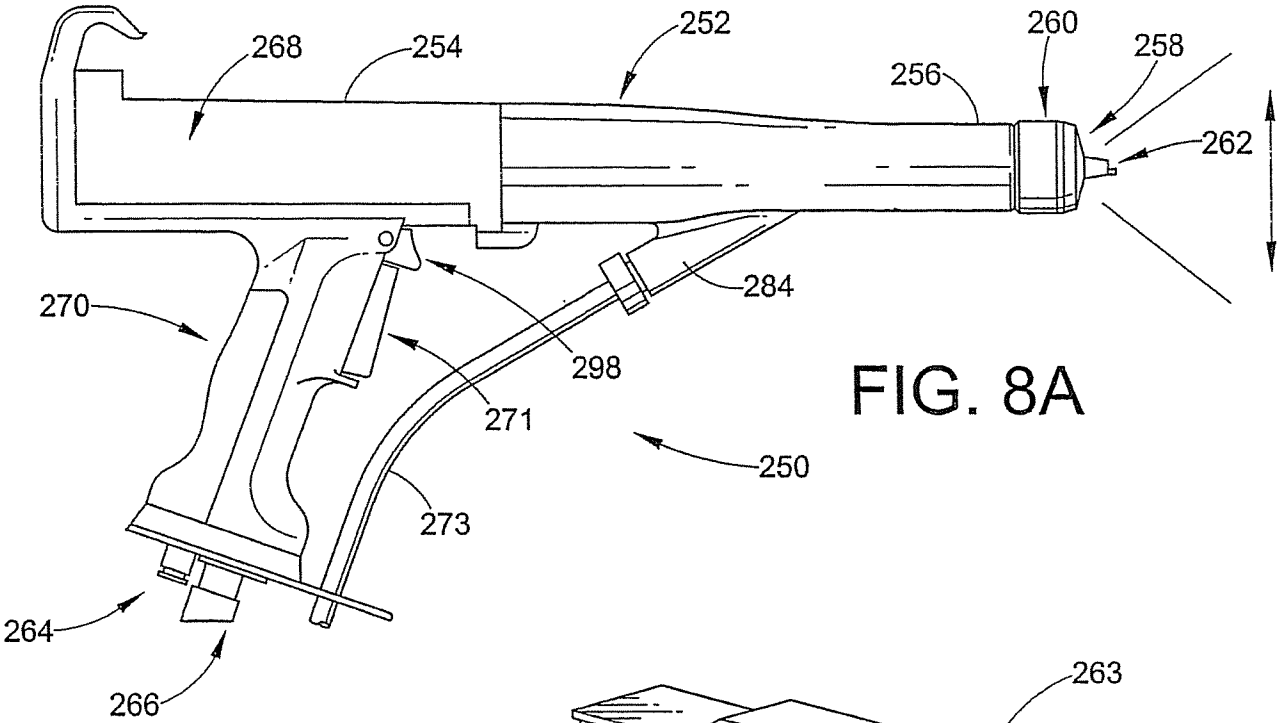
FIG. 8A illustrates a manual spray applicator in elevation in accordance with the invention.
Figure 8C:
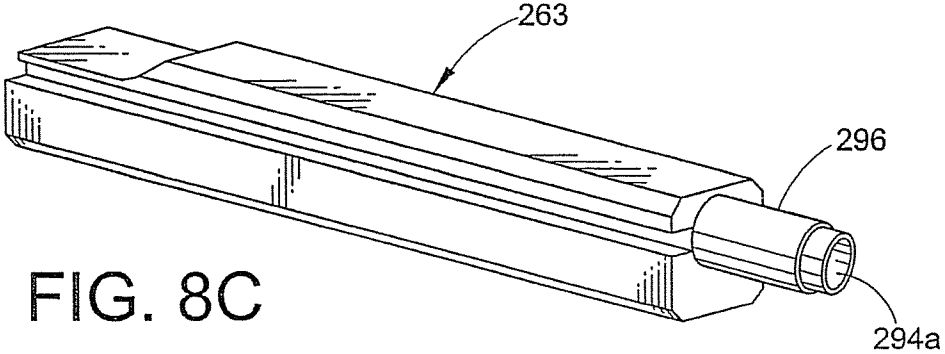
FIG. 8C is a perspective illustration of a powder tube used in the applicator of FIGS. 8A and 8B.
Figure 8B:
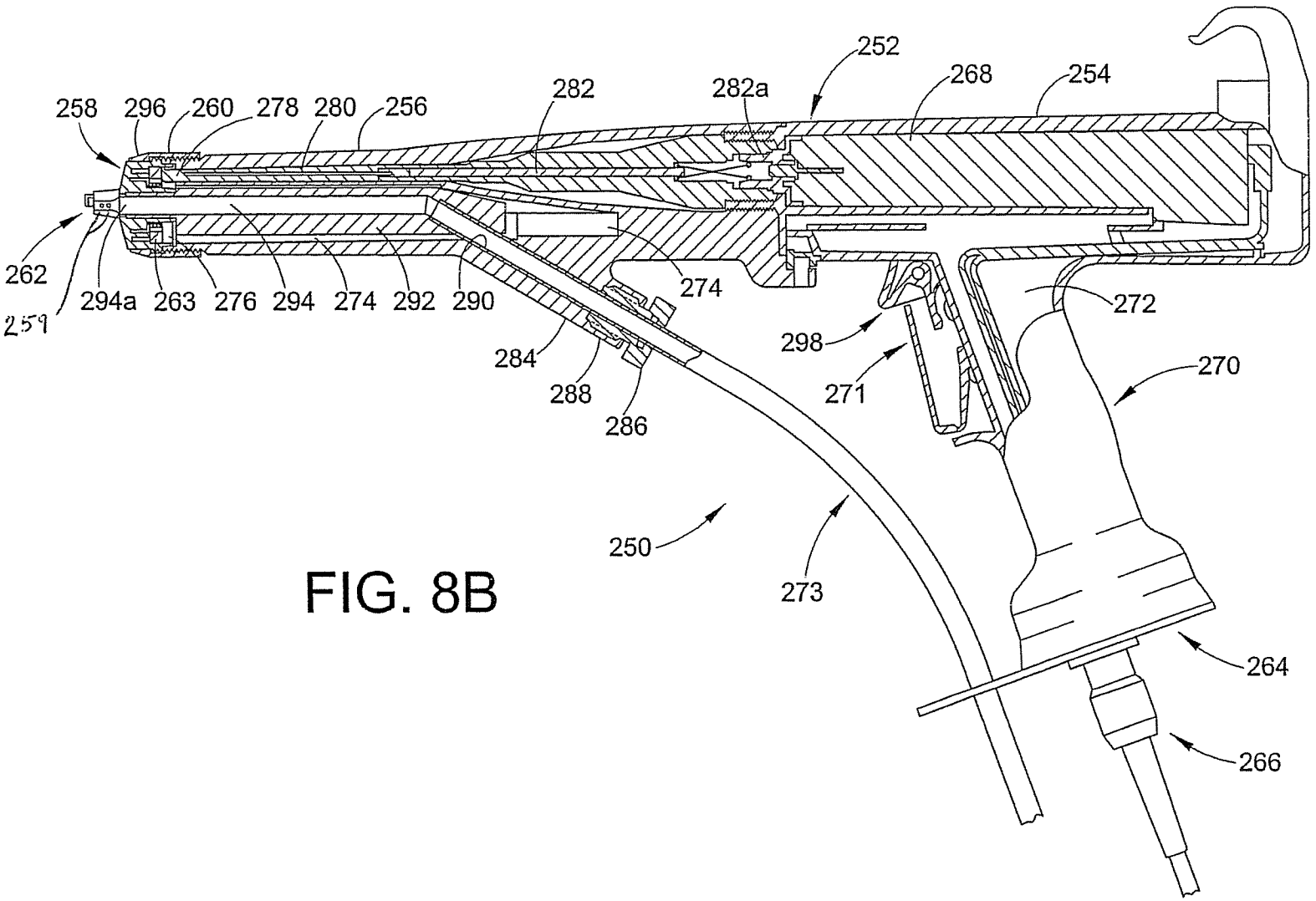
FIG. 8B illustrates the applicator of FIG. 8A in longitudinal cross-section.

With reference to FIGS. 8A and 8B, the present invention also contemplates a manual spray applicator 250 that is particularly but not exclusively suited for dense phase material application. Many features of the manual version are the same as the automatic spray applicator described herein above.

The manual gun 250 includes a housing 252 that in this embodiment is a two piece housing including a rear or multiplier section 254 and a front or powder tube section 256 in the form of a barrel. These sections can be releasably secured together by any convenient mechanism such as a set screw for example. There is an air cap 258 that is retained on the outlet end of the front housing 256 by a retainer nut 260. The air cap holds an electrode assembly 262 and also a conductive diffuser ring 263 (shown in FIG. 8B). The air cap includes air jets 259. The air cap 258, retainer nut 260, electrode assembly 262 (including an electrode conductor and over-molded electrode holder) and conductive diffuser ring 263 may be the same design and operation as the corresponding parts in the automatic gun version described herein above.

The manual gun 250 further includes an air inlet, such as a fitting 264 that is connectable to an air line (not shown). An electrical connector 266 is provided for connection with an external low voltage power supply to operate the internal high voltage multiplier 268 (shown in dotted line in FIG. 8). The multiplier 268 is disposed in the rear housing section 254 above the grip handle 270 to reduce operator fatigue. The powder tube housing may be provided in any length as needed, or alternatively can be connectable to an extension housing if so desired for additional length of the spray applicator 250.

Operation of the manual gun 250 is similar to the automatic version except that the manual gun is manually triggered by an operator. Thus the manual gun includes a control trigger device 271. When this trigger 271 is depressed it causes electrical power to be delivered to the multiplier when electrostatic operation is to be used. Actuation of the control trigger 271 also allows air to flow to the air cap 258 via passages that extend through the handle 270 and the housing 252. Air may also be used to cool the multiplier via a heat sink as in the automatic version. The control trigger 271 actuation also causes powder to flow through the gun from a powder feed hose 273 and out the front end of the gun.

Air enters the applicator 250 via the air fitting 264 and into a passage 272 in the handle 270. This air can be used to help cool the multiplier 268. The passage 272 is in fluid communication with an air passage 274 in the front housing section 256. The passage 274 extends through the front housing section and opens to a recess 276 in the air cap 258 that receives the diffuser ring 263.

The electrode 262 makes electrical contact with the diffuser ring 263 in a manner as described herein above. There is also a contact pin 278 that contacts the ring 263. The contact pin 278 is part of an electrical circuit that includes a spring electrode 280 and a resistor assembly 282 and a conductive electrode spacer 282*a* that is electrically coupled to an output of the multiplier 268. The electrode spacer 282*a* may for example be made of a conductive Teflon™ material. This electrical circuit may be similar as described herein above in the embodiment of the automatic gun.

The powder feed hose 273 is inserted into a tubular extension 284 of the front housing section 256. A female threaded tube lock knob 286 and a lock ring 288 may be used to retain the feed hose 273 in the tubular extension 284. The lock ring and lock knob may be designed to function in a manner similar to the corresponding parts in the automatic gun described herein before.

The forward end 273*a* of the feed hose 273 inserts into a hose passageway 290 formed in a powder tube 292. The passageway 290 opens to a powder passage 294 that preferably lies along the central longitudinal axis of the applicator 250. The distal end 294*a* of the passageway 294 is formed by a tubular portion 296 of the powder tube 292 (see also FIG. 8C). The powder tube 292 is slip fit or otherwise slideably installed into the front housing section 256 with the passageway 290 aligning with the tubular extension 284 so that the powder feed hose 273 can easily be inserted into the powder tube 292. Note that the distal end 294*a* is received in the air cap 258 in a manner similar to the feed tube 106 and the air cap 138 in the automatic gun embodiment described herein above. The powder tube 292 thus foams a small diameter passageway for powder flow to the front of the gun, so that the manual gun 250 is well suited, for example, for dense phase powder flow.

The powder tube 292 thus provides an easily removable unit that forms the entire powder flow path for the spray gun 250. This makes the manual gun easy to clean for color change.

In accordance with another aspect of the invention, an adjusting member or control device in the form of a second trigger device 298 is provided. This trigger 298 may be actuated alone or in combination with the control trigger 271. The second trigger 298 is a pattern adjust trigger by which an operator can adjust the flow of air to the air cap 258. By increasing the air flow, the spray pattern is made larger and vice-versa. As shown in FIG. 1, the control system 34 receives a signal from the pattern adjust trigger 298 (such as, for example, a change in impedance when the contacts close) and in response thereto issues a gun air control signal 299 The air control signal 299 can be used to control an air valve (not shown) disposed either inside the gun 250 or preferably in a pneumatic control section of the overall powder application system 10 to increase or decrease air flow to the air cap jets 259 as required.

Figure 9:
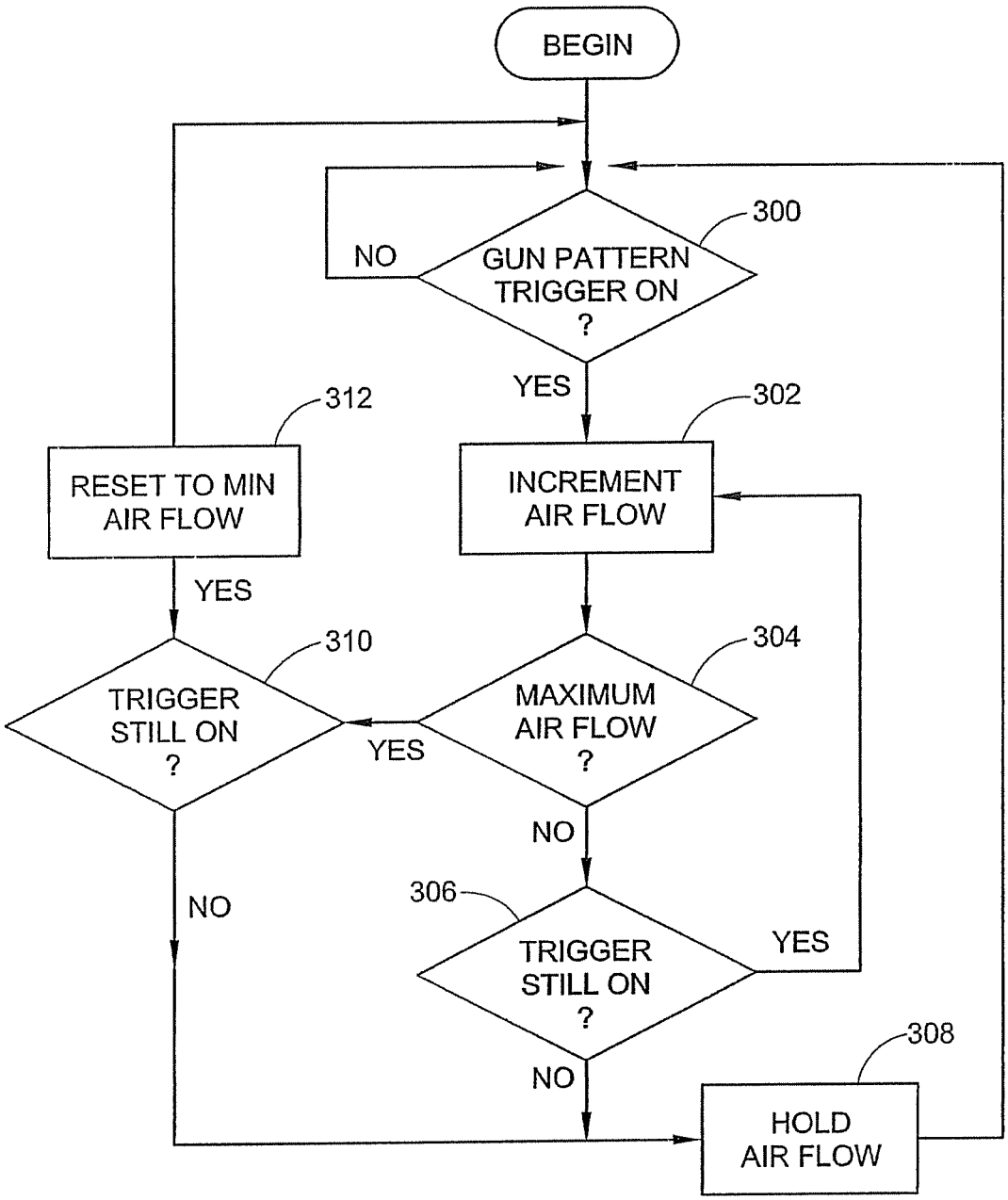
FIG. 9 is a logic flow diagram for a pattern adjust algorithm in accordance with the invention.

With reference to FIG. 9, an exemplary flow diagram is provided for a pattern adjust logic routine or algorithm. At step 300 the logic determines if the gun pattern adjust trigger 298 is activated (a de-bounce subroutine may optionally be included to prevent air adjustment unless the trigger has been activated for a minimum time period.) If it is not, the program waits until a valid trigger signal is received. When the trigger 298 is activated, at step 302 the air flow is incrementally increased. The amount of the incremental increase is a matter of design choice, wherein the operator can be provided with fine adjustment, course adjustment or both. At step 304 the program determines whether maximum air flow is being provided to the spray applicator 250. If it is not, then at step 306 the program checks if the trigger 298 is still on. If it is, the logic loops back to 302 to increment the air flow again. In this manner, the operator can hold the trigger 298 down and watch the pattern change with the increasing air flow, and stop by releasing the trigger 298.

At step 306 if the trigger 298 is not still on then the program holds that air flow rate at 308 and loops back to wait for the next trigger actuation at step 300.

If at step 304 the system determines that the maximum air flow is being provided, then at step 310 the logic checks if the trigger 298 is still activated. If it is not the program branches to step 308 and holds the air flow rate (and hence the selected pattern). If at step 310 the trigger is still on, then the program resets the air flow back to the minimum air flow rate at 312 and loops back to step 300. Alternatively, at step 312 instead of resetting to the minimum flow rate and waiting for another trigger, the program could branch to step 302 and start incrementing again. This alternative method would allow the operator to keep the trigger depressed and observe the spray pattern as the air flow was adjusted through the maximum air flow rate and them incremented again from the minimum air flow rate. As still another alternative, rather than having the operator hold the pattern adjust trigger 298 actuated, the system can be programmed to look for a first actuation and then to stop the adjustment in response to a second actuation of the trigger.

As another alternative to the "ramp" feature that is described previously for the pattern shaping air, the control function may be programmed to incorporate a "hi/lo" feature. This "hi/lo" feature would use discrete actuation of the trigger 298 to switch between a "high" and a "low" pattern shaping air flow setting. During normal spraying, say the operator is using the high setting, which he controls from the manual gun controller, to give a large fan pattern. He then comes to an area where he needs a narrow fan pattern to better coat the part. He can actuate trigger 298 once, and the controller will change the flow of pattern shaping air to a lower setting, which the operator has previously set to a certain value through the manual gun controller. A second actuation of trigger 298 will revert the pattern shaping air flow back to the "high" setting.

It should be noted that varying the spray pattern by adjusting the air flow can also be implemented in the automatic spray applicator described herein above because the adjustment is essentially a software logic control function. In the automatic gun version the control system could be provided with a switch for the operator to activate to increment the air flow rate to the gun.

In accordance with another aspect of the invention, the adjustability of the spray pattern can be implemented with an optional adjustment of the material flow rate from the pump 402. As will be described hereinbelow, a pump in accordance with the invention can operate with controllable material flow rates, even at rather low flow rates. This control is based in part on various timing functions within the pump. As used in combination with the spray gun, the control system 39 may be programmed so that in response to a change in the spray pattern, the material flow rate is also adjusted. For example, if the operator changes the spray pattern from a large pattern to a smaller pattern, it may be desirable to lower the material flow rate. Vice-versa, if the operator increases the spray pattern size it may be desirable to increase the material flow rate. These complementary adjustments can be incorporated into the part recipes within the control logic of the control system 39. As another alternative, the control system 39 may be programmed to adjust the material flow rate as a percentage of a change in the pattern size. Adjustment of the flow rate can save on powder since less powder can be used for special touch ups or other spray operations in which a smaller pattern is used. Those skilled in the art will readily appreciate that there are many such related adjustments that can be made in accordance with the invention. The invention provides such flexibility, in part, by providing a pump that has a scalable flow rate (to be described herein below) and a spray gun that has a scalable or at least an adjustable air flow to the air cap.

In yet another alternative embodiment, a setup mode can be programmed into the control system 39. During the setup mode, an operator can activate the pattern adjust trigger, and either in the ramping mode or step mode the operator can observe the spray patter as applied to an object. The operator can then assess the optimal spray pattern for the object. The air setting and flow rate settings at this optimal spray pattern can then be recorded for future reference when the same part is sprayed again. This information could also be entered into the part recipe database so that the control system 39 can automatically select the pattern and material flow rates the next time that the system is used to spray that part with a similar coating material.

With reference to FIG. 22A-22E and FIG. 23, in an alternative embodiment the air cap 138 of FIG. 2B is replaced with a nozzle assembly 900. The nozzle assembly 900 in some cases will be simpler to make and can provide some operational advantages over the air cap 138 as will be apparent from the description below, however, the air cap 138 may be used in many applications as set forth herein above. The nozzle concept may be used with the manual spray gun or automatic spray gun versions.

The nozzle assembly 900 includes a nozzle 902 and a nozzle insert 904. The nozzle insert 904 may optionally be used and is not required for all applications. The nozzle insert however can make the design of the nozzle easier to manufacture, and in any case may be used to provide an expansion chamber 906 for powder as the powder flows from the powder feed tube 106 (for the automatic gun) or the powder tube 292 (for the manual version) into the nozzle.

The nozzle 902 includes a nozzle body 903 that may be provided with external threads 908 to permit the nozzle assembly 900 to be installed on the outlet end of the spray gun, such as with the retaining nut 140 (FIG. 2B.) The nozzle 902 may be a molded or machined part and typically may be made of a low impact fusion material such as PTFE, TIVAR™ or nylon for example.

Figure 22E:
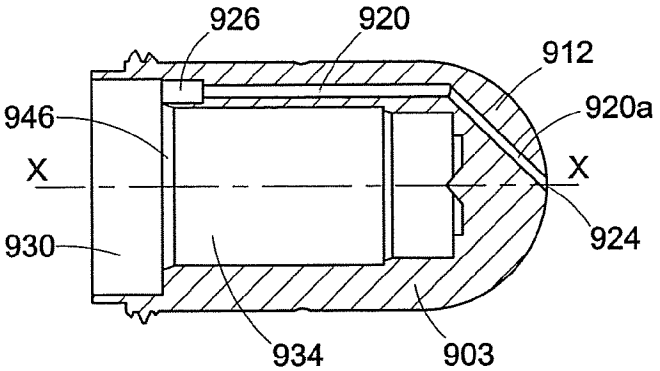

In this embodiment the nozzle 902 has a generally bullet like shape with a domed front end 902*a*. A machining or molding step or other process for forming an integral one piece nozzle may be used to form a deflector and outlet orifice. The nozzle 902 may have an integrally formed deflector 910. In the example of FIGS. 22 and 23, the nozzle is used to produce a conical spray pattern, hence the deflector 910 includes a generally conical profile to direct powder to spread out in a conical pattern. The deflector 910 is supported on the nozzle 902 by one or more ribs 912. In the exemplary embodiment of FIGS. 22A-E one rib is somewhat larger than the other, to accommodate an electrode as will be further explained herein.

The conical deflector 910 forms an included angle θ in this case of about seventy degrees, however the selected angle may be chosen based on the type of spray pattern desired. A larger included angle of about one-hundred degrees for example will produce a wider spray pattern from the nozzle.

The deflector 910 and the forward end 902*a* of the nozzle form an outlet orifice 914 through which powder exits the nozzle 902. The orifice 914 geometry may be selected as needed to form the desired spray pattern. The orifice 914 may have a generally uniform width 916 along its length (when viewed in cross-section as in FIG. 22D) or may have a tapering width or other geometric shape as needed. One method for making the nozzle 902 is to machine it so that the deflector 910 is integrally machined with the nozzle.

Figure 22B:
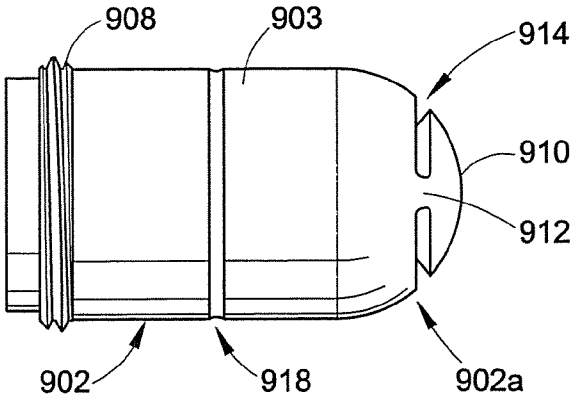
Figure 22C:
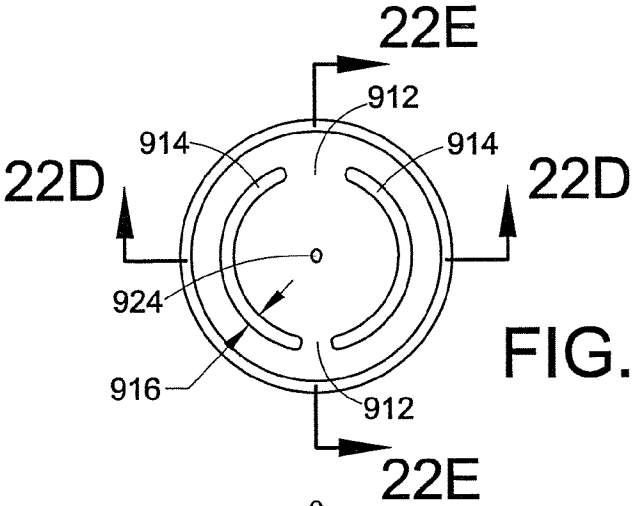
Figure 22D:
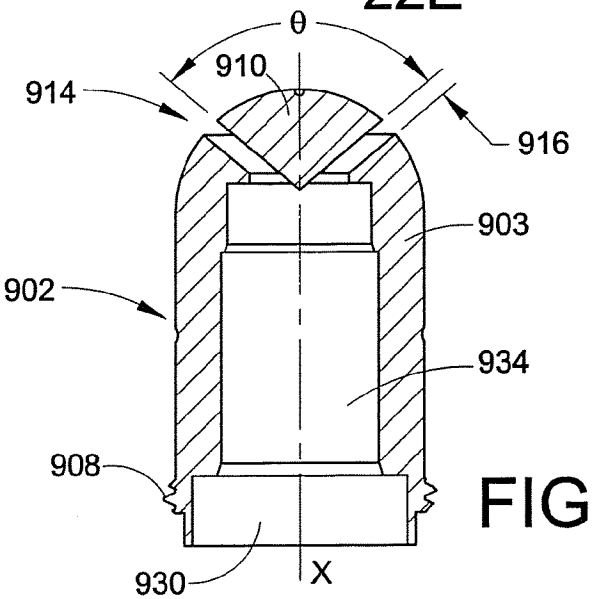
Figure 23:
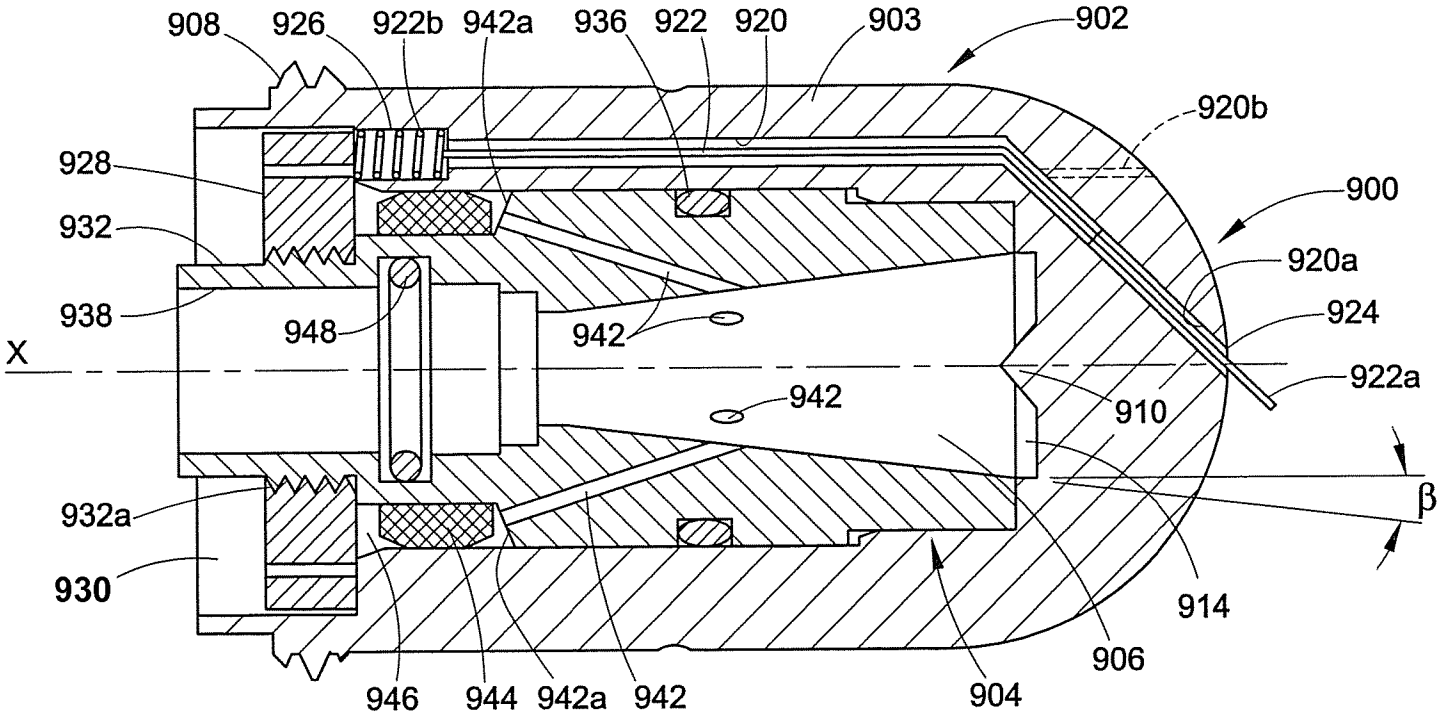
FIG. 23 is a longitudinal cross-section of a first embodiment of a nozzle assembly in accordance with an alternative embodiment of the invention.
Figure 24E:
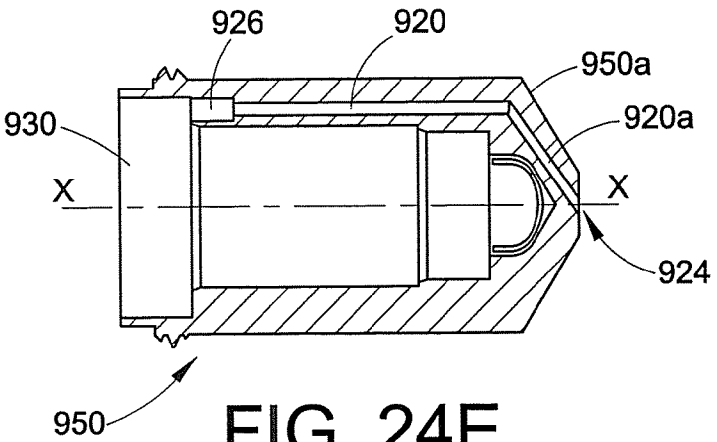
Figure 24B:
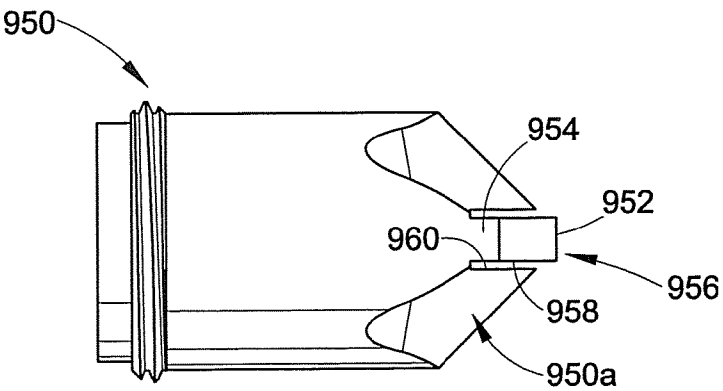
Figure 24C:
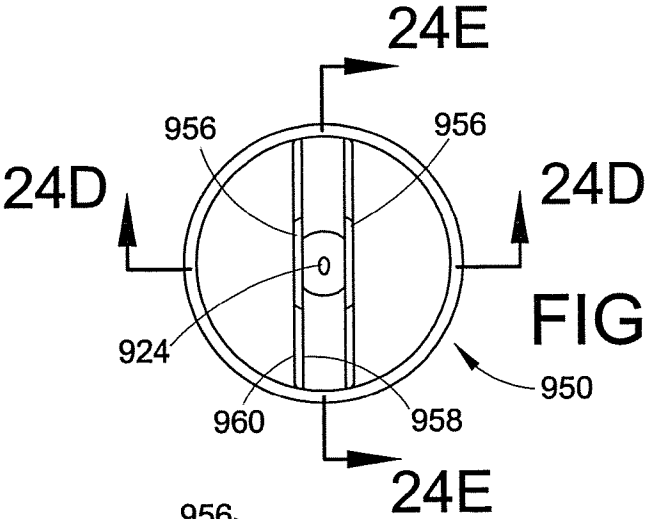
Figure 24D:
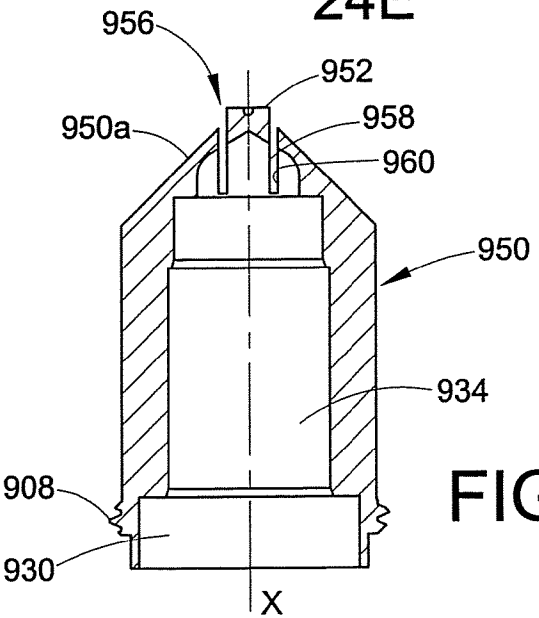

As best illustrated in FIG. 22B the nozzle 902 may be provided with markings, grooves or other indicia or physical feature 918. These characteristics 918 may represent for example the spray angle of the orifice 914 or other size criteria of the orifice, material and so on, limited only be the complexity desired for the indicia code and the amount of information to be conveyed to the operator or assembler.

As best illustrated in FIGS. 22E and 23, the nozzle 902 also includes a electrode passageway 920 that retains an electrode 922. The electrode passageway includes a forward portion 920*a* that extends through one of the ribs 912 that supports the deflector 910. The electrode passageway 920 is formed so that it terminates at the front of the nozzle 910 at an electrode opening 924. A discharging portion 922*a* of the electrode extends through the electrode opening 924. The electrode passageway 920 and the electrode length are selected so that preferably, although not necessarily in all cases, the electrode tip is in the center of the spray pattern produced by the nozzle 910. This has several benefits including better charging of the powder particles for better transfer efficiency, and also the powder cloud may function to shield against EMF (electromagnetic field) wrap thus reducing the risk of shock. However, when appropriate the electrode passage way could extend to a different location, such as for example more along the periphery of the nozzle 902, such as represented by the dashed lines 920*b* in FIG. 23.

The electrode passageway 920 terminates internally at a pocket 926. In this embodiment, the electrode 922 includes a spring end 922*b* that is positioned within the pocket 926. This spring 922*b* contacts a conductive diffuser ring 928 such as described in the above embodiments as element 158 (FIG. 2B) having one or more through holes for air to pass through the ring. When assembled with the gun, the diffuser ring 928 is in electrical continuity with the output of the multiplier, as in the earlier embodiments described herein above. The nozzle 902 also includes a pattern air chamber 930. The diffuser ring 928 is inserted into the chamber 930 by a threaded connection 932*a* with a threaded end 932 of the insert 904. The ring 928 is inserted sufficiently far as to make electrical contact with the electrode spring 922*b*.

When the nozzle assembly 900 is installed on the gun, the pattern air chamber 930 communicates with a source of pressurized air, such as via the air passageway 204 and the pattern air tube 200 in the above described embodiments.

The nozzle 902 further includes an insert chamber 934 into which the insert 904 is slideably positioned. A seal 936, such as an o-ring for example, may be used on the outer perimeter of the insert 904 to prevent powder from back flowing into the gun interior.

The insert 904 includes a powder tube or feed hose passage 938. Depending on whether the nozzle is being used on a manual or automatic gun, a powder tube or feed hose is inserted so that its end abuts a shoulder 940 in the insert 904. This shoulder defines the powder inlet or inlet opening to the nozzle assembly 900 and will have a defined cross-sectional area. The insert 904 further includes the expansion chamber 906 such that powder flowing through the feed hose or powder tube enters the expansion chamber 906 through the inlet opening 940. The expansion chamber 904 may be any suitable geometry, in the exemplary embodiment it is in the general shape of a cone with increasing diameter towards the front of the nozzle 902. The expansion chamber 904 opens to the outlet orifice 914. Preferably although not necessarily the deflector 910 is centered with respect to the center of the expansion chamber along the central axis X.

In the embodiment of FIG. 23, the expansion chamber 904 extends at an included angle of β relative to the central longitudinal axis X. The angle β may be defined by the expansion characteristics of the conveying gas (compressed air in the exemplary embodiments herein) such that the angle β is equal to or less than about one-half that of the expansion angle of the conveying gas so as not to create pockets where powder can be trapped. This also may ensure that the walls of the expansion chamber are "washed" by the compressed air during a purging operation.

The expansion chamber 904 functions to slow down the speed of the powder as it leaves the feed hose or powder tube. The deflector 914 may further slow down the powder. In order to have this effect, the cross-sectional area of the outlet orifice 914 is made greater than the cross-sectional area of the inlet 940. The larger outlet area prevents acceleration of the powder as it exits the nozzle as is common with venturi type low density high air volume spray nozzles. By significantly reducing the speed of the powder cloud exiting the nozzle, a slow moving dense cloud of powder is produced that is more thoroughly charged (in the case of when electrostatic charging is used) and exhibits better adherence to the target being sprayed (higher transfer efficiency.) Thus it is preferred that the ratio of the outlet orifice cross-sectional area to the inlet cross-sectional area be at least equal to or greater than one.

The insert 904 may optionally include air jets or passageways 942 that are in fluid communication with the pattern air chamber 930. In the exemplary embodiment there are six jets 942 but any number may be used as required. The air jets are used to inject air into the powder stream as it passes through the expansion chamber 906. This added air is optional and may be used for example to add some velocity to the powder stream so that a more penetrating powder cloud is produced at the nozzle outlet. This may be desired for example when spraying interiors in which it is necessary to get the powder cloud into the object but the nozzle cannot get too close to prevent arcing with the electrode. Air may be added for assisting in atomizing the dense powder. A filter element 944 is provided between the jet inlets 942*a* and the pattern air chamber 930 to reduce or prevent powder from back flowing into the pattern air passageway of the gun. The filter 944 may be made of any suitable material that passes air but filters powder, such as for example, sintered polyethylene.

An axially extending recess 946 may be provided between the front end of the diffuser ring 928 and the filter 944. This recess 946 is in fluid communication with the spring pocket 926 and allows air to travel down the electrode passageway 920 to wash the electrode 922 and also prevent powder from back flowing into the gun particularly in areas of high voltage.

A seal 948 such as an o-ring may be provided to seal the feed hose or powder tube to prevent back flow of powder and to help snugly retain the powder tube or feed hose within the nozzle insert 904.

The use of the expansion chamber 906, the deflector 910 and the controlled ratio of equal to or greater than one of the outlet orifice to the inlet cross-sectional areas, either individually or in combination and sub-combination with each other, result in the nozzle producing a slow moving dense phase powder cloud that has excellent transfer efficiency and can be more easily charged. The higher transfer efficiency means that operators can paint or coat an object much faster and with less overspray thereby helping to improve color change times. The use of dense phase and a slow moving cloud also improves transfer efficiency over dilute phase higher velocity spray patterns. The dilute phase spray pattern involves the use of a high volume and flow of air that transports the powder. This large volume air movement necessarily produces aerodynamic effects that reduce the transfer efficiency. The dense phase slow moving cloud of powder has some of its most pronounced benefits with manual guns that are typically held rather close to the parts being sprayed so that the operator cannot rely simply on the natural slow down in speed that occurs as powder is sprayed from a gun. The air assist option to produce a more penetrating powder cloud of dense phase powder is also beneficial with manual guns as it allows the dense phase powder cloud to enter enclosed volumes that otherwise tend to produce Faraday cage effects if the electrode is positioned too close to the part being sprayed.

Figure 24A:
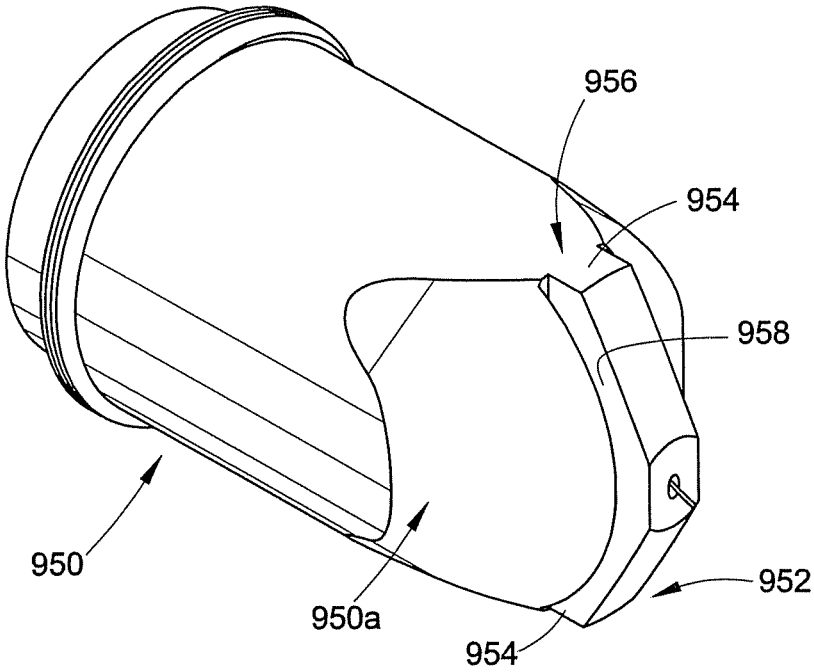
FIGS. 24A-24E illustrate a flat pattern nozzle for a spray applicator in isometric, elevation, front end, cross-section along the line 24D-24D in FIG. 24C and cross-section along the line 24E-24E of FIG. 24C respectively.
Figure 25:
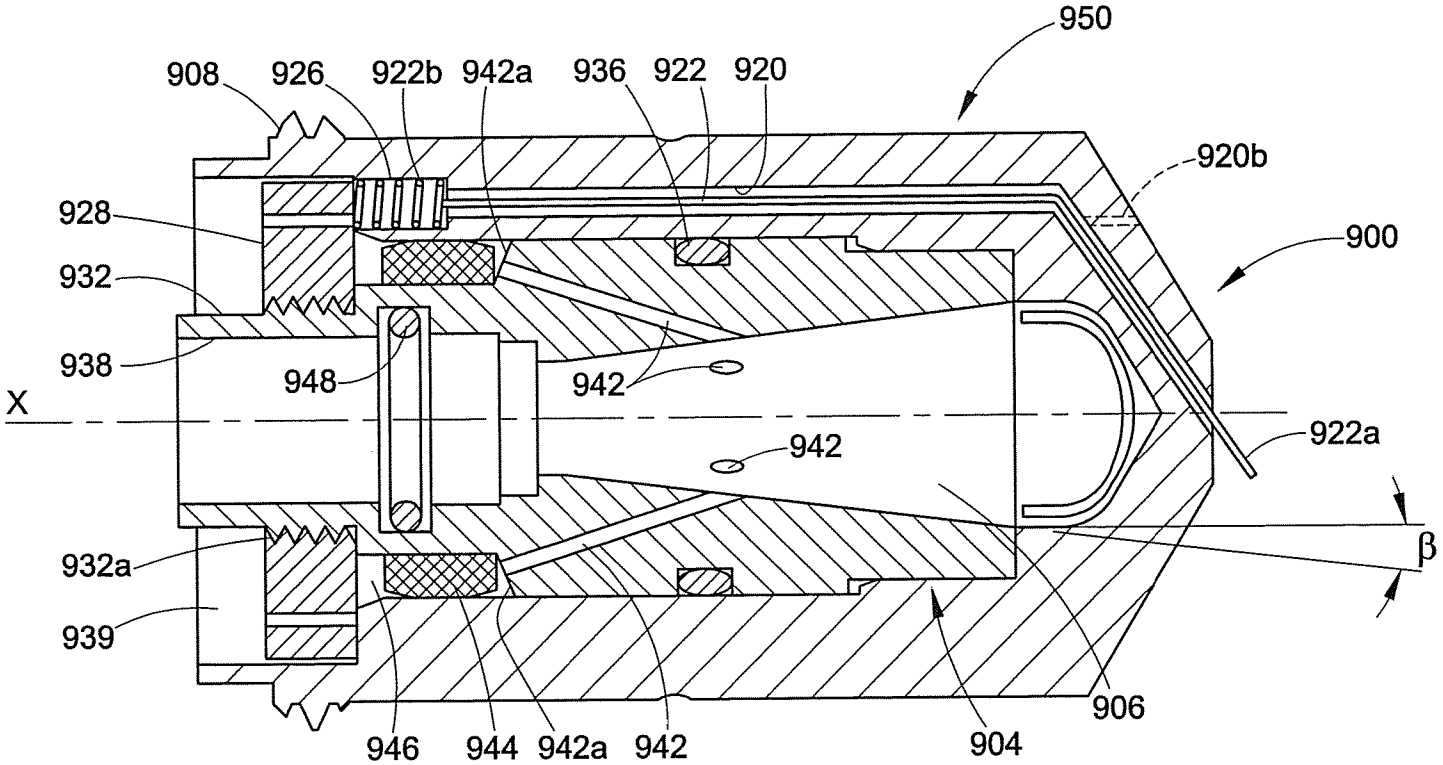
FIG. 25 is a longitudinal cross-section of a first embodiment of a nozzle assembly in accordance with an alternative embodiment of the invention.

FIGS. 24A-24E and 25 illustrate an alternative nozzle design 950 such as may be used, for example, to produce a flat spray pattern. A comparison of FIGS. 23 and 25 shows that the same insert 904 may be used in both nozzle designs and therefore the basic operation is the same with like elements and structural features being given like numerals and the description thereof need not be repeated. The difference between the designs is the shape of the outlet orifice and the deflector, as best illustrated in FIG. 24A.

The flat pattern nozzle 950 includes a generally flat, plate like deflector 952 that is integrally part of the nozzle 950, such as with ribs 954. The nozzle 950 is preferably although not necessarily a one piece nozzle with the deflector 952 integrally part of the nozzle 950 via the ribs 954. The nozzle 950 has a somewhat conical tapered front portion 950*a*. The deflector 952 may be formed by any suitable process such as machining. The space 956 formed between the sides 958 of the deflector 952 and the sides 960 of the nozzle opposite the deflector sides 958 forms the outlet orifice in the form of two slots in this example. In order to produce a good flat spray pattern it is preferred although not required to maintain a narrow width for the outlet orifice 956. The use of dense phase powder allows for the outlet orifice to be substantially smaller as compared to conventional orifice sizes used with dilute phase systems. For example, the nozzle may 2×1 mm slots as contrasted to a conventional orifice of a single slot 4 mm in width. However, as in the other nozzle embodiment herein, it is desired to maintain the ratio of the cross-sectional area of the outlet 956 to the inlet cross-sectional area about equal to or greater than one. From FIGS. 24A, 24E and 25 it is apparent that the flat spray nozzle also includes the integral electrode passageway that centers the electrode tip in the powder cloud formed by the nozzle 950.

In both nozzle designs, the ribs 912, 954 penult the electrical path to be routed outside the powder path, particularly the expansion chamber, yet positioning the electrode tip in the center of the powder cloud. This eliminates electrical path and high voltage elements from having to be positioned in the powder flow path.

In the case of the flat pattern nozzle 950, the angle θ is about zero degrees meaning that the orifice 956 lies generally parallel about the central axis X. In some cases, it may be desired to have the slots cause the powder to impinge such that the angle θ is negative.

Figure 10A:
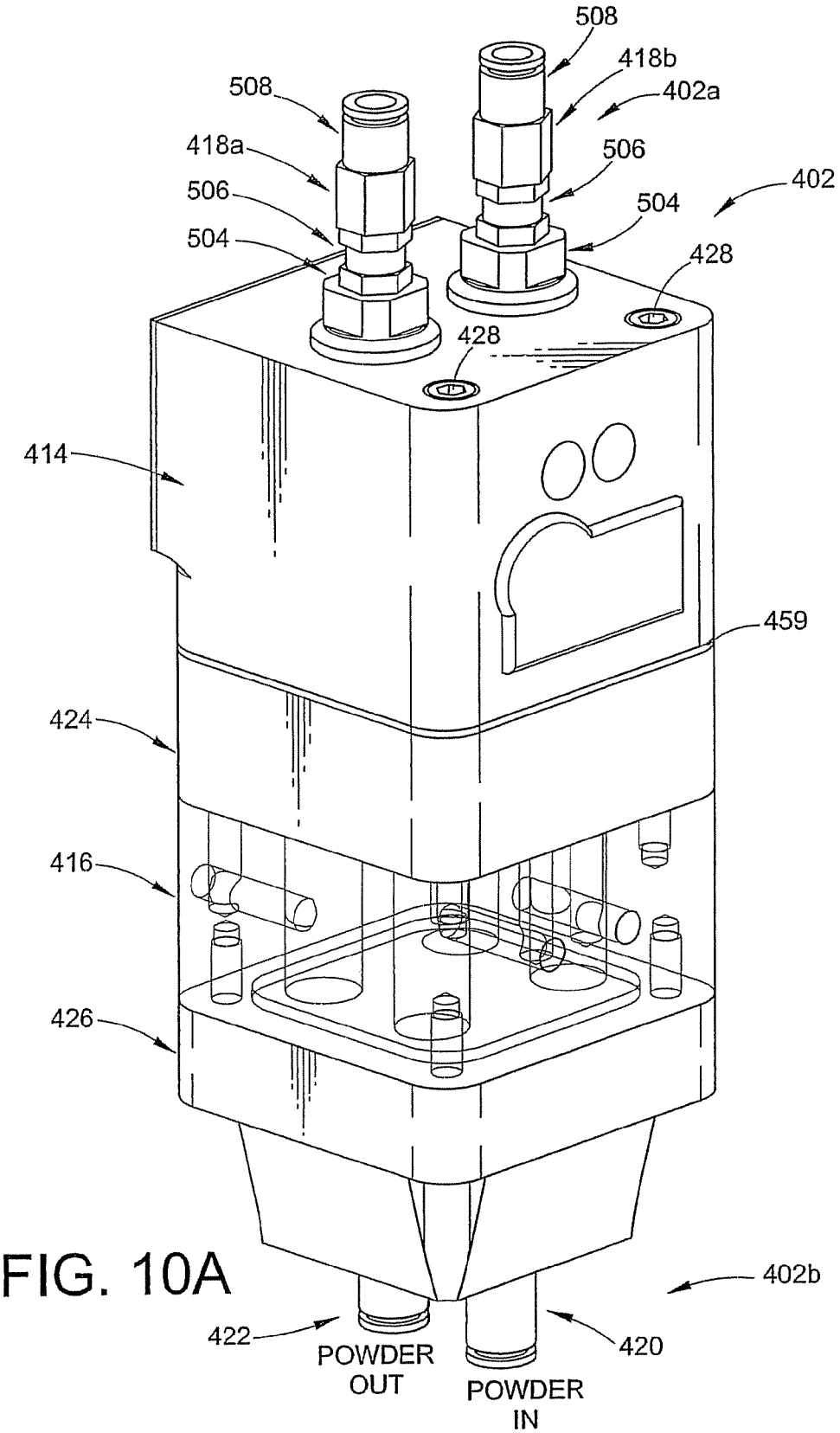
FIGS. 10A-10C are assembled and exploded isometric views of a pump in accordance with the invention.
Figure 10B:
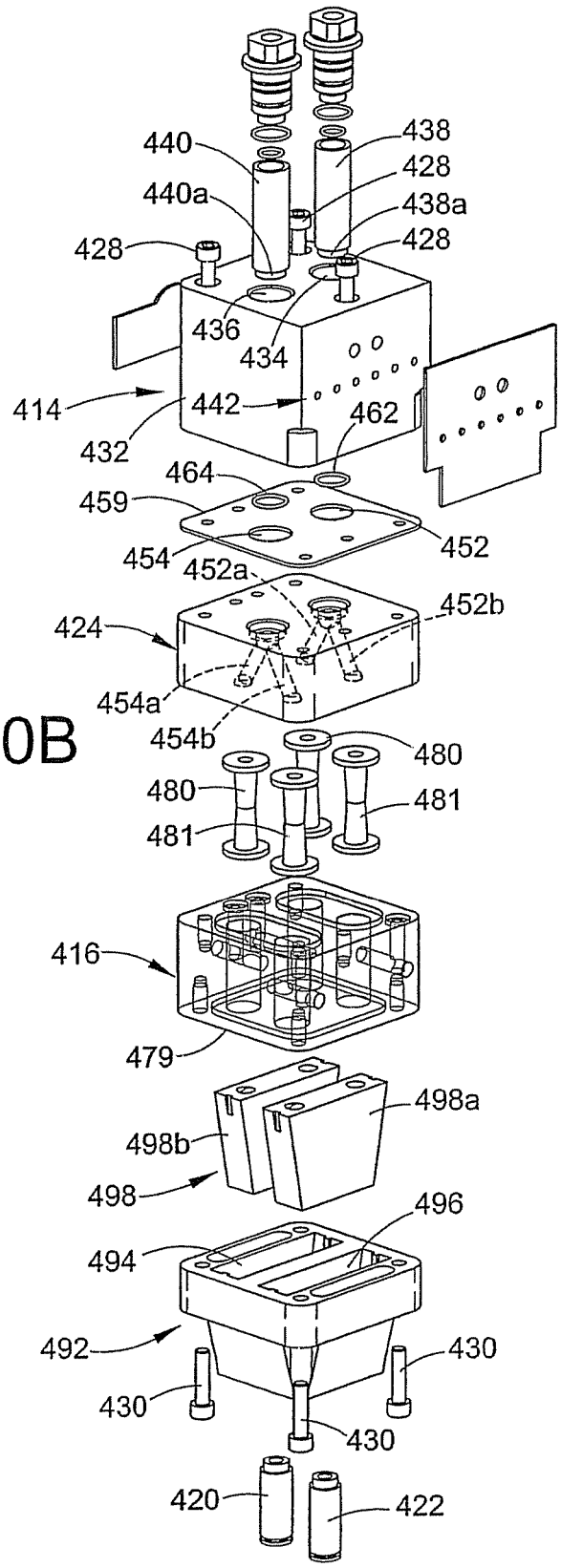
Figure 10C:
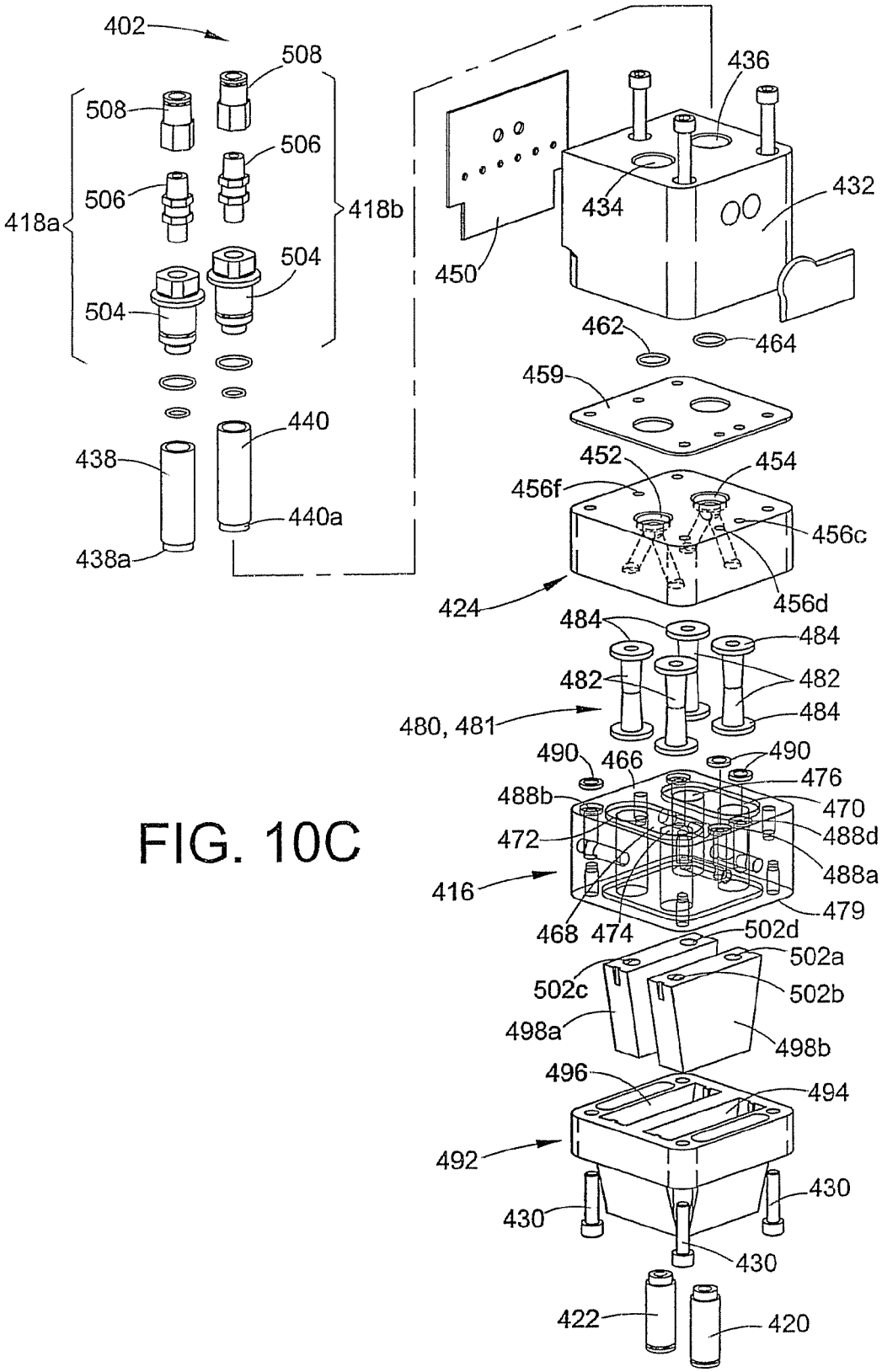
Figure 10D:
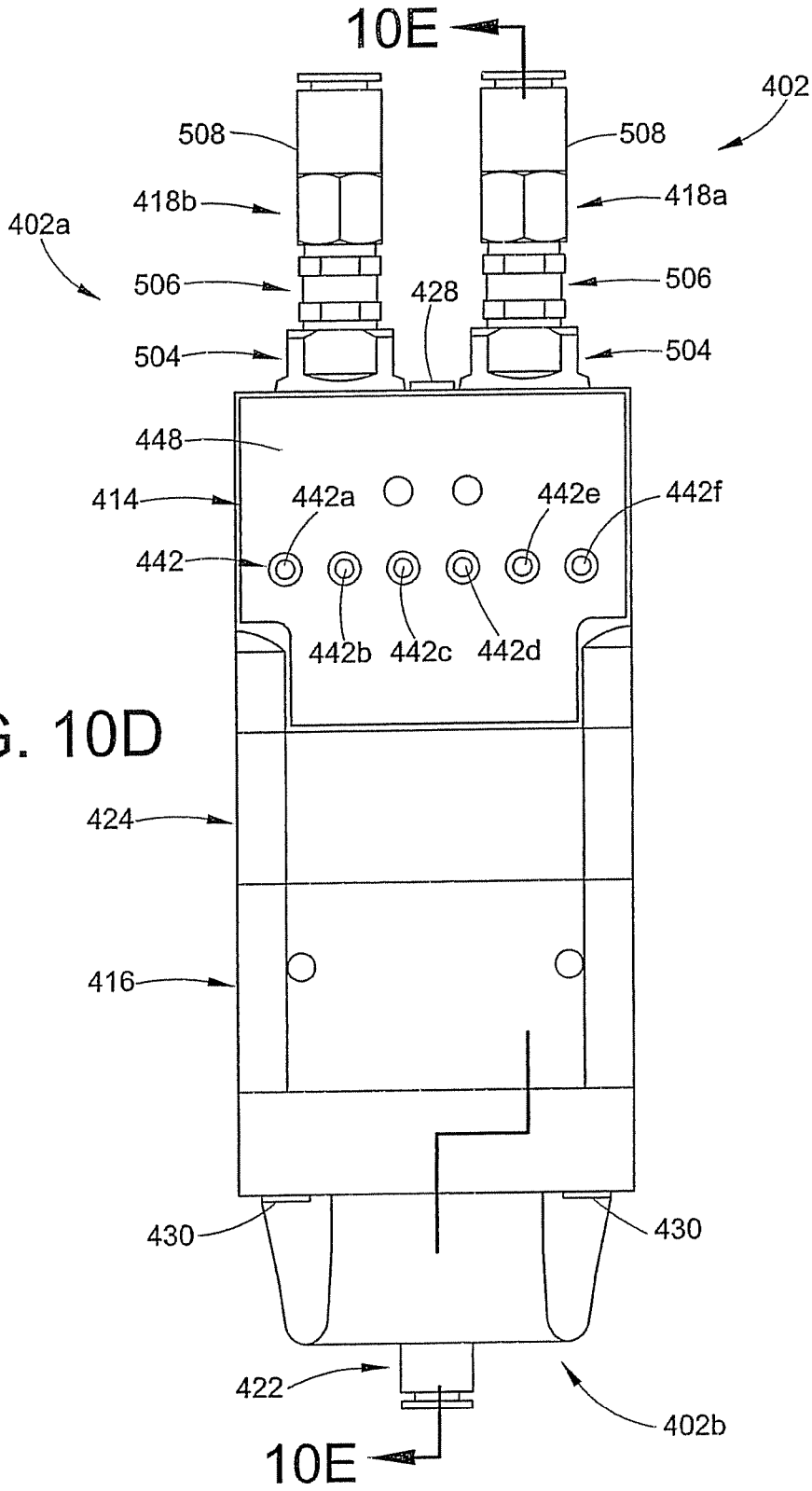
FIGS. 10D-10G are elevation and cross-sectional views of the assembled pump of FIG. 10A.
Figure 10E:
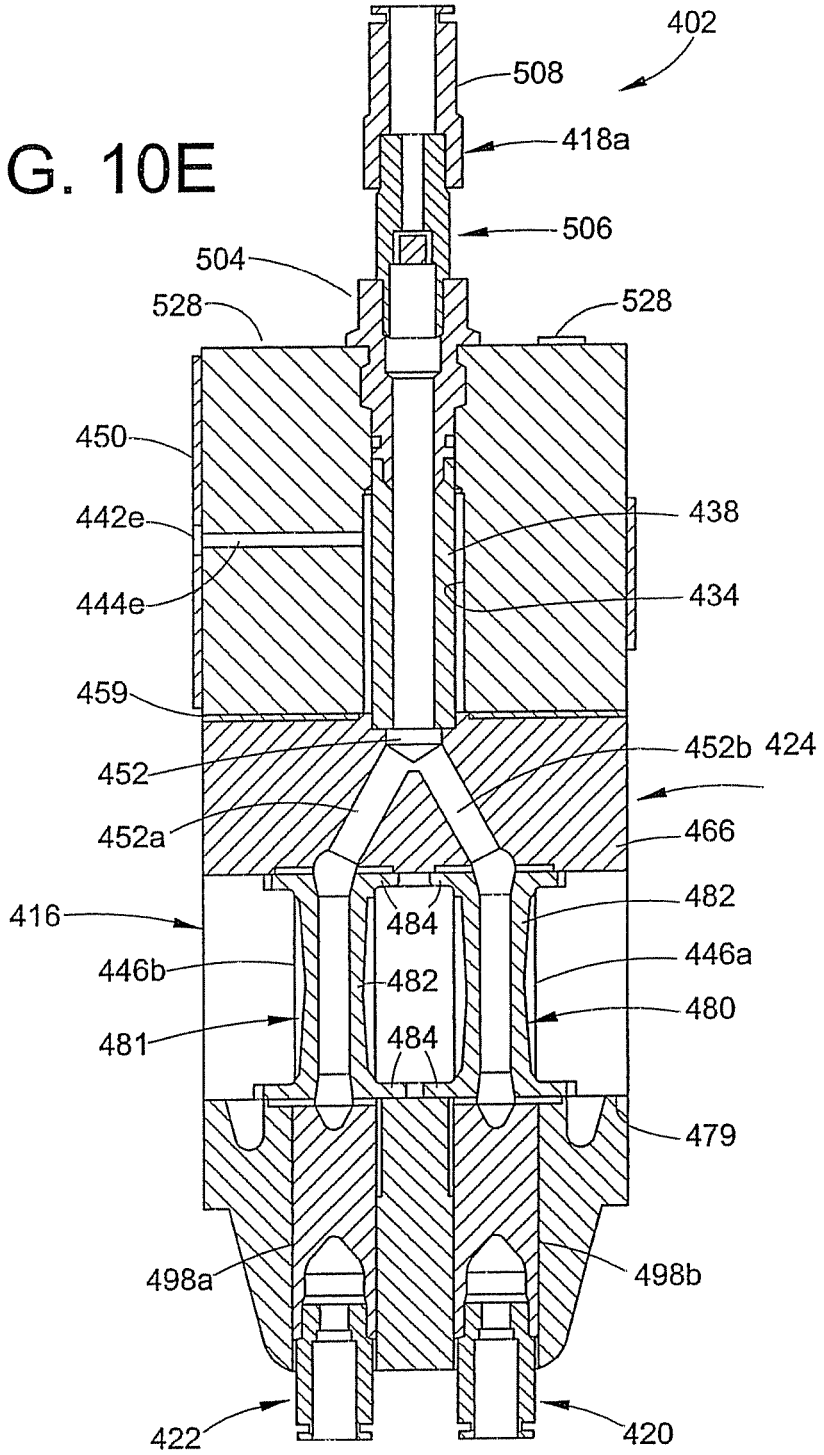
Figure 10F:
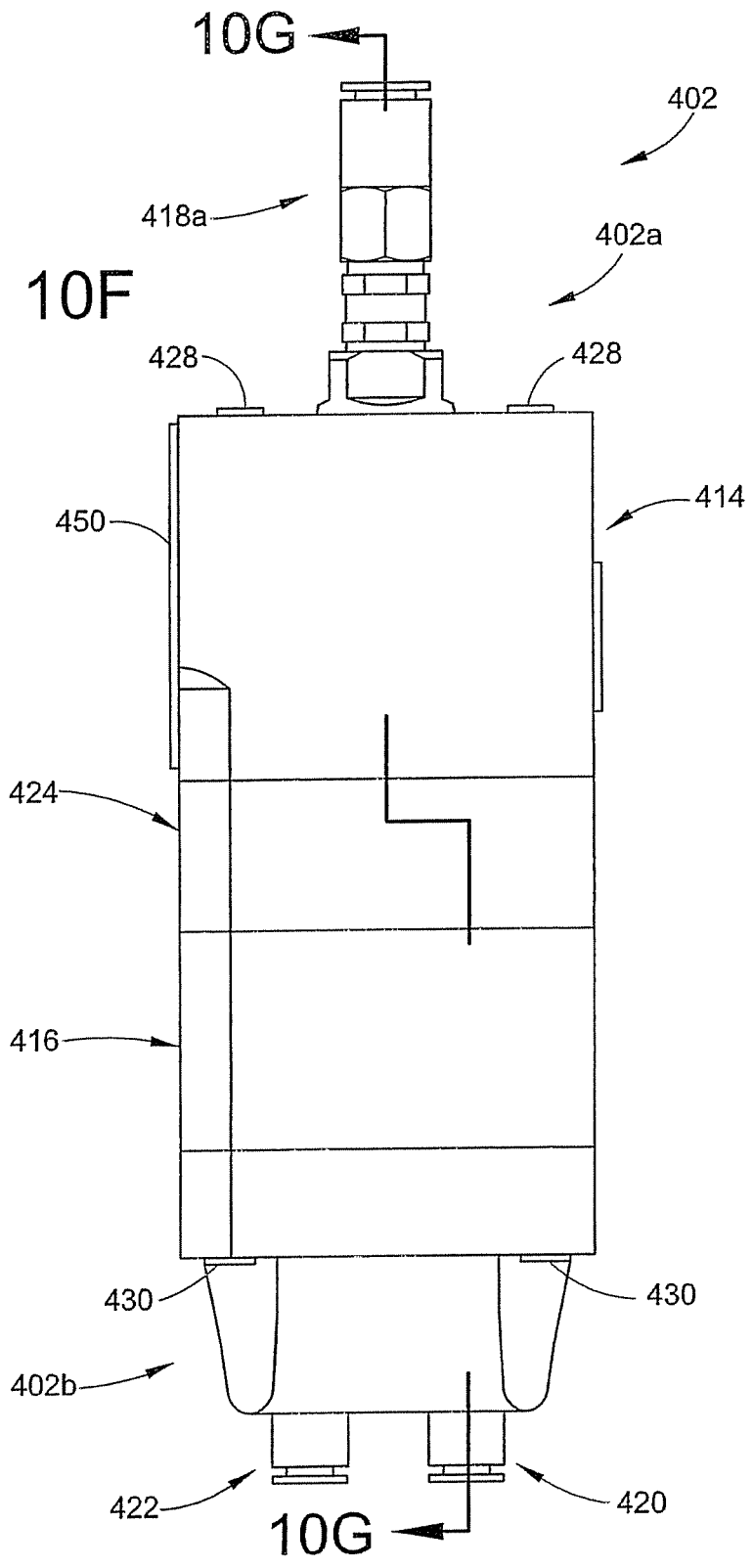
Figure 10G:
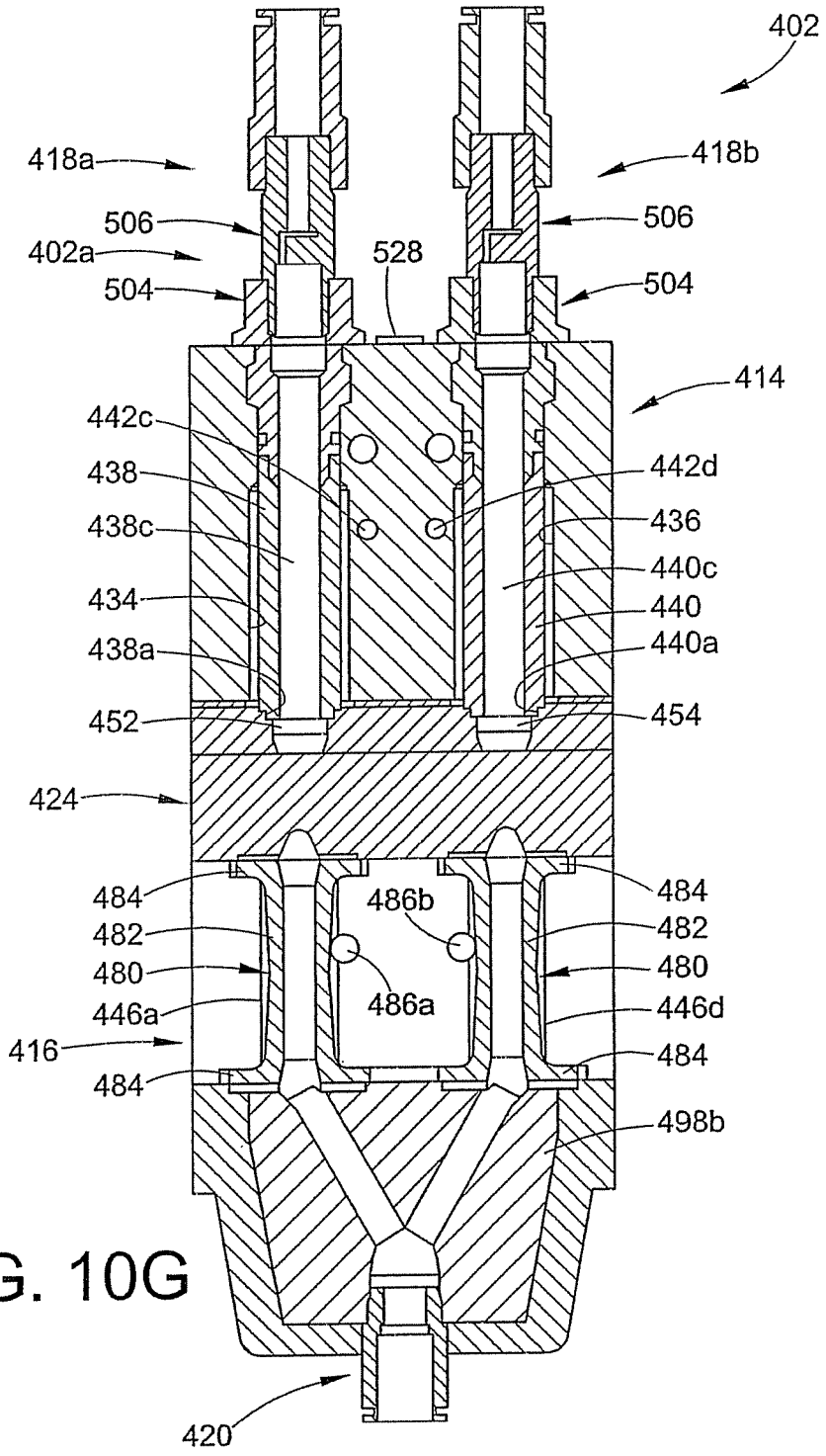
Figure 11A:
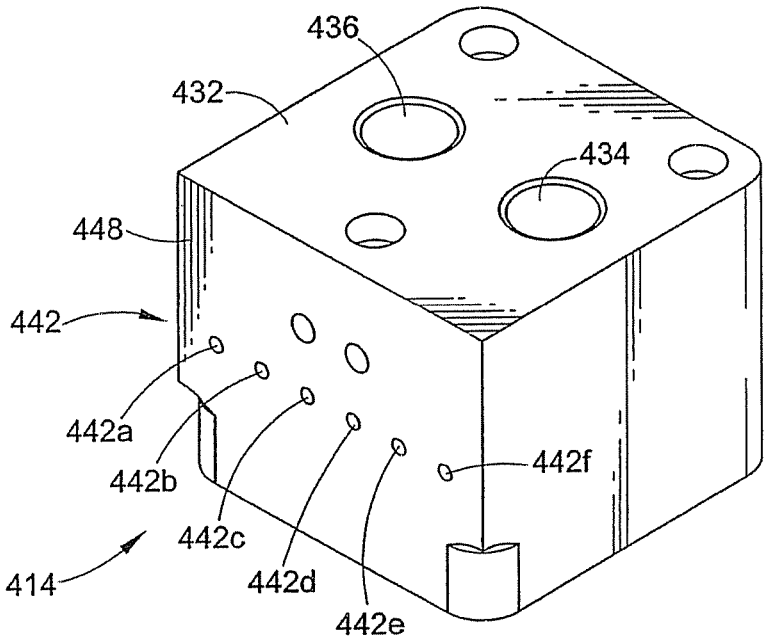
FIGS. 11A and 11B are an isometric and upper plan view of a pump manifold.
Figure 11B:
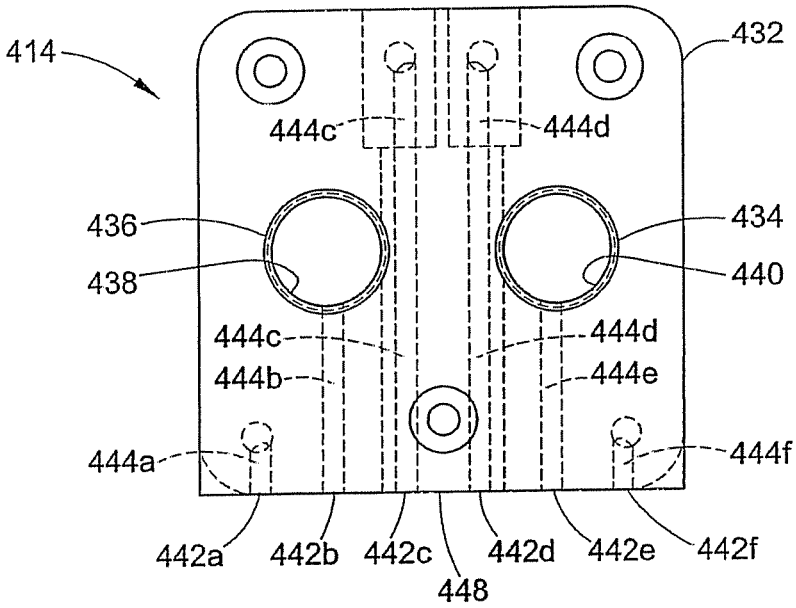

With reference to FIGS. 10A, 10B and 10C there is illustrated an exemplary embodiment of a dense phase pump 402 in accordance with the present invention. Although the pump 402 can be used as a transfer pump as well, it is particularly designed as a gun pump for supplying material to the spray applicators 20. The gun pumps 402 and transfer pumps 400 and 410 share many common design features which will be readily apparent from the detailed descriptions herein.

The pump 402 is preferably although need not be modular in design. The modular construction of the pump 402 is realized with a pump manifold body 414 and a valve body 416. The manifold body 414 houses a pair of pump chambers along with a number of air passages as will be further explained herein. The valve body 416 houses a plurality of valve elements as will also be explained herein. The valves respond to air pressure signals that are communicated into the valve body 416 from the manifold body 414. Although the exemplary embodiments herein illustrate the use of pneumatic pinch valves, those skilled in the are will readily appreciate that various aspects and advantages of the present invention can be realized with the use of other control valve designs other than pneumatic pinch valves.

The upper portion 402*a* of the pump is adapted for purge air arrangements 418*a* and 418*b*, and the lower portion 402*b* of the pump is adapted for a powder inlet hose connector 420 and a powder outlet hose connector 422. A powder feed hose 24 (FIG. 1) is connected to the inlet connector 420 to supply a flow of powder from a supply such as the feed hopper 22. A powder supply hose 406 (FIG. 1) is used to connect the outlet 422 to a spray applicator whether it be a manual or automatic spray gun positioned up at the spray booth 12. The powder supplied to the pump 402 may, but not necessarily must, be fluidized.

Powder flow into an out of the pump 402 thus occurs on a single end 402*b* of the pump. This allows a purge function 418 to be provided at the opposite end 402*a* of the pump thus providing an easier purging operation as will be further explained herein.

If there were only one pump chamber (which is a useable embodiment of the invention) then the valve body 416 could be directly connected to the manifold because there would only be the need for two powder paths through the pump. However, in order to produce a steady, consistent and adjustable flow of powder from the pump, two or more pump chambers are provided. When two pump chambers are used, they are preferably operated out of phase so that as one chamber is receiving powder from the inlet the other is supplying powder to the outlet. In this way, powder flows substantially continuously from the pump. With a single chamber this would not be the case because there is a gap in the powder flow from each individual pump chamber due to the need to first fill the pump chamber with powder. When more than two chambers are used, their timing can be adjusted as needed. In any case it is preferred though not required that all pump chambers communicate with a single inlet and a single outlet.

In accordance with one aspect of the present invention, material flow into and out of each of the pump chambers is accomplished at a single end of the chamber. This provides an arrangement by which a straight through purge function can be used at an opposite end of the pump chamber. Since each pump chamber communicates with the same pump inlet and outlet in the exemplary embodiment, additional modular units are used to provide branched powder flow paths in the form of Y blocks.

A first Y-block 424 is interconnected between the manifold body 414 and the valve body 416. A second Y-block 426 forms the inlet/outlet end of the pump and is connected to the side of the valve body 416 that is opposite the first Y-block 424. A first set of bolts 428 are used to join the manifold body 414, first Y-block 424 and the valve body 416 together. A second set of bolts 430 are used to join the second Y-block 426 to the valve body 416. Thus the pump in FIG. 10A when fully assembled is very compact and sturdy, yet the lower Y-block 426 can easily and separately be removed for replacement of flow path wear parts without complete disassembly of the pump. The first Y-block 424 provides a two branch powder flow path away from each powder chamber. One branch from each chamber communicates with the pump inlet 420 through the valve body 416 and the other branch from each chamber communicates with the pump outlet 422 through the valve body 416. The second Y-block 426 is used to combine the common powder flow paths from the valve body 416 to the inlet 420 and outlet 422 of the pump. In this manner, each pump chamber communicates with the pump inlet through a control valve and with the pump outlet through another control valve. Thus, in the exemplary embodiment, there are four control valves in the valve body that control flow of powder into and out of the pump chambers.

The manifold body 414 is shown in detail in FIGS. 10B, 10E, 10G, 11A and 11B. The manifold 414 includes a body 432 having first and second bores therethrough 434, 436 respectively. Each of the bores receives a generally cylindrical gas permeable filter member 438 and 440 respectively. The gas permeable filter members 438, 440 include lower reduced outside diameter ends 438*a* and 440*a* which insert into a counterbore inside the first Y-block 424 (FIG. 12B) which helps to maintain the members 438, 440 aligned and stable. The upper ends of the filter members abut the bottom ends of purge air fittings 504 with appropriate seals as required. The filter members 438, 440 each define an interior volume (438*c*, 440*c*) that serves as a powder pump chamber so that there are two pump powder chambers provided in this embodiment. A portion of the bores 434, 436 are adapted to receive the purge air arrangements 418*a* and 418*b* as will be described hereinafter.

The filter members 438, 440 may be identical and allow a gas, such as ordinary air, to pass through the cylindrical wall of the member but not powder. The filter members 438, 440 may be made of porous polyethylene, for example. This material is commonly used for fluidizing plates in powder feed hoppers. An exemplary material has about a forty micron opening size and about a 40-50% porosity. Such material is commercially available from Genpore or Poron. Other porous materials may be used as needed. The filter members 438, 440 each have a diameter that is less than the diameter of its associated bore 434, 436 so that a small annular space is provided between the wall of the bore and the wall of the filter member (see FIGS. 10E, 10G). This annular space serves as a pneumatic pressure chamber. When a pressure chamber has negative pressure applied to it, powder is drawn up into the powder pump chamber and when positive pressure is applied to the pressure chamber the powder in the powder pump chamber is forced out.

The manifold body 432 includes a series of six inlet orifices 442. These orifices 442 are used to input pneumatic energy or signals into the pump. Four of the orifices 442*a, c, d* and *f* are in fluid communication via respective air passages 444*a, c, d* and *f* with a respective pressure chamber 446 in the valve block 416 and thus are used to provide valve actuation air as will be explained hereinafter. Note that the air passages 444 extend horizontally from the manifold surface 448 into the manifold body and then extend vertically downward to the bottom surface of the manifold body where they communicate with respective vertical air passages through the upper Y-block 424 and the valve body 416 wherein they join to respective horizontal air passages in the valve body 416 to open into each respective valve pressure chamber. Air filters (not shown) may be included in these air passages to prevent powder from flowing up into the pump manifold 414 and the supply manifold 404 in the event that a valve element or other seal should become compromised. The remaining two orifices, 442*b* and 442*e* are respectively in fluid communication with the bores 434, 436 via air passages 444*b* and 444*e*. These orifices 442*b* and 442*e* are thus used to provide positive and negative pressure to the pump pressure chambers in the manifold body.

The orifices 442 are preferably, although need not be, formed in a single planar surface 448 of the manifold body. The air supply manifold 404 includes a corresponding set of orifices that align with the pump orifices 442 and are in fluid communication therewith when the supply manifold 404 is mounted on the pump manifold 414. In this manner the supply manifold 404 can supply all required pump air for the valves and pump chambers through a simple planar interface. A seal gasket 450 is compressed between the faces of the pump manifold 414 and the supply manifold 404 to provide fluid tight seals between the orifices. Because of the volume, pressure and velocity desired for purge air, preferably separate purge air connections are used between the supply manifold and the pump manifold. Although the planar interface between the two manifolds is preferred it is not required, and individual connections for each pneumatic input to the pump from the supply manifold 404 could be used as required. The planar interface allows for the supply manifold 404, which in some embodiments includes electrical solenoids, to be placed inside a cabinet with the pump on the outside of the cabinet (mounted to the supply manifold through an opening in a cabinet wall) so as to help isolate electrical energy from the overall system 10. It is noted in passing that the pump 402 need not be mounted in any particular orientation during use.

Figure 12A:
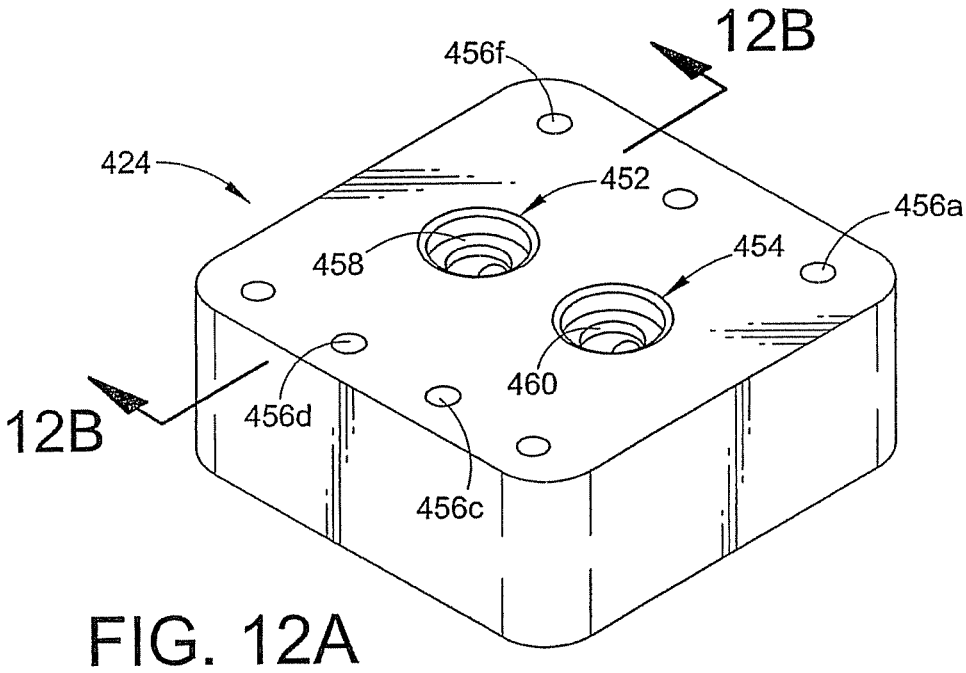
FIGS. 12A and 12B illustrate a first Y-block.
Figure 12B:
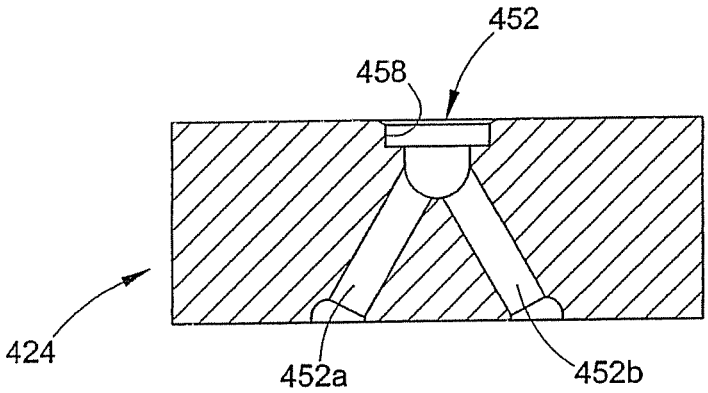

With reference to FIGS. 12A and 12B, the first Y-block 424 includes first and second ports 452, 454 that align with their respective pump chamber 434, 436. Each of the ports 452, 454 communicates with two branches 452*a*, 452*b* and 454*a*, 454*b* respectively (FIG. 12B only shows the branches for the port 452). Thus, the port 452 communicates with branches 452*a* and 452*b*. Therefore, there are a total of four branches in the first Y-block 424 wherein two of the branches communicate with one pressure chamber and the other two communicate with the other pressure chamber. The branches 452*a, b* and 454*a, b* form part of the powder path through the pump for the two pump chambers. Flow of powder through each of the four branches is controlled by a separate pinch valve in the valve body 416 as will be described herein. Note that the Y-block 424 also includes four through air passages 456*a, c, d, f* which are in fluid communication with the air passages 444*a, c, d* and *f* respectively in the manifold body 414. A gasket 459 may be used to provide fluid tight connection between the manifold body 414 and the first Y-block 424.

The ports 452 and 454 include counterbores 458, 460 which receive seals 462, 464 (FIG. 10C) such as conventional o-rings. These seals provide a fluid tight seal between the lower ends of the filter members 438, 440 and the Y-block ports 452, 454. They also allow for slight tolerance variations so that the filter members are tightly held in place.

Figure 13A:
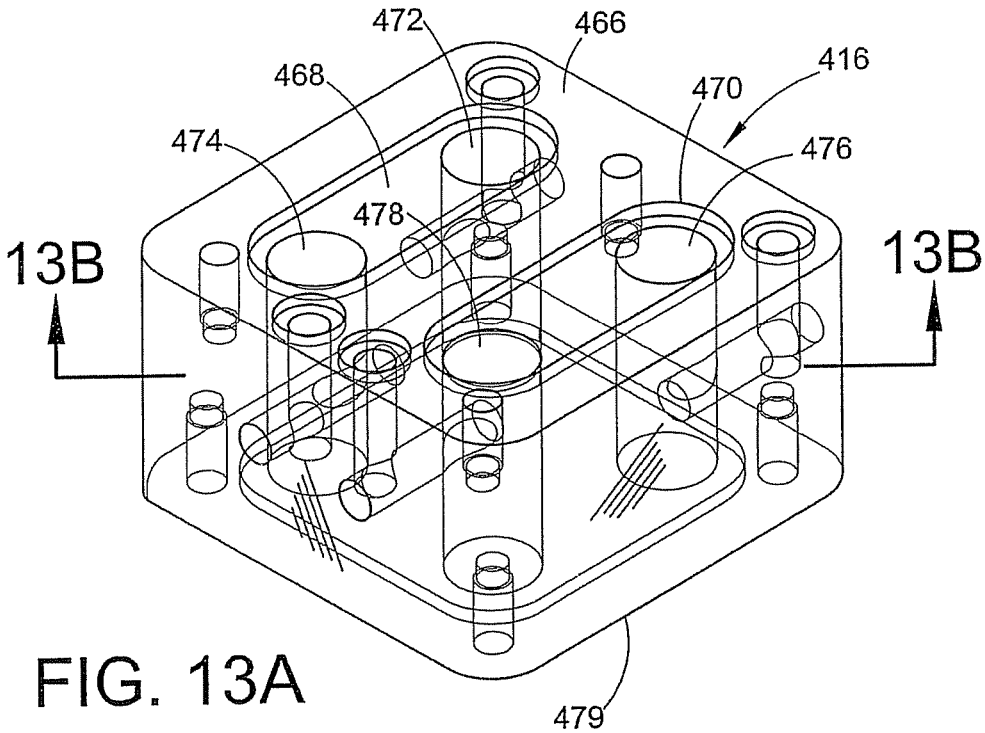
FIGS. 13A and 13B are perspective and cross-sectional views of a valve body.
Figure 13B:
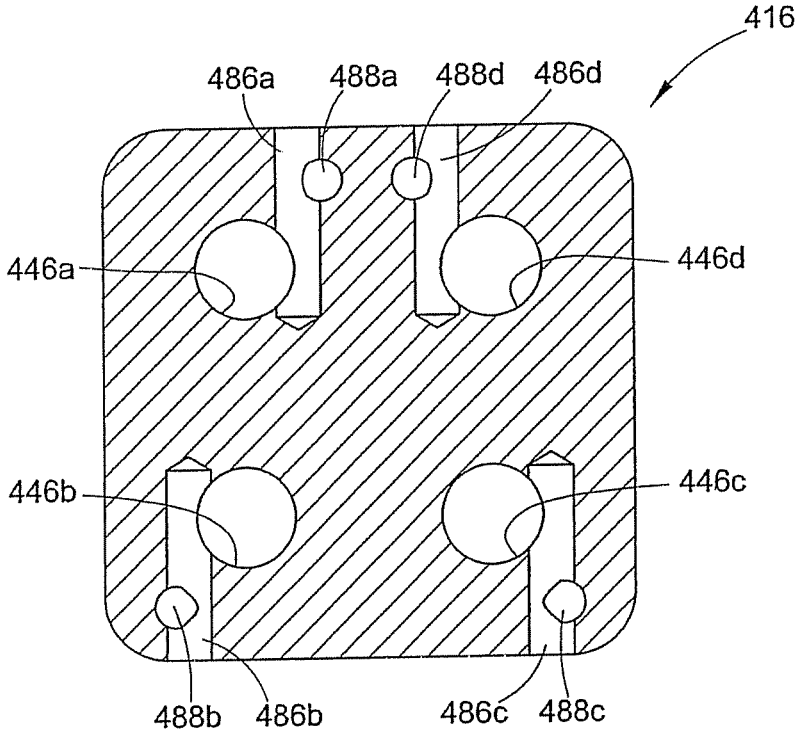

With additional reference to FIGS. 13A and 13B, the valve body 416 includes four through bores 446*a*, 446*b*, 446*c* and 446*d* that function as pressure chambers for a corresponding number of pinch valves. The upper surface 466 of the valve body includes two recessed regions 468 and 470 each of which includes two ports, each port being formed by one end of a respective bore 446. In this embodiment, the first recessed portion 468 includes orifices 472 and 474 which are formed by their respective bores 446*b* and 446*a* respectively. Likewise, the second recessed portion 470 includes orifices 476 and 478 which are formed by their respective bores 446*d* and 446*c* respectively. Corresponding orifices are formed on the opposite side face 479 of the valve body 416.

Each of the pressure chambers 446*a-d* retains either an inlet pinch valve element 480 or an outlet pinch valve 481. Each pinch valve element 480, 481 is a fairly soft flexible member made of a suitable material, such as for example, natural rubber, latex or silicone. Each valve element 480, 481 includes a central generally cylindrical body 482 and two flanged ends 484 of a wider diameter than the central body 482. The flanged ends function as seals and are compressed about the bores 446*a-d* when the valve body 416 is sandwiched between the first Y-block 424 and the second Y-block 426. In this manner, each pinch valve defines a flow path for powder through the valve body 416 to a respective one of the branches 452, 454 in the first Y-block 424. Therefore, one pair of pinch valves (a suction valve and a delivery valve) communicates with one of the pump chambers 440 in the manifold body while the other pair of pinch valves communicates with the other pump chamber 438. There are two pinch valves per chamber because one pinch valve controls the flow of powder into the pump chamber (suction) and the other pinch valve controls the flow of powder out of the pump chamber (delivery). The outer diameter of each pinch valve central body portion 482 is less than the bore diameter of its respect pressure chamber 446. This leaves an annular space surrounding each pinch valve that functions as the pressure chamber for that valve.

The valve body 416 includes air passages 486*a-d* that communicate respectively with the four pressure chamber bores 446*a-d*. as illustrated in FIG. 13B. These air passages 486*a-d* include vertical extensions (as viewed in FIG. 13B) 488*a-d*. These four air passage extensions 488*a, b, c, d* respectively are in fluid communication with the vertical portions of the four air passages 444*d, f, a, c* in the manifold 414 and the vertical passages 456*d, f, a, c* in the upper Y-block 424. Seals 490 are provided for air tight connections.

In this manner, each of the pressure chambers 446 in the valve body 416 is in fluid communication with a respective one of the air orifices 442 in the manifold body 414, all through internal passages through the manifold body, the first Y-block and the valve body. When positive air pressure is received from the supply manifold 404 (FIG. 1) into the pump manifold 414, the corresponding valve 480, 481 is closed by the force of the air pressure acting against the outer flexible surface of the flexible valve body. The valves open due to their own resilience and elasticity when external air pressure in the pressure chamber is removed. This true pneumatic actuation avoids any mechanical actuation or other control member being used to open and close the pinch valves which is a significant improvement over the conventional designs. Each of the four pinch valves 480, 481 is preferably separately controlled for the gun pump 402.

In accordance with another aspect of the invention, the valve body 416 is preferably made of a sufficiently transparent material so that an operator can visually observe the opening and closing of the pinch valves therein. A suitable material is acrylic but other transparent materials may be used. The ability to view the pinch valves also gives a good visual indication of a pinch valve failure since powder will be visible.

Figure 14A:
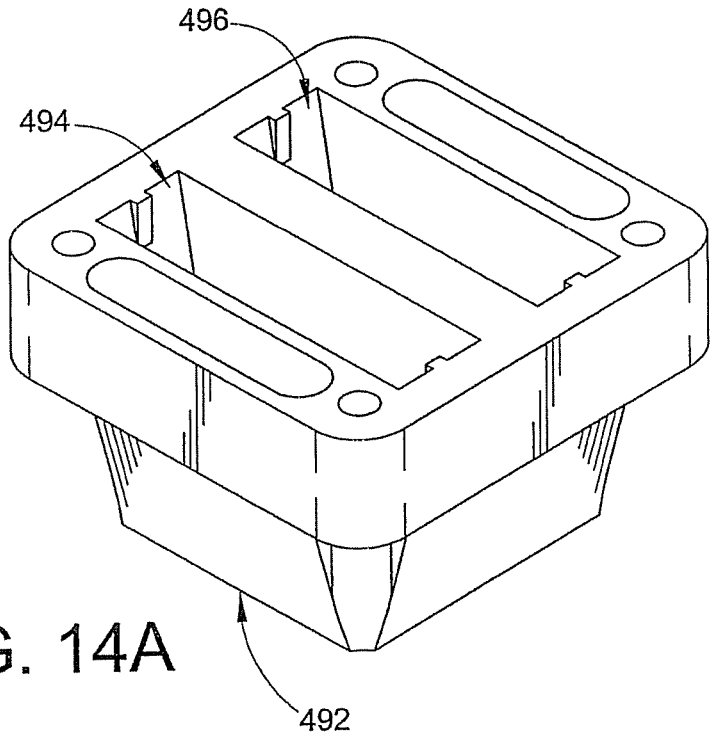
FIGS. 14A and 14B illustrate in perspective another Y-block arrangement.
Figure 14B:
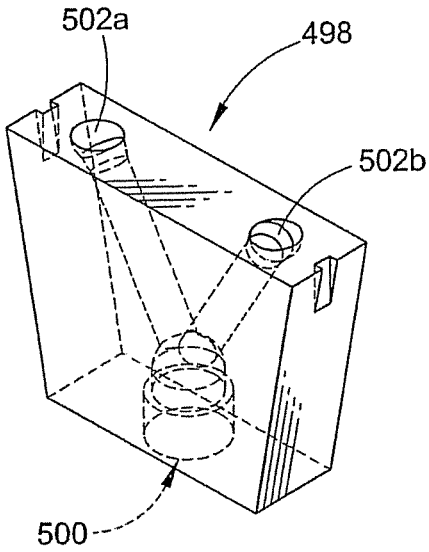

With additional reference to FIGS. 14A and 14B, the remaining part of the pump is the inlet end 402*b* formed by a second Y-block end body 492. The end body 492 includes first and second recesses 494, 496 each of which is adapted to receive a Y-block 498*a* and 498*b*. One of the Y-blocks is used for powder inlet and the other is used for powder outlet. Each Y-block 498 is a wear component due to exposure of its internal surfaces to powder flow. Since the body 492 is simply bolted to the valve body 416, it is a simple matter to replace the wear parts by removing the body 492, thus avoiding having to disassemble the rest of the pump.

Each Y-block 498 includes a lower port 500 that is adapted to receive a fitting or other suitable hose connector 420, 422 (FIG. 10A) with one fitting connected to a hose 24 that runs to a powder supply and another hose 406 to a spray applicator such as a spray gun 20 (FIG. 1). Each Y-block includes two powder path branches 502*a*, 502*b*, 502*c* and 502*d* that extend away from the port 500. Each powder path in the second Y-blocks 498 are in fluid communication with a respective one of the pinch valves 480, 481 in the pinch valve body 416. Thus, powder that enters the pump at the inlet 420 branches through a first of the two lower Y-blocks 498 into two of the pinch valves and from there to the pump chambers. Likewise powder from the two pump chambers recombine from the other two pinch valves into a single outlet 422 by way of the other lower Y-block 498.

The powder flow paths are as follows. Powder enters through a common inlet 420 and branches via paths 502*a* or 502*b* in the lower Y-block 498*b* to the two inlet or suction pinch valves 480. Each of the inlet pinch valves 480 is connected to a respective one of the powder pump chambers 434, 436 via a respective one branch 452, 454 of a respective path through the first or upper Y-block 424. Each of the other branches 452, 454 of the upper Y-block 424 receive powder from a respective pump chamber, with the powder flowing through the first Y-block 424 to the two outlet or delivery pinch valves 481. Each of the outlet pinch valves 481 is also connected to a respect one of the branches 502 in the lower Y-block 498*a* wherein the powder from both pump chambers is recombined to the single outlet 422.

The pneumatic flow paths are as follows. When any of the pinch valves is to be closed, the supply manifold 404 issues a pressure increase at the respective orifice 442 in the manifold body 414. The increased air pressure flows through the respective air passage 442, 444 in the manifold body 414, down through the respective air passage 456 in the first Y-block 424 and into the respective air passage 486 in the valve body 416 to the appropriate pressure chamber 446.

It should be noted that a pump in accordance with the present invention provides for a scalable flow rate based on percent fill of the powder pump chambers, meaning that the flow rate of powder from the pump can be accurately controlled by controlling the open time of the pinch valves that feed powder to the pump chambers. This allows the pump cycle (i.e. the time duration for filling and emptying the pump chambers) to be short enough so that a smooth flow of powder is achieved independent of the flow rate, with the flow rate being separately controlled by operation of the pinch valves. Thus, flow rate can be adjusted entirely by control of the pinch valves without necessarily having to make any physical changes to the pump.

The purge function is greatly simplified in accordance with another aspect of the invention. Because the invention provides a way for powder to enter and exit the pump chambers from a single end, the opposite end of the pump chamber can be used for purge air. With reference to FIGS. 10A, 10C, 10E and 10G, a purge air fitting 504 is inserted into the upper end of its respective pump chamber 438, 440. The fittings 504 receive respective check valves 506 that are arranged to only permit flow into the pump chambers 438, 440. The check valves 506 receive respective purge air hose fittings 508 to which a purge air hose can be connected. Purge air is supplied to the pump from the supply manifold 404 as will be described hereinbelow. The purge air thus can flow straight through the powder pump chambers and through the rest of the powder path inside the pump to very effectively purge the pump for a color change operation. No special connections or changes need to be made by the operator to effect this purging operation, thereby reducing cleaning time. Once the system 10 is installed, the purging function is always connected and available, thereby significantly reducing color change time because the purging function can be executed by the control system 39 without the operator having to make or break any powder or pneumatic connections with the pump.

Note from FIGS. 1 and 10A that with all four pinch valves 480, 481 in an open condition purge air will flow straight through the pump chambers, through the powder paths in the first Y-block 424, the pinch valves themselves 480, 481, the second Y-block 498 and out both the inlet 420 and the outlet 422. Purge air thus can be supplied throughout the pump and then on to the spray applicator to purge that device as well as to purge the feed hoses back to the powder supply 22. Thus in accordance with the invention, a dense phase pump concept is provided that allows forward and reverse purging.

Figure 15:
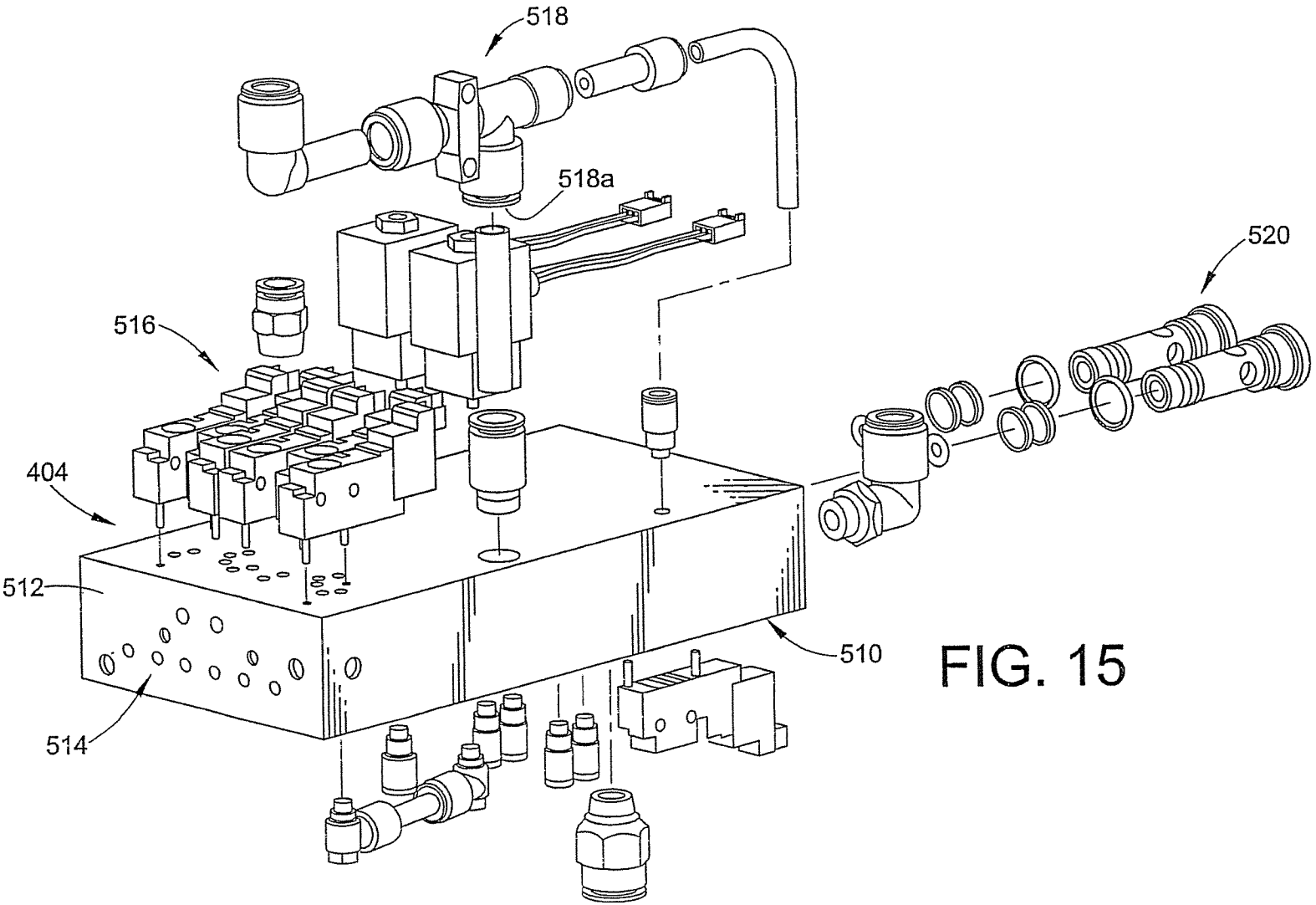
FIG. 15 is an exploded perspective of a supply manifold.

With reference to FIG. 15, the supply manifold 404 illustrated is in essence a series of solenoid valves and air sources that control the flow of air to the pump 402. The particular arrangement illustrated in FIG. 15 is exemplary and not intended to be limiting. The supply of air to operate the pump 402 can be done without a manifold arrangement and in a wide variety of ways. The embodiment of FIG. 15 is provided as it is particularly useful for the planar interface arrangement with the pump, however, other manifold designs can also be used.

The supply manifold 404 includes a supply manifold body 510 that has a first planar face 512 that is mounted against the surface 448 of the pump manifold body 414 (FIG. 11A) as previously described herein. Thus the face 512 includes six orifices 514 that align with their respective orifices 442 in the pump manifold 414. The supply manifold body 510 is machined to have the appropriate number and location of air passages therein so that the proper air signals are delivered to the orifices 514 at the correct times. As such, the manifold further includes a series of valves that are used to control the flow of air to the orifices 514 as well as to control the purge air flow. Negative pressure is generated in the manifold 404 by use of a conventional venturi pump 518. System or shop air is provided to the manifold 404 via appropriate fittings 520. The details of the physical manifold arrangement are not necessary to understand and practice the present invention since the manifold simply operates to provide air passages for air sources to operate the pump and can be implemented in a wide variety of ways. Rather, the details of note are described in the context of a schematic diagram of the pneumatic flow. It is noted at this time, however, that in accordance with another aspect of the invention, a separate control valve is provided for each of the pinch valves in the valve body 414 for purposes that will be described hereinafter.

Figure 16:
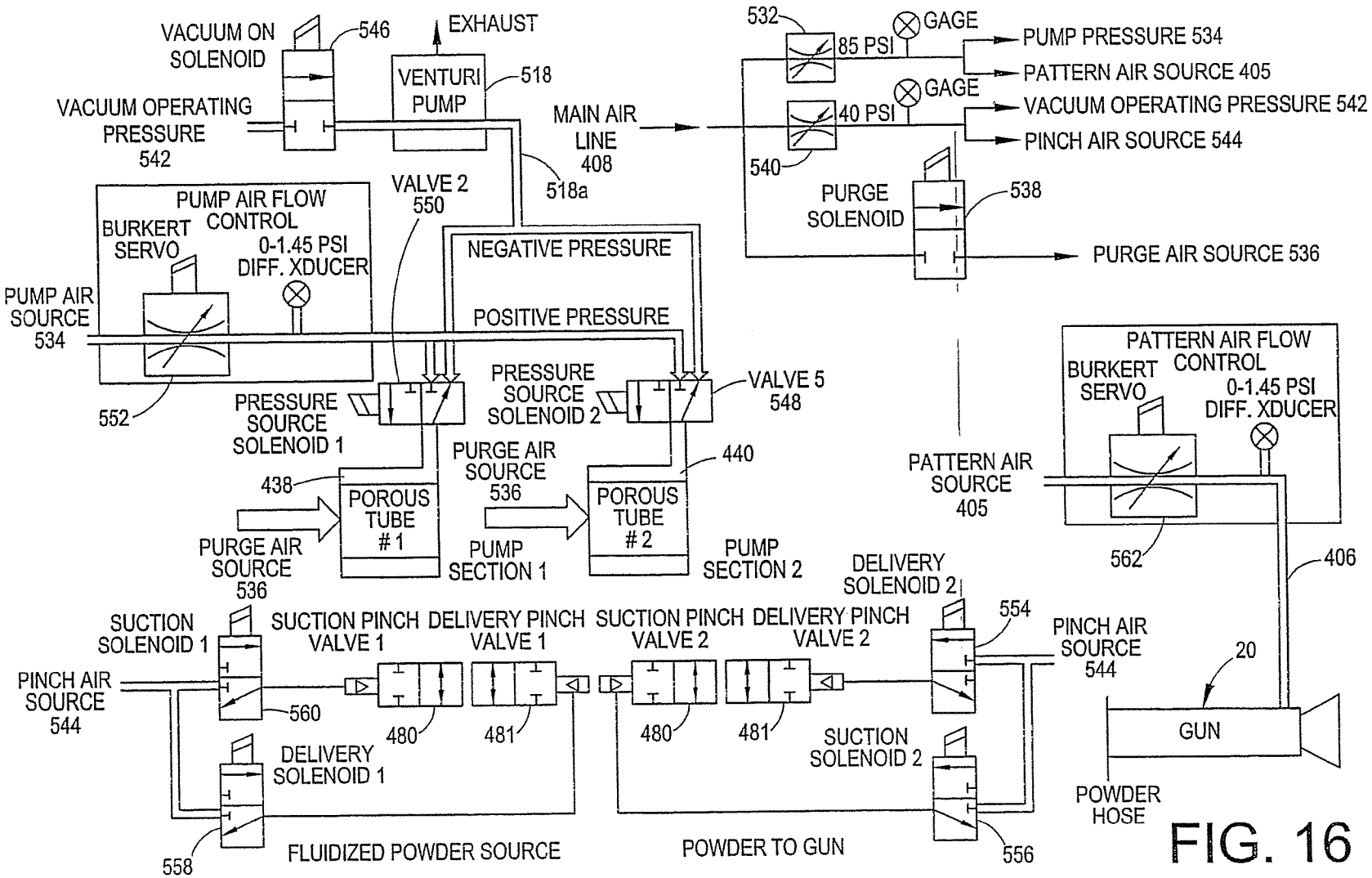
FIG. 16 is an exemplary embodiment of a pneumatic flow arrangement for the pump of FIG. 10A.

With reference to FIG. 16, a pneumatic diagram is provided for a first embodiment of the invention. Main air 408 enters the supply manifold 404 and goes to a first regulator 532 to provide pump pressure source 534 to the pump chambers 438, 440, as well as pattern shaping air source 405 to the spray applicator 20 via air hose 406. Main air also is used as purge air source 536 under control of a purge air solenoid valve 538. Main air also goes to a second regulator 540 to produce venturi air pressure source 542 used to operate the venturi pump (to produce the negative pressure to the pump chambers 438, 440) and also to produce pinch air source 544 to operate the pinch valves 480, 481.

In accordance with another aspect of the invention, the use of the solenoid control valve 538 or other suitable control device for the purge air provides multiple purge capability. The first aspect is that two or more different purge air pressures and flows can be selected, thus allowing a soft and hard purge function. Other control arrangements besides a solenoid valve can be used to provide two or more purge air flow characteristics. The control system 39 selects soft or hard purge, or a manual input could be used for this selection. For a soft purge function, a lower purge air flow is supplied through the supply manifold 404 into the pump pressure chambers 434, 436 which is the annular space between the porous members 438, 440 and their respective bores 434, 436. The control system 39 further selects one set of pinch valves (suction or delivery) to open while the other set is closed. The purge air bleeds through the porous filters 438, 440 and out the open valves to either purge the system forward to the spray gun 20 or reverse (backward) to the supply 22. The control system 39 then reverses which pinch valves are open and closed. Soft purge may also be done in both directions at the same time by opening all four pinch valves. Similarly, the air pressure may be ramped up to remove additional powder from the hose and gun. Higher purge air pressure and flow may be used for a harder purge function forward, reverse or at the same time. The purge function carried out by bleeding air through the porous members 438, 440 also helps to remove powder that has been trapped by the porous members, thus extending the useful life of the porous members before they need to be replaced.

The soft purge function may then be followed by a second soft purge operation in which the powder supply hose 406*a, b* is disconnected from the gun and the free end of the hose positioned in or aimed at the spray booth interior. The soft purge operation is then performed at low pressure and may also be ramped up to a medium pressure in order to blow powder from the hose into the spray booth.

Hard or system purge can also be effected using the two purge arrangements 418*a* and 418*b*. The system purge may be performed with the gun reconnected to the supply hose after the soft purge cycle has been completed. During system purge the soft purge flow of air through the porous elements may remain on, and in fact may remain on during an entire color change operation. High pressure flow air can be input through the purge air fittings 508 (the purge air can be provided from the supply manifold 404) and this air flows straight through the powder pump chambers defined in part by the porous members 438, 440 and out the pump. Again, the pinch valves 480, 481 can be selectively operated as desired to purge forward or reverse or at the same time. After the hard purge is completed through the gun, the gun can again be removed for a hard purge through the hose into the booth. When the nozzle embodiments of FIGS. 23 and 25 are used, the air assist feature may also remain on throughout a purge operation and a color change operation.

It should be noted that the ability to optionally purge in only the forward or reverse direction provides a better purging capability because if purging can only be done in both directions at the same time, the purge air will flow through the path of least resistance whereby some of the powder path regions may not get adequately purged. For example, when trying the purge a spray applicator and a supply hopper, if the applicator is completely open to air flow, the purge air will tend to flow out the applicator and might not adequately purge the hopper or supply.

The invention thus provides a pump design by which the entire powder path from the supply to and through the spray guns can be purged separately or at the same time with virtually no operator action required. The optional soft purge may be useful to gently blow out residue powder from the flow path before hitting the powder path with hard purge air, thereby preventing impact fusion or other deleterious effects from a hard purge being performed first.

The positive air pressure 542 for the venturi enters a control solenoid valve 546 and from there goes to the venturi pump 518. The output 518*a* of the venturi pump is a negative pressure or partial vacuum that is connected to an inlet of two pump solenoid valves 548, 550. The pump valves 548 and 550 are used to control whether positive or negative pressure is applied to the pump chambers 438, 440. Additional inputs of the valves 548, 550 receive positive pressure air from a first servo valve 552 that receives pump pressure air 534. The outlets of the pump valves 548, 550 are connected to a respective one of the pump chambers through the air passage scheme described hereinabove. Note that the purge air 536 is schematically indicated as passing through the porous tubes 438, 440.

Thus, the pump valves 550 and 552 are used to control operation of the pump 402 by alternately applying positive and negative pressure to the pump chambers, typically 180° out of phase so that as one chamber is being pressurized the other is under negative pressure and vice-versa. In this manner, one chamber is filling with powder while the other chamber is emptying. It should be noted that the pump chambers may or may not completely "fill" with powder. As will be explained herein, very low powder flow rates can be accurately controlled using the present invention by use of the independent control valves for the pinch valves. That is, the pinch valves can be independently controlled apart from the cycle rate of the pump chambers to feed more or less powder into the chambers during each pumping cycle.

Pinch valve air 544 is input to four pinch valve control solenoids 554, 556, 558 and 560. Four valves are used so that there is preferably independent timing control of the operation of each of the four pinch valves 480, 481. In FIG. 16, "delivery pinch valve" refers to those two pinch valves 481 through which powder exits the pump chambers and "suction pinch valve" refers to those two pinch valves 480 through which powder is fed to the pump chambers. Though the same reference numeral is used, each suction pinch valve and each delivery pinch valve is separately controlled.

A first delivery solenoid valve 554 controls air pressure to a first delivery pinch valve 481; a second delivery solenoid valve 558 controls air pressure to a second delivery pinch valve 481; a first suction solenoid valve 556 controls air pressure to a first suction pinch valve 480 and a second suction solenoid valve 560 controls air pressure to a second suction pinch valve 480.

The pneumatic diagram of FIG. 16 thus illustrates the functional air flow that the manifold 404 produces in response to various control signals from the control system 39 (FIG. 1).

Figure 17A:
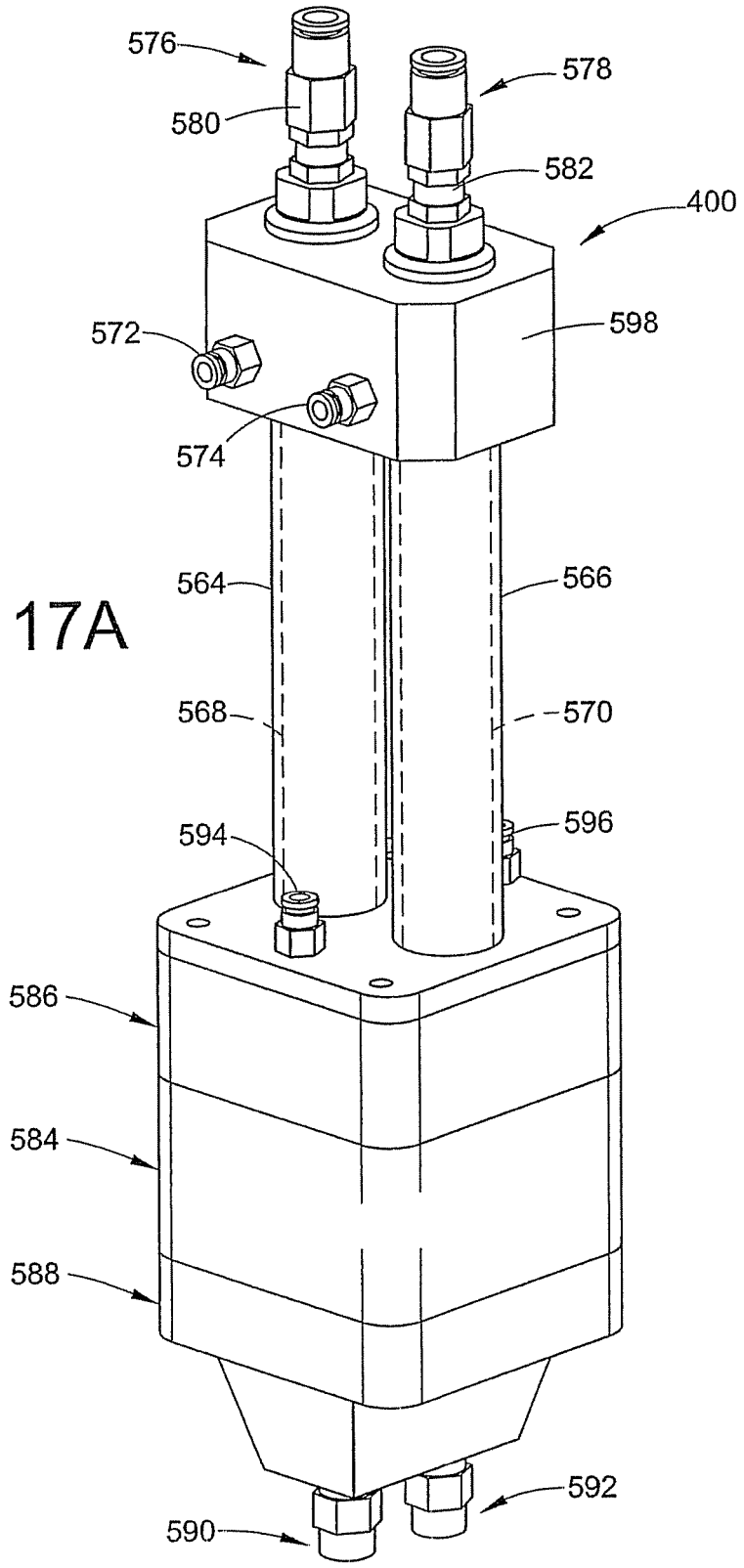
FIGS. 17A and 17B are an isometric and exploded isometric of a transfer pump in accordance with the invention.
Figure 17B:
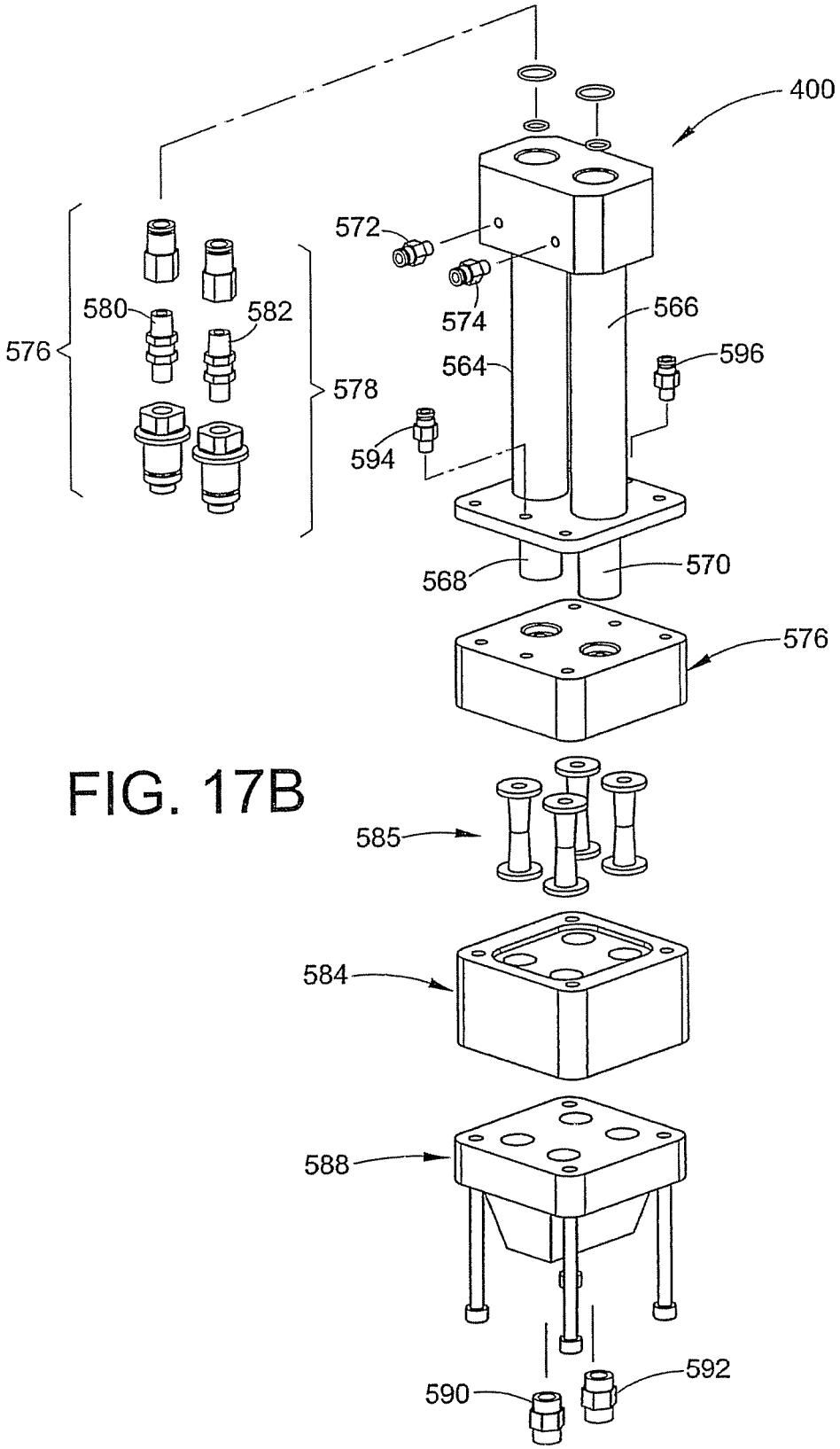

With reference to FIGS. 17A and 17B, and in accordance with another aspect of the invention, a transfer pump 400 is also contemplated. Many aspects of the transfer pump are the same or similar to the spray applicator pump 402 and therefore need not be repeated in detail.

Although a gun pump 402 may be used as a transfer pump as well, a transfer pump is primarily used for moving larger amounts of powder between receptacles as quickly as needed. Moreover, although a transfer pump as described herein will not have the same four way independent pinch valve operation, a transfer valve may be operated with the same control process as the gun pump. For example, some applications require large amounts of material to be applied over large surfaces yet maintaining control of the finish. A transfer pump could be used as a pump for the applicators by also incorporating the four independent pinch valve control process described herein.

In the system of FIG. 1 a transfer pump 400 is used to move powder from the recovery system 28 (such as a cyclone) back to the feed center 22. A transfer pump 410 is also used to transfer virgin powder from a supply, such as a box, to the feed center 22. In such examples as well as others, the flow characteristics are not as important in a transfer pump because the powder flow is not being sent to a spray applicator. In accordance then with an aspect of the invention, the gun pump is modified to accommodate the performance expectations for a transfer pump.

In the transfer pump 400, to increase the powder flow rate larger pump chambers are needed. In the embodiment of FIGS. 17A and 17B, the pump manifold is now replaced with two extended tubular housings 564 and 566 which enclose lengthened porous tubes 568 and 570. The longer tubes 568, 570 can accommodate a greater amount of powder during each pump cycle. The porous tubes 568, 570 have a slightly smaller diameter than the housings 564, 566 so that an annular space is provided therebetween that serves as a pressure chamber for both positive and negative pressure. Air hose fittings 572 and 574 are provided to connect air hoses that are also connected to a source of positive and negative pressure at a transfer pump air supply system to be described hereinafter. Since a pump manifold is not being used, the pneumatic energy is individually plumbed into the pump 400.

The air hose fittings 572 and 574 are in fluid communication with the pressure chambers within the respective housings 564 and 566. In this manner, powder is drawn into and pushed out of the powder chambers 568, 570 by negative and positive pressure as in the gun pump design. Also similarly, purge port arrangements 576 and 578 are provided and function the same way as in the gun pump design, including check valves 580, 582.

A valve body 584 is provided that houses four pinch valves 585 which control the flow of powder into and out of the pump chambers 568 and 570 as in the gun pump design. As in the gun pump, the pinch valves are disposed in respective pressure chambers in the valve body 584 such that positive air pressure is used to close a valve and the valves open under their own resilience when the positive pressure is removed. A different pinch valve actuation scheme however is used as will be described shortly. An upper Y-block 586 and a lower Y-block 588 are also provided to provide branched powder flow paths as in the gun pump design. The lower Y-block 588 thus is also in communication with a powder inlet fitting 590 and a powder outlet fitting 592. Thus, powder in from the single inlet flows to both pump chambers 568, 570 through respective pinch valves and the upper Y-block 586, and powder out of the pump chambers 568, 570 flows through respective pinch valves to the single outlet 592. The branched powder flow paths are realized in a manner similar to the gun pump embodiment and need not be repeated herein. The transfer pump may also incorporate replaceable wear parts or inserts in the lower Y-block 588 as in the gun pump.

Again, since a pump manifold is not being used in the transfer pump, separate air inlets 594 and 596 are provided for operation of the pinch valves which are disposed in pressure chambers as in the gun pump design. Only two air inlets are needed even though there are four pinch valves for reasons set forth below. An end cap 598 may be used to hold the housings in alignment and provide a structure for the air fittings and purge fittings.

Because quantity of flow is of greater interest in the transfer pump than quality of the powder flow, individual control of all four pinch valves is not needed although it could alternatively be done. As such, pairs of the pinch valves can be actuated at the same time, coincident with the pump cycle rate. In other words, when the one pump chamber is filling with powder, the other is discharging powder, and respective pairs of the pinch valves are thus open and closed. The pinch valves can be actuated synchronously with actuation of positive and negative pressure to the pump chambers. Moreover, single air inlets to the pinch valve pressure chambers can be used by internally connecting respective pairs of the pressure chambers for the pinch valve pairs that operate together. Thus, two pinch valves are used as delivery valves for powder leaving the pump, and two pinch valves are used as suction valves for powder being drawing into the pump. However, because the pump chambers alternate delivery and suction, during each half cycle there is one suction pinch valve open and one delivery pinch valve open, each connected to different ones of the pump chambers. Therefore, internally the valve body 584 the pressure chamber of one of the suction pinch valves and the pressure chamber for one of the delivery pinch valves are connected together, and the pressure chambers of the other two pinch valves are also connected together. This is done for pinch valve pairs in which each pinch valve is connected to a different pump chamber. The interconnection can be accomplished by simply providing cross-passages within the valve body between the pair of pressure chambers.

Figure 18:
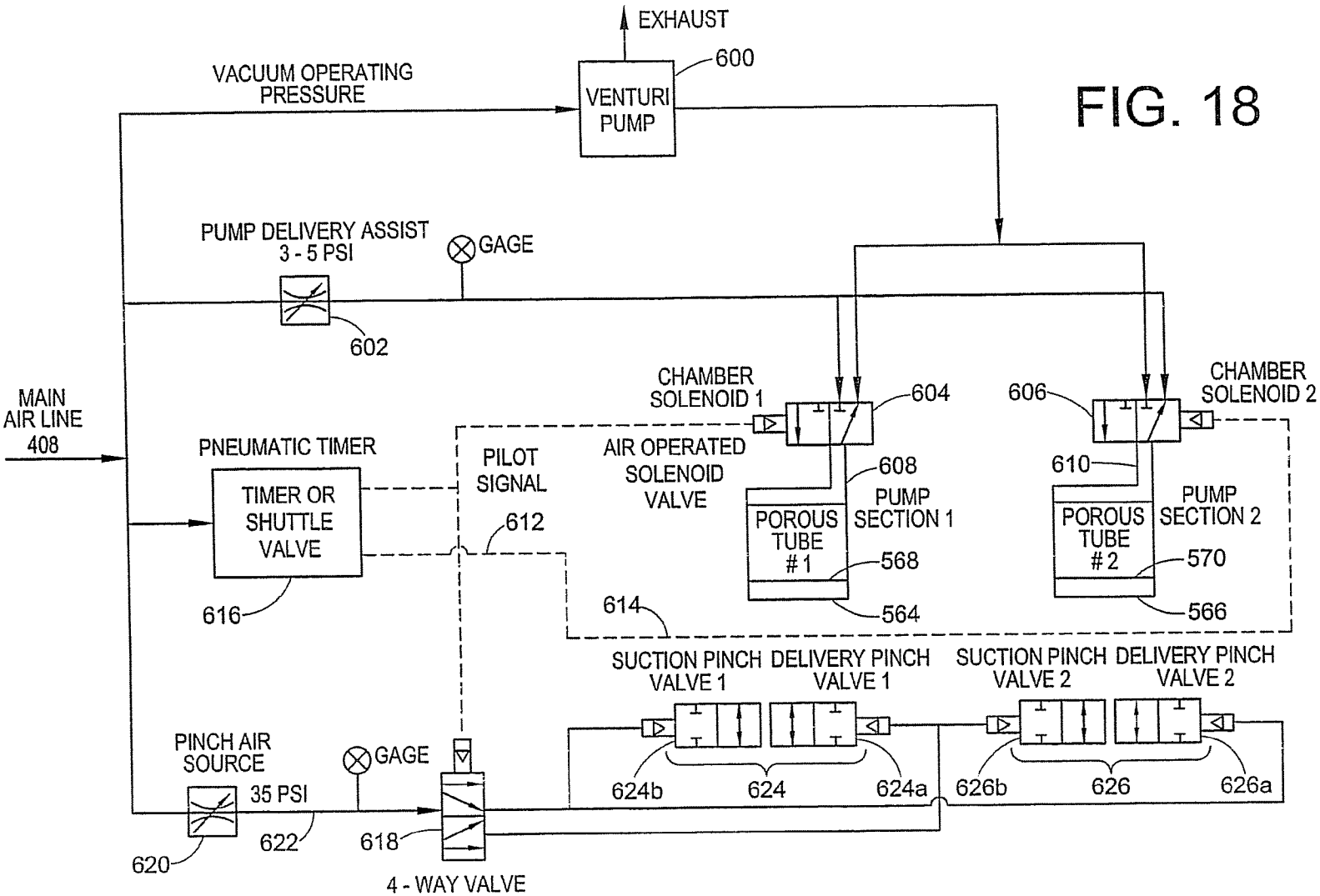
FIG. 18 is an exemplary embodiment of a pneumatic flow arrangement for a transfer pump.

With reference to FIG. 18, the pneumatic diagram for the transfer pump 400 is somewhat more simplified than for a pump that is used with a spray applicator. Main air 408 is input to a venturi pump 600 that is used to produce negative pressure for the transfer pump chambers. Main air also is input to a regulator 602 with delivery air being supplied to respective inputs to first and second chamber solenoid valves 604, 606. The chamber valves also receive as an input the negative pressure from the venturi pump 600. The solenoid valves 604, 606 have respective outputs 608, 610 that are in fluid communication with the respective pressure chambers of the transfer pump.

The solenoid valves in this embodiment are air actuated rather than electrically actuated. Thus, air signals 612 and 614 from a pneumatic timer or shuttle valve 616 are used to alternate the valves 604, 606 between positive and negative pressure outputs to the pressure chambers of the pump. An example of a suitable pneumatic timer or shuttle valve is model S9 568/68-1/4-SO available from Hoerbiger-Origa. As in the gun pump, the pump chambers alternate such that as one is filling the other is discharging. The shuttle timer signal 612 is also used to actuate a 4-way valve 618. Main air is reduced to a lower pressure by a regulator 620 to produce pinch air 622 for the transfer pump pinch valves. The pinch air 622 is delivered to the 4-way valve 618. The pinch air is coupled to the pinch valves 624 for the one pump chamber and 626 for the other pump chamber such that associated pairs are open and closed together during the same cycle times as the pump chambers. For example, when the delivery pinch valve 624*a* is open to the one pump chamber, the delivery pinch valve 626*a* for the other pump chamber is closed, while the suction pinch valve 624*b* is closed and the suction pinch valve 626*b* is open. The valves reverse during the second half of each pump cycle so that the pump chambers alternate as with the gun pump. Since the pinch valves operate on the same timing cycle as the pump chambers, a continuous flow of powder is achieved.

Figure 19:
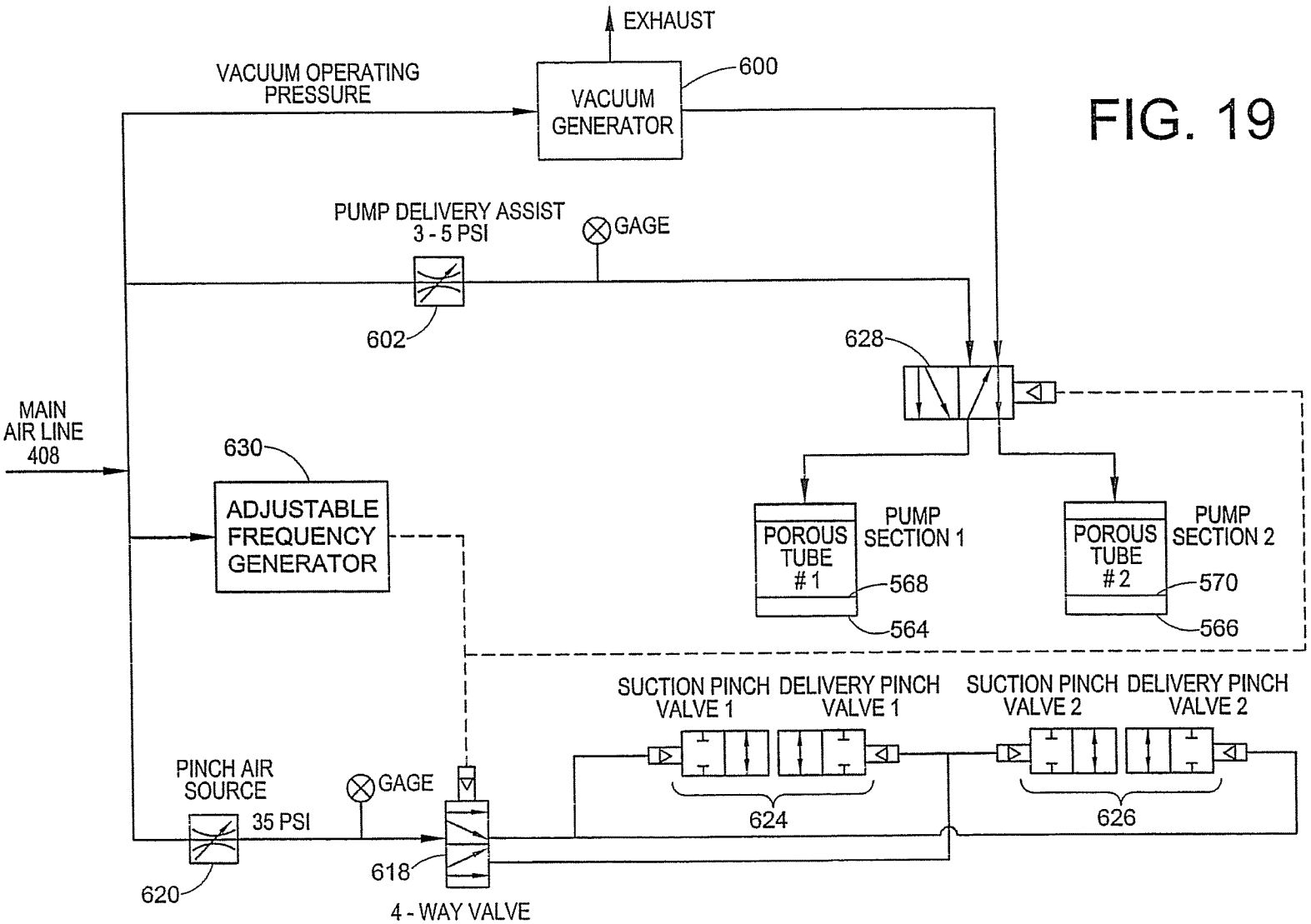
FIG. 19 is an alternative embodiment of a pneumatic circuit for the transfer pump.

FIG. 19 illustrates an alternative embodiment of the transfer pump pneumatic circuit. In this embodiment, the basic operation of the pump is the same, however, now a single valve 628 is used to alternate positive and negative pressure to the pump chambers. In this case, a pneumatic frequency generator 630 is used. A suitable device is model 81 506 490 available from Crouzet. The generator 630 produces a varying air signal that actuates the chamber 4-way valve 628 and the pinch air 4-way valve 618. As such, the alternating cycles of the pump chambers and the associated pinch valves is accomplished.

Figure 20:
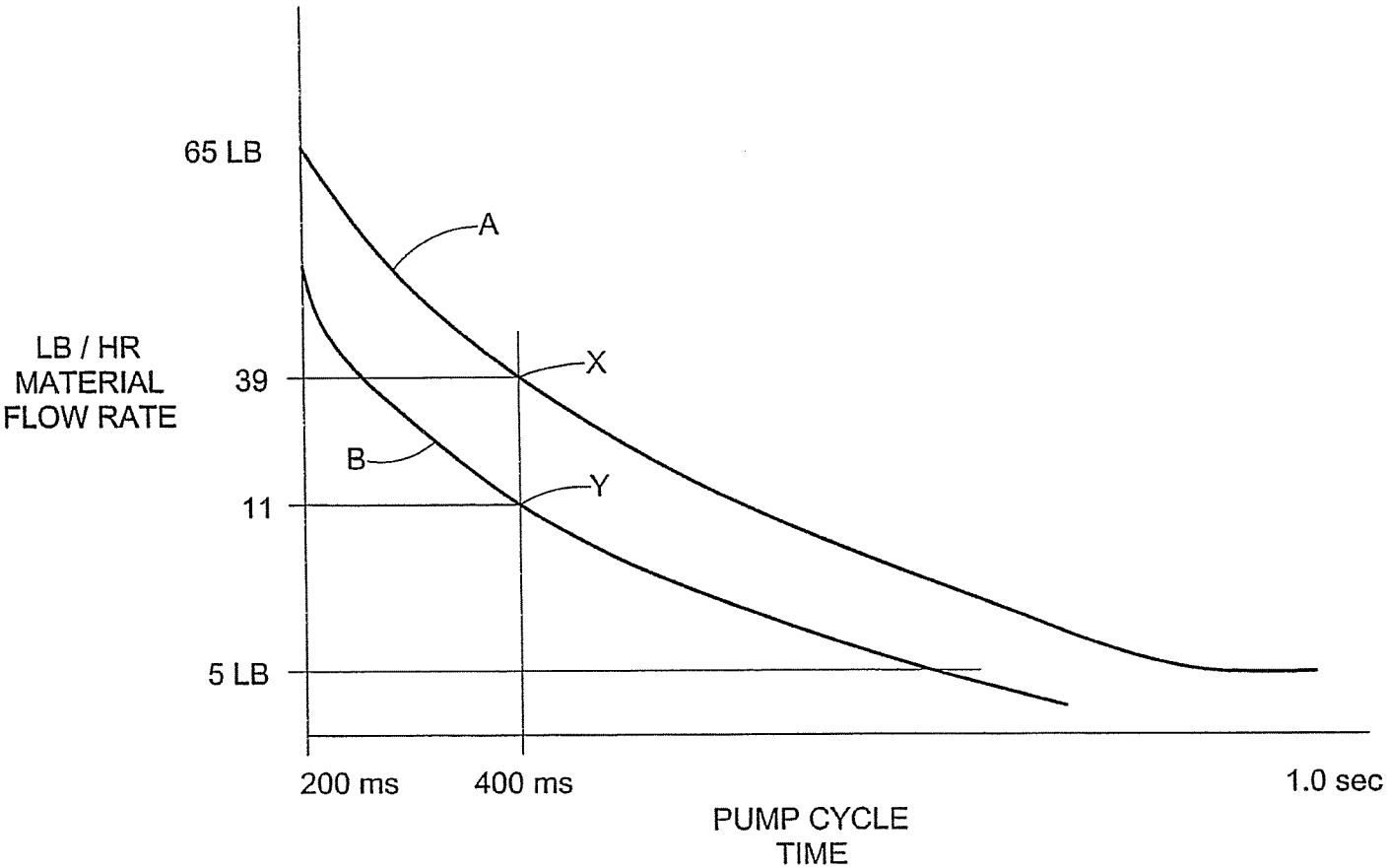
FIG. 20 is a representation of material flow rate curves for a pump operating in accordance with the invention.

FIG. 20 illustrates a flow control aspect of the present invention that is made possible by the independent control of the pinch valves 480, 481. This illustration is for explanation purposes and does not represent actual measured data, but a typical pump in accordance with the present invention will show a similar performance. The graph plots total flow rate in pounds per hour out of the pump versus pump cycle time. A typical pump cycle time of 400 milliseconds means that each pump chamber is filling or discharging during a 400 msec time window as a result of the application of negative and positive pressure to the pressure chambers that surround the porous members. Thus, each chamber fills and discharges during a total time of 800 msec. Graph A shows a typical response if the pinch valves are operated at the same time intervals as the pump chamber. This produces the maximum powder flow for a given cycle time. Thus, as the cycle time increases the amount of powder flow decreases because the pump is operating slower. Flow rate thus increases as the cycle time decreases because the actual time it takes to fill the pump chambers is much less than the pump cycle time. Thus there is a direct relationship between how fast or slow the pump is running (pump cycle time based on the time duration for applying negative and positive pressure to the pump pressure chambers) and the powder flow rate.

Graph B is significant because it illustrates that the powder flow rate, especially low flow rates, can be controlled and selected by changing the pinch valve cycle time relative to the pump cycle time. For example, by shortening the time that the suction pinch valves stay open, less powder will enter the pump chamber, no matter how long the pump chamber is in suction mode. In FIG. 20, for example, graph A shows that at pump cycle time of 400 msec, a flow rate of about 39 pounds per hour is achieved, as at point X. If the pinch valves however are closed in less than 400 msec time, the flow rated drops to point Y or about 11 pounds per hour, even though the pump cycle time remains at 400 msec. What this assures is a smooth consistent powder flow even at low flow rates. Smoother powder flow is effected by higher pump cycle rates, but as noted above this would also produce higher powder flow rates. So to achieve low powder flow rates but with smooth powder flow, the present invention allows control of the powder flow rate even for faster pump cycle rates, because of the ability to individually control operation of the suction pinch valves, and optionally the delivery pinch valves as well. An operator can easily change flow rate by simply entering in a desired rate. The control system 39 is programmed so that the desired flow rate is effected by an appropriate adjustment of the pinch valve open times. It is contemplated that the flow rate control is accurate enough that in effect this is an open loop flow rate control scheme, as opposed to a closed loop system that uses a sensor to measure actual flow rates. Empirical data can be collected for given overall system designs to measure flow rates at different pump cycle and pinch valve cycle times. This empirical data is then stored as recipes for material flow rates, meaning that if a particular flow rate is requested the control system will know what pinch valve cycle times will achieve that rate. Control of the flow rate, especially at low flow rates, is more accurate and produces a better, more uniform flow by adjusting the pinch valve open or suction times rather than slowing down the pump cycle times as would have to be done with prior systems. Thus the invention provides a scalable pump by which the flow rate of material from the pump can be, if desired, controlled without changing the pump cycle rate.

Figure 21:
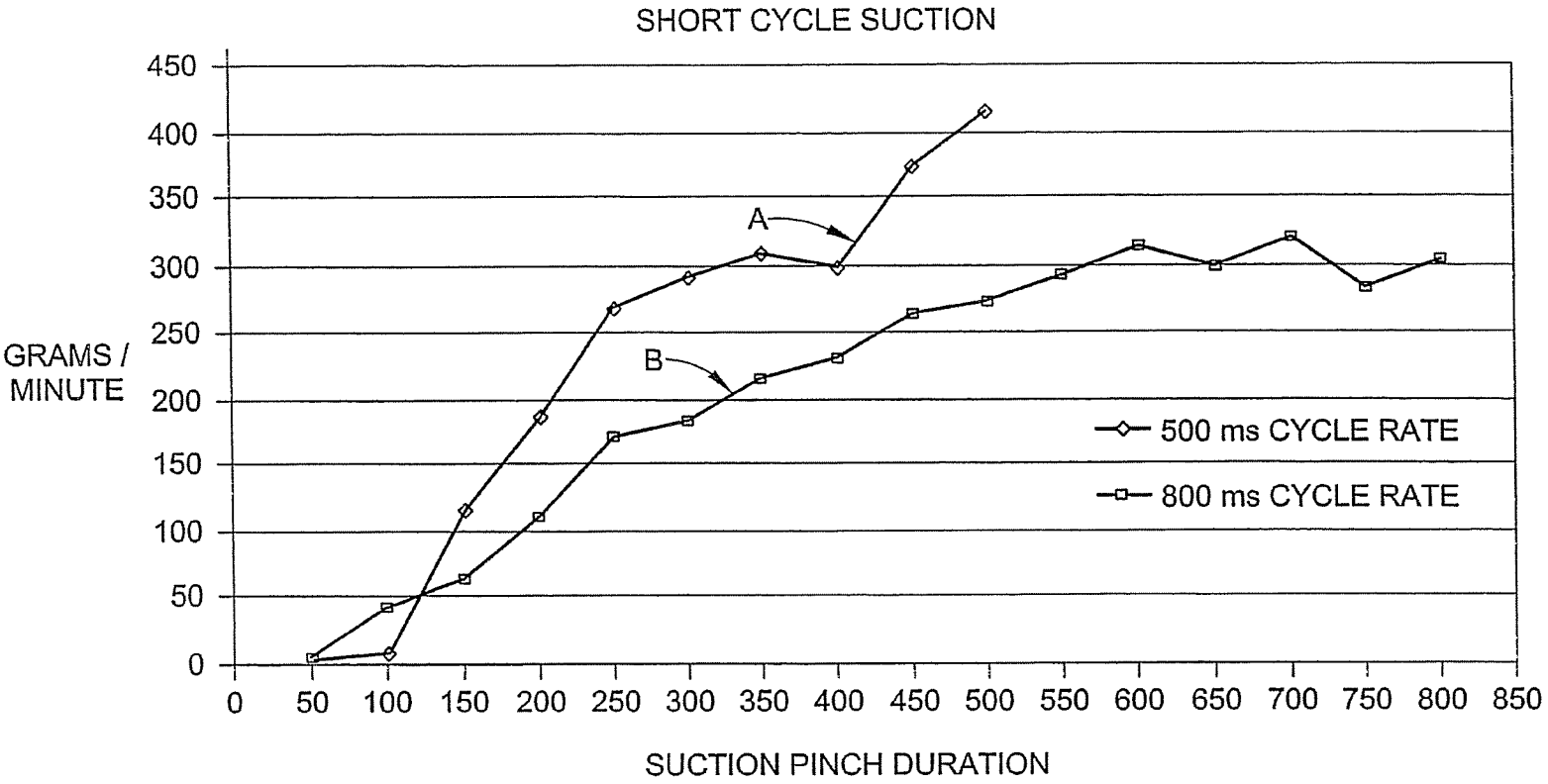
FIG. 21 is a graph depicting powder flow rates versus pinch valve open duration for two different pump cycle rates.
Figure 22A:
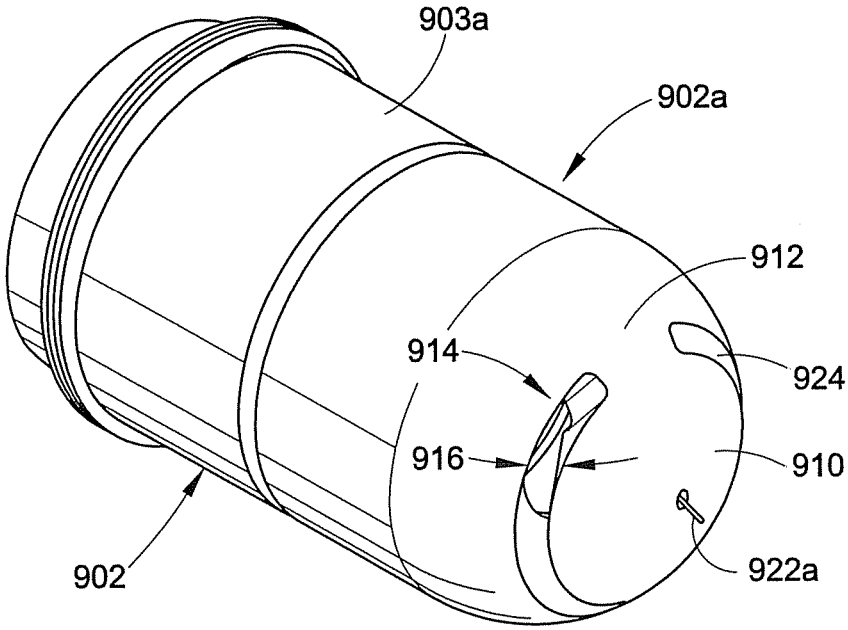
FIGS. 22A-22E illustrate a conical pattern nozzle for a spray applicator in isometric, elevation, front end, cross-section along the line 22D-22D in FIG. 22C and cross-section along the line 22E-22E of FIG. 22C respectively.

FIG. 21 further illustrates the pump control concept of the present invention. Graph A shows flow rate versus pinch valve open duration at a pump cycle rate of 500 msec, and Graph B shows the data for a pump cycle rate of 800 msec. Both graphs are for dual chamber pumps as described herein. First it will be noted that for both graphs, flow rate increases with increasing pinch valve open times. Graph B shows however that the flow rate reaches a maximum above a determinable pinch valve open duration. This is because only so much powder can fill the pump chambers regardless of how long the pinch valves are open. Graph A would show a similar plateau if plotted out for the same pinch valve duration times. Both graphs also illustrate that there is a determinable minimum pinch valve open duration in order to get any powder flow from the pump. This is because the pinch valves must be open long enough for powder to actually be sucked into and pushed out of the pump chambers. Note that in general the faster pump rate of Graph A provides a higher flow rate for a given pinch valve duration.

The data and values and graphs provided herein are intended to be exemplary and non-limiting as they are highly dependent on the actual pump design. The control system 39 is easily programmed to provide variable flow rates by simply having the control system 39 adjust the valve open times for the pinch valves and the suction/pressure times for the pump chambers. These functions are handled by the material flow rate control 632 process.

In an alternative embodiment, the material flow rate from the pump can be controlled by adjusting the time duration that suction is applied to the pump pressure chamber to suck powder into the powder pump chamber. While the overall pump cycle may be kept constant, for example 800 msec, the amount of time that suction is actually applied during the 400 msec fill time can be adjusted so as to control the amount of powder that is drawn into the powder pump chamber. The longer the vacuum is applied, the more powder is pulled into the chamber. This allows control and adjustment of the material flow rate separate from using control of the suction and delivery pinch valves.

Use of the separate pinch valve controls however can augment the material flow rate control of this alternative embodiment. For example, as noted the suction time can be adjusted so as to control the amount of powder sucked into the powder chamber each cycle. By also controlling operation of the pinch valves, the timing of when this suction occurs can also be controlled. Suction will only occur while negative pressure is applied to the pressure chamber, but also only while the suction pinch valve is open. Therefore, at the time that the suction time is finished, the suction pinch valve can be closed and the negative pressure to the pressure chamber can be turned off. This has several benefits. One benefit is that by removing the suction force from the pressure chamber, less pressurized air consumption is needed for the venturi pump that creates the negative pressure. Another benefit is that the suction period can be completely isolated from the delivery period (the delivery period being that time period during which positive pressure is applied to the pressure chamber) so that there is no overlap between suction and delivery. This prevents backflow from occurring between the transition time from suction to delivery of powder in the powder pump chamber. Thus, by using independent pinch valve control with the use of controlling the suction time, the timing of when suction occurs can be controlled to be, for example, in the middle of the suction portion of the pump cycle to prevent overlap into the delivery cycle when positive pressure is applied. As in the embodiment herein of using the pinch valves to control material flow rate, this alternative embodiment can utilize empirical data or other appropriate analysis to determine the appropriate suction duration times and optional pinch valve operation times to control for the desired flow rates.

Thus, the invention contemplates a scalable material flow rate pump output by which is meant that the operator can select the output flow rate of the pump without having to make any changes to the system other than to input the desired flow rate. This can be done through any convenient interface device such as a keyboard or other suitable mechanism, or the flow rates can be programmed into the control system 39 as part of the recipes for applying material to an object. Such recipes commonly include such things as flow rates, voltages, air flow control, pattern shaping, trigger times and so on.

Figure 26:
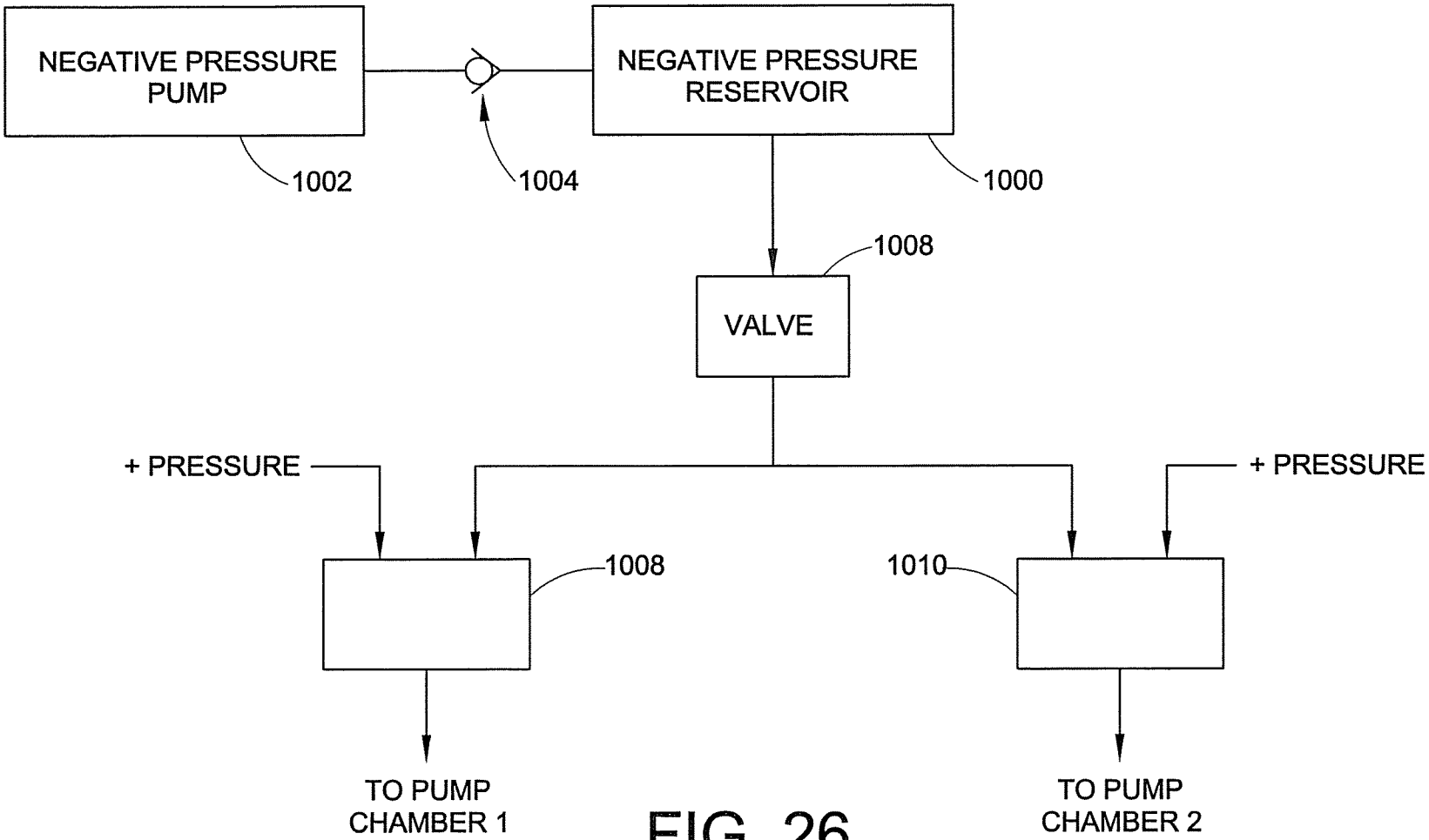
FIG. 26 is a functional schematic of an alternative embodiment of a negative pressure source used by a dense phase pump.

With reference to FIG. 26 we illustrate an alternative embodiment for supplying negative pressure to the gun and transfer pumps. Although FIG. 26 illustrates only a single pump with two pump chambers 1 and 2, the concept is scalable to multiple pumps, and also is applicable to both the gun pump and the transfer pump concepts herein.

It is contemplated that the invention may be used in applications that utilize a large number of guns and pumps. As the system becomes larger there will be a need for multiple venturi pumps to generate the negative pressure needed to operate the suction cycle of the powder pumps. It will also be appreciated that when negative pressure is demanded, there are inherent delays in the arrangement of FIGS. 16, 19 and 20 because in order to build up the negative pressure the venturi pumps must be operating. Also, the venturi pumps consume pressurized air unless they are turned off when there is no demand for negative pressure.

In order to increase the efficiency of the system, a negative pressure accumulator or reservoir 1000 may be added to the system to store negative pressure so that there is always a supply of negative pressure when demanded for the pump chambers, and the negative pressure pumps can be operated independently of the demand for negative pressure from the pumping chambers. In FIG. 26 the negative pressure pump outlet 1002 may be connected to the inlet to a reservoir 1000 through a check valve 1004. The check valve 1004 may be used to allow the reservoir to store negative pressure even after system shutdown. Another control device such as valve 1006 connects the outlet of the reservoir 1000 to the control solenoids 1008 and 1010 that control the application of positive and negative pressure to the pump chambers. For example, in the embodiment of FIG. 16 the valve 1008 and 1010 correspond to valves 548, 550; in the embodiment of FIG. 18 the valve 1008 and 1010 correspond to valves 604, 606; and in the embodiment of FIG. 19 the valve 1008 and 1010 correspond to valve 628.

The use of the reservoir 1000 allows the venturi pump to be off loaded or turned off so as not to consume compressed air until the reservoir is drawn down to the point of needing to be replenished. A sensor (not shown) may be used to determine the need for turning the venturi pump on.

A suitable negative pressure pump is a venturi pump as discussed in the above described embodiments. In those embodiments, the venturi pump may be positioned on the manifold 404 (FIGS. 1 and 15). The reservoir concept may be realized in an alternative form. The plurality of negative pressure pumps 1002 may be positioned in the control cabinet or other location along with the reservoir tank 1000. Individual supply lines can then be run from the reservoir outlet to the various control solenoids for the pump chambers, which may be disposed on the manifold 404. The manifolds 404 may be located with the pumps and reservoir or in a different location as needed.

The invention has been described with reference to the preferred embodiment. Modifications and alterations will occur to others upon a reading and understanding of this specification and drawings. The invention is intended to include all such modifications and alterations insofar as they come within the scope of the appended claims or the equivalents thereof.

We claim:

1. An automatic powder coating spray applicator, comprising: a three piece housing having an inlet end and an outlet end; said housing having a rearward section, a middle section and a forward section; said forward section having a spray nozzle attached to its forward end, a charging electrode and an open rearward end; said middle section being longer than said rearward section and comprising a tubular section having two open ends; said rearward section entirely enclosing a voltage multiplier and having an open front end and a rearward end closed off by a heat sink plate for said multiplier, said heat sink plate including a powder coating material connection and an electrical connection; a first open end of said middle section being secured to and separable from said open front end of said rearward section; a second open end of said middle section being secured to and separable from said open rearward end of said forward section; a powder flow path extending through the housing from said inlet end to said outlet end, wherein said powder flow path is a straight powder path from said inlet end to said outlet end of said three piece housing; and an electrical cable that extends from an outlet of said multiplier in said rearward section through said middle section to a current limiting resistive device that is electrically coupled to said cable and said electrode, said three piece housing being releasably secured together by a tube having a forward portion that is secured to said housing forward section and a rearward portion that engages a member that holds said tube in tension to secure said housing forward section, middle section and rearward section together in compression.

2. The spray applicator of claim 1 wherein said applicator is mounted to a support device by said rearward section.

3. The spray applicator of claim 2 wherein said support device comprises a gun mover.

4. The spray applicator of claim 1 wherein said powder flow path is provided by a powder feed tube that extends from said inlet end to said outlet end.

5. The spray applicator of claim 4 wherein said first open end of said middle section is secured over said open front end of said rearward section in a friction fit and wherein said second open end of said middle section is secured over said open rearward end of said forward section in a friction fit.

6. The spray applicator of claim 1 wherein said tubular section has a non-round cross-section that includes a tapered upper portion.

7. The spray applicator of claim 1 wherein said current limiting resistive device is at least partially disposed in said forward section of said three piece housing.

8. An automatic powder coating spray applicator, comprising: a three piece housing having an inlet end and an outlet end; said housing having a rearward section, a middle section and a forward section; said forward section having a spray nozzle attached to its forward end, a charging electrode and an open rearward end; said middle section being longer than said rearward section and comprising a tubular section having two open ends; said rearward section entirely enclosing a voltage multiplier and having an open front end and a rearward end closed off by a heat sink plate for said multiplier, said heat sink plate including a powder coating material connection and an electrical connection; a first open end of said middle section being secured to and separable from said open front end of said rearward section; a second open end of said middle section being secured to and separable from said open rearward end of said forward section; a powder flow path extending through the housing from said inlet end to said outlet end, wherein said powder flow path is provided by a powder feed tube; and an electrical cable that extends from an outlet of said multiplier in said rearward section through said middle section to a current limiting resistive device that is electrically coupled to said cable and said electrode, and wherein said three piece housing is held together by a tube, said tube being in tension and holds said housing forward section, middle section and rearward section together in compression.

9. The spray applicator of claim 8 wherein said powder feed tube provides a straight powder path from said inlet end to said outlet end.

10. The spray applicator of claim 8 wherein said applicator is mounted to a support device by said rearward section.

11. The spray applicator of claim 10 wherein said support device comprises a gun mover.

12. The spray applicator of claim 8 wherein said first open end of said middle section is secured over said open front end of said rearward section in a friction fit and wherein said second open end of said middle section is secured over said open rearward end of said forward section in a friction fit.

13. The spray applicator of claim 8 wherein said tubular section has a non-round cross-section that includes a tapered upper portion.

14. The spray applicator of claim 8 wherein said current limiting resistive device is at least partially disposed in said forward section of said three piece housing.

15. The spray applicator of claim 8 wherein said tubular section is unitary.

16. The spray applicator of claim 1 wherein said tubular section is unitary.

17. The spray applicator of claim 1 wherein said member comprises a nut.

18. The spray applicator of claim 17 wherein said nut comprises a threaded nut, and said tube forward portion and said tube rearward portion are threaded.

* * * * *